US007731239B2

(12) United States Patent
Nishida et al.

(10) Patent No.: US 7,731,239 B2
(45) Date of Patent: Jun. 8, 2010

(54) CARD FORMING SHEET

(75) Inventors: Masaaki Nishida, Komaki (JP); Takao Tsubouchi, Mie (JP); Mariko Ueki, Kasugai (JP); Kenji Hirose, Kasugai (JP)

(73) Assignee: Kalbas Co., Ltd., Aichi (JP)

( * ) Notice: Subject to any disclaimer, the term of this patent is extended or adjusted under 35 U.S.C. 154(b) by 1013 days.

(21) Appl. No.: 11/056,598

(22) Filed: Feb. 14, 2005

(65) Prior Publication Data

US 2005/0186402 A1 Aug. 25, 2005

(30) Foreign Application Priority Data

| | | |
|---|---|---|
| Feb. 25, 2004 | (JP) | 2004-050406 |
| Apr. 5, 2004 | (JP) | 2004-111039 |
| Apr. 21, 2004 | (JP) | 2004-125863 |
| Oct. 19, 2004 | (JP) | 2004-304680 |

(51) Int. Cl.
*B42D 15/00* (2006.01)
*G09F 1/00* (2006.01)

(52) U.S. Cl. ..... 283/111; 283/117; 283/94; 283/100; 283/98; 283/101; 283/109; 40/124.09; 40/124.01; 40/124.11; 40/124.191

(58) Field of Classification Search ..... 229/68.1, 229/928; 283/94, 100, 110, 111, 117; 428/194, 428/202, 321.5, 914; 493/243; 503/206, 503/215, 226; *B42D 15/02, 27/00; F41A 9/31*
See application file for complete search history.

(56) References Cited

U.S. PATENT DOCUMENTS

| | | | | |
|---|---|---|---|---|
| 2,948,977 | A * | 8/1960 | Meissner | 40/124.09 |
| 3,893,252 | A * | 7/1975 | Chase | 40/773 |
| 4,742,954 | A * | 5/1988 | Shishido | 229/92.8 |
| 5,039,652 | A * | 8/1991 | Doll et al. | 503/206 |
| 5,217,162 | A * | 6/1993 | Shibahara | 229/92.8 |
| 5,516,033 | A * | 5/1996 | Bernetich | 229/92.7 |

FOREIGN PATENT DOCUMENTS

| | | |
|---|---|---|
| JP | 3000414 | 6/1994 |
| JP | 08-230358 | 9/1996 |
| JP | 09-039451 | 2/1997 |
| JP | 11-342682 | 12/1999 |
| JP | 2000-211270 | 8/2000 |
| JP | 3084782 | 12/2001 |

* cited by examiner

*Primary Examiner*—Dana Ross
*Assistant Examiner*—Justin V Lewis
(74) *Attorney, Agent, or Firm*—Wenderoth, Lind & Ponack L.L.P.

(57) ABSTRACT

A card forming sheet includes an opaque printing sheet and a transparent film placed over the printing sheet, so that the transparent film can be peeled away from the printing sheet and cannot be re-bonded to the printing sheet. Moreover, the card forming sheet includes a transparent adhesive and a peeling sheet placed over the adhesive layer. The printing sheet is divided into a substantially rectangular address describing part, an information describing part adjacent to one side of the address describing part, and a concealing part adjacent to another side of the address describing part. The card forming sheet is folded along a boundary between the address describing part and the information describing part. The two sides are bonded together so that the printing sheet is placed to the outside, and the card forming sheet is then folded along a boundary between the concealing part and the address describing part and bonded together, removably concealing the information.

6 Claims, 71 Drawing Sheets

CARD FORMING SHEET

BACKGROUND OF THE INVENTION

1. Field of the Invention

The present invention relates to a card forming sheet capable of concealing information.

2. Description of the Prior Art

When insurance companies or the like provide notification of confidential information, or when such companies mail personal information such as details concerning bank transfers, concealing postcards 100 as shown in FIG. 63 have been used (for example, see Japanese Patent Laid-Open No. 11-20350 (FIG. 1)). Such a concealing postcard 100 conceals personal information 101 by attaching a concealing seal 103, having a quasi-adhesive layer, to a printed part after the personal information 101 is printed. Customers or the like who receive the postcard, peel the quasi-adhesive layer of the seal 103 in order to read the personal information.

In the conventional concealing postcard, however, the seal is a separate piece apart from the postcard, and proper positioning of the seal onto the personal information part is difficult.

SUMMARY OF THE INVENTION

The invention is completed based on the above described circumstances, and has a first object to provide a card forming sheet that allows for the easy positioning of a concealing member when concealing confidential information.

Generally, for example, pay statements have been handed to individual workers with each pay statement printed on a piece of paper and the piece of paper being subsequently placed in an envelope (for example, see Japanese Utility Model Registration No. 3084782). Such a type of pay statement requires a careful check to match the name on the statement to the name on the envelope, which takes effort.

Sometimes a special envelope has been used that has a window opening in a section corresponding to the location of the name describing portion of the pay statement.

Both of these cases, however, require placing the pay statement in an envelope and then sealing the envelope, all of which takes effort. Also, there is the need to prepare the envelope, which increases costs and increases wastes, causing the cases to be environmentally unfriendly. Further, a pay stub for the pay statement has to be separately printed for the company records.

The invention is achieved in view of the above described circumstances, and has as a second object to provide a card forming sheet that can protect personal information, such as the information printed on a pay statement, so as to not be visible or readable from the outside, and to form a pay stub at the same time.

A card forming sheet according to the invention includes: an opaque printing sheet; a transparent film placed over the printing sheet so that the printing sheet can be peeled from the transparent film and cannot be subsequently re-bonded to the transparent film; a transparent adhesive layer placed over the transparent film; and a peeling sheet placed over the adhesive layer.

The printing sheet is divided into a substantially rectangular address describing part, a substantially rectangular information describing part adjacent to one side of the address describing part, and a substantially rectangular concealing part adjacent to one different side of the address describing part.

The card forming sheet is folded along a boundary between the information describing part and the address describing part so that the printing sheet is placed to the outside, with the peeling sheets on backsides of the information describing part and the address describing part being peeled away so as to expose the adhesive layer. The information describing part can then be placed over and bonded to the address describing part.

The card forming sheet is then folded along a boundary between the concealing part and the address describing part so that the printing sheet is placed to the outside. The adhesive layer exposed by peeling the peeling sheet on a backside of the concealing part can be placed over and bonded to the information describing part.

In order to use a card forming sheet according to the invention, first, an address or the like of a customer is printed on the address describing part. Personal or confidential information to be communicated to the customer is printed on the information describing part.

The card forming sheet is then folded along the boundary between the address describing part and the information describing part so that the printing sheet is placed to the outside. The peeling sheets on the backsides of the information describing part and the address describing part are peeled to expose the adhesive layers. The information describing part is placed over and bonded to the address describing part.

The card forming sheet is then folded along the boundary between the concealing part and the address describing part so that the printing sheet is placed to the outside. The adhesive layer exposed by peeling the peeling sheet on the backside of the concealing part is placed over and bonded to the information describing part. Consequently, completing a card to be used as a postcard or the like.

Thereby, according to the invention, the card forming sheet may be simply folded along the boundary between the concealing part and the address describing part in order to conceal the personal or confidential information printed on the information describing part of the printing sheet. As a result, allowing easier positioning than the case where a concealing seal is separately formed and applied.

A customer who receives the postcard or the like formed using the card forming sheet can peel the concealing part and see the personal information printed on the information describing part through the transparent film and the adhesive layer. And after being peeled, the concealing part cannot be reattached or re-bonded to the transparent film. Thus, once the concealing part has been initially peeled away, the peeling is clearly perceivable, which is advantageous in ensuring confidentiality.

DETAILED DESCRIPTION OF THE PREFERRED EMBODIMENTS

First Embodiment

Figure 1:
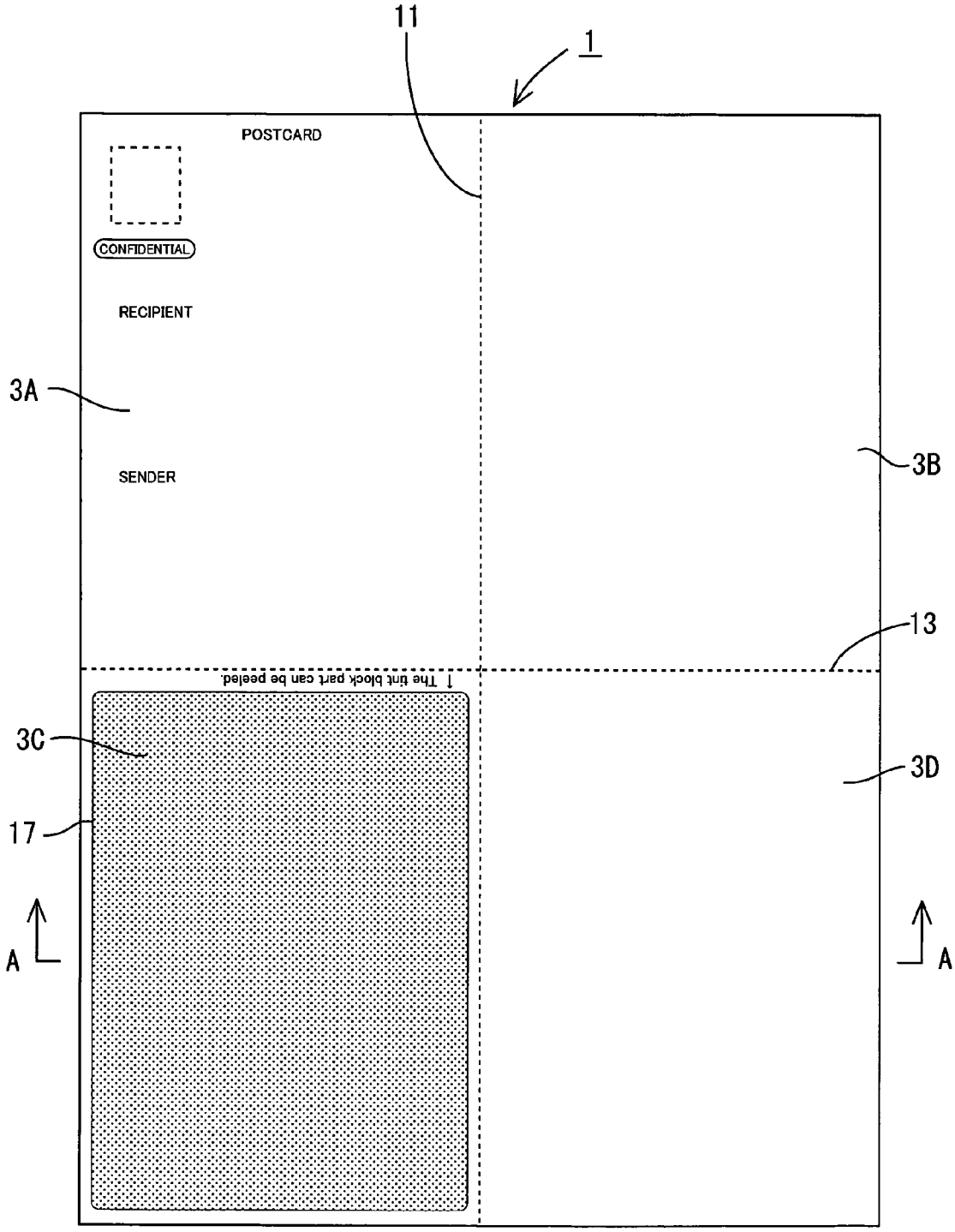
FIG. 1 is a front view of a postcard forming sheet according to a first embodiment.
Figure 2:
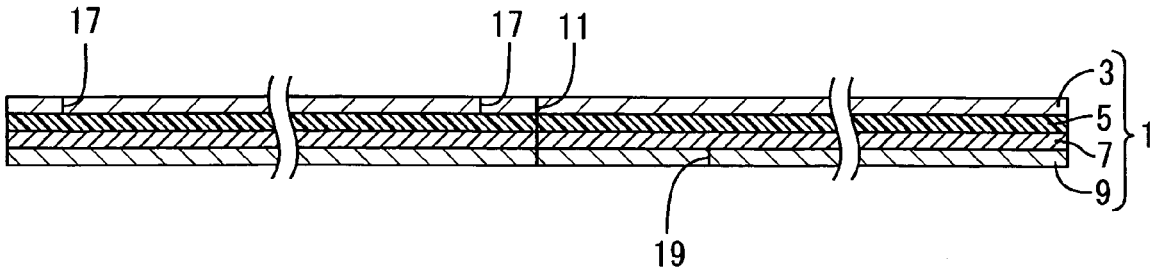
FIG. 2 is a sectional view taken along the line A-A in FIG. 1.

Now, a first embodiment of the invention will be described with reference to FIGS. 1 to 13.

A postcard forming sheet 1 (corresponding to a card forming sheet according to the invention), according to one embodiment, is used for example when creating a bank transfer notification to be sent to a customer from an insurance company. The postcard forming sheet 1 is a substantially A4 size sheet having a four layer structure. The four layer structure includes a printing sheet 3, having a print surface on which printing can be applied by a printer; a transparent film 5 placed over the printing sheet 3 so that the printing sheet 3 can be peeled from the transparent sheet 5 by breaking the quasi-bonding between the two and the printing sheet 3 subsequently cannot be bonded again to the transparent sheet 5; a transparent adhesive layer 7 placed over the transparent film 5; and a peeling sheet 9 placed over the adhesive layer 7.

The printing sheet 3 for example, is made of paper and has a thickness of about 60 μm. The transparent film 5 may be made of a thermoplastic resin such as polyethylene and has a thickness of about 25 μm. The adhesive layer 7 is made of a general transparent adhesive and has a thickness of about 10 μm. The peeling sheet 9 has a thickness of about 60 μm.

On the postcard forming sheet 1, linear first perforations 11, connecting the central portions of the upper and lower short sides of the sheet (horizontal edges in FIG. 1), and linear second perforations 13, connecting the central portions of the left and right long sides of the sheet (vertical edges in FIG. 1), cross each other. These perforations 11 and 13 penetrate the postcard forming sheet 1 from the printing sheet 3 through to the peeling sheet 9.

The printing sheet 3 is divided by the perforations 11 and 13 into a rectangular address describing part 3A of substantially postcard size, an information describing part 3B adjacent to a right long side of the address describing part 3A in FIG. 1 (corresponding to one side of the invention) and of substantially the same size and shape as the address describing part 3A, a concealing part 3C adjacent to a lower short side of the address describing part 3A (corresponding to one different side of the invention), also of substantially the same size and shape as the address describing part 3A and on which a tint block is printed, and a remaining non-used part 3D.

The postcard forming sheet 1 generally has a uniform laminated structure of substantially the same thickness. The postcard forming sheet 1 also has a good printing property (paper feeding property or the like) for printing on the postcard forming sheet 1 by a printer (such as a laser printer or an inkjet printer for example).

In the concealing part 3C, a first slit 17 of closed-loop shape is formed so as to loop around a few millimeters to the inside of the edge of the concealing part 3C. The first slit 17 allows the interior area bounded by the first slit 17 to be peeled away.

Figure 3:
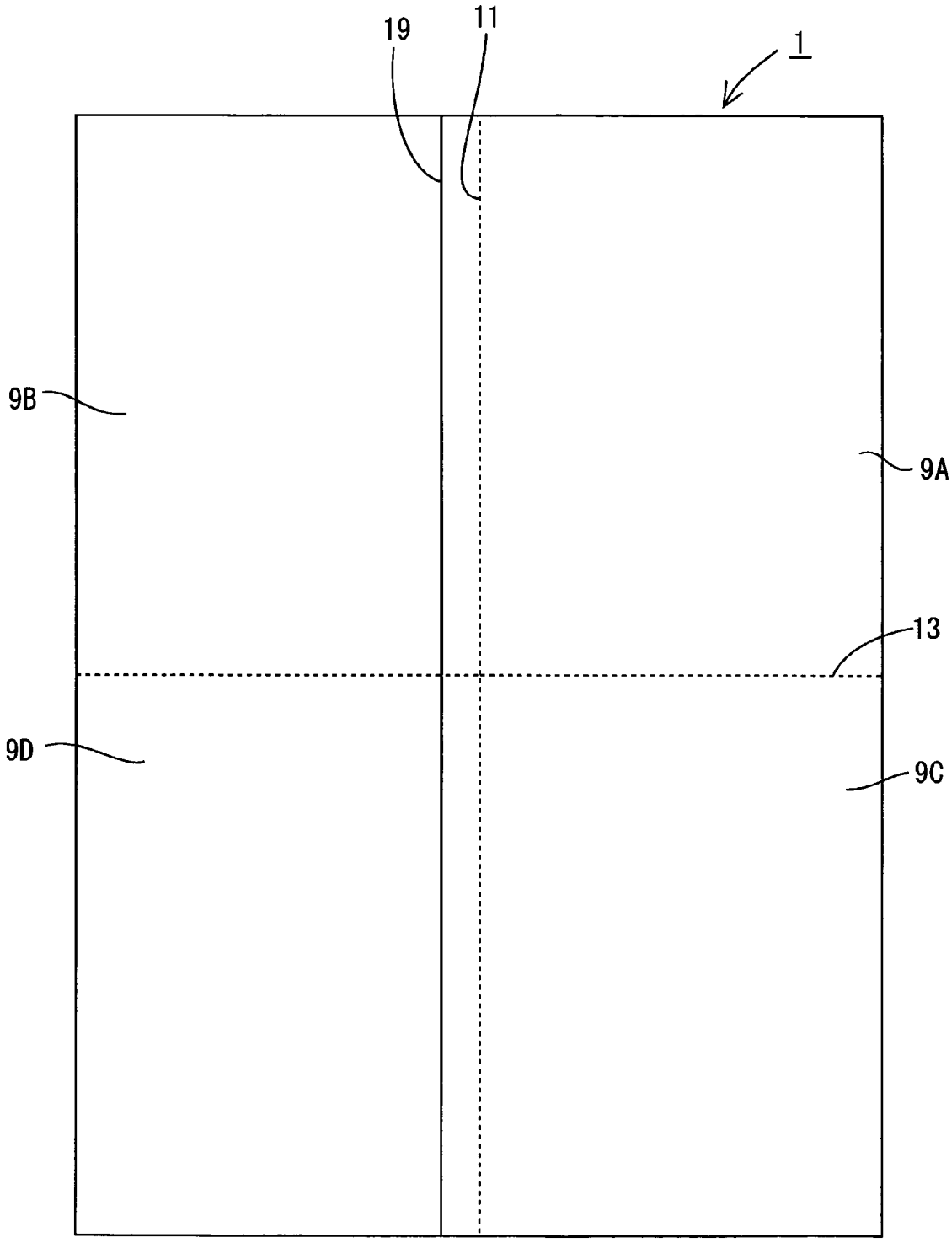
FIG. 3 is a back view of the postcard forming sheet.

On the peeling sheet 9, placed upon the back surfaces of the information describing part 3B and the non-used part 3D, a second slit 19, parallel to the first perforations 11, is formed in a position close to the first perforations 11 as shown in FIG. 3. In the drawings, the peeling sheet placed upon a back surface of the address describing part 3A is denoted by reference numeral 9A, the peeling sheet placed upon the back surface of the information describing part 3B is denoted by reference numeral 9B, the peeling sheet placed upon a back surface of the concealing part 3C is denoted by reference numeral 9C, and the peeling sheet placed upon the back surface of the non-used part 3D is denoted by reference numeral 9D.

Next, a method of using the postcard forming sheet 1 will be described.

Figure 4:
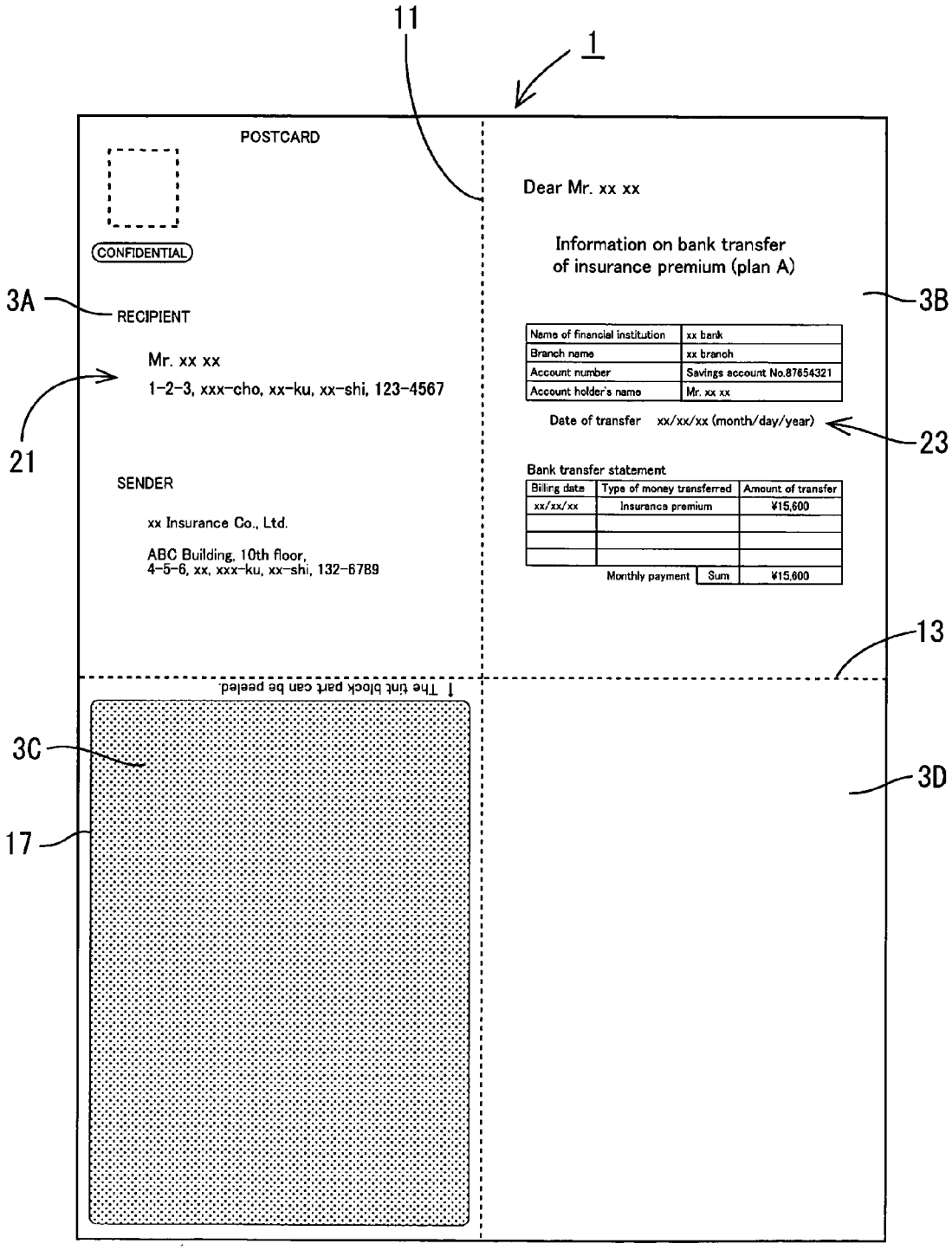
FIG. 4 is a front view of the postcard forming sheet showing a process of forming a postcard.

In the use of the postcard forming sheet 1, first, as shown in FIG. 4, an address 21 or the like of a customer is printed on the address describing part 3A, and personal information 23, to be privately communicated to the customer, is printed on the information describing part 3B. With this embodiment, the address 21 and the personal information 23 can be printed at the same time via single-sided printing.

Figure 5:
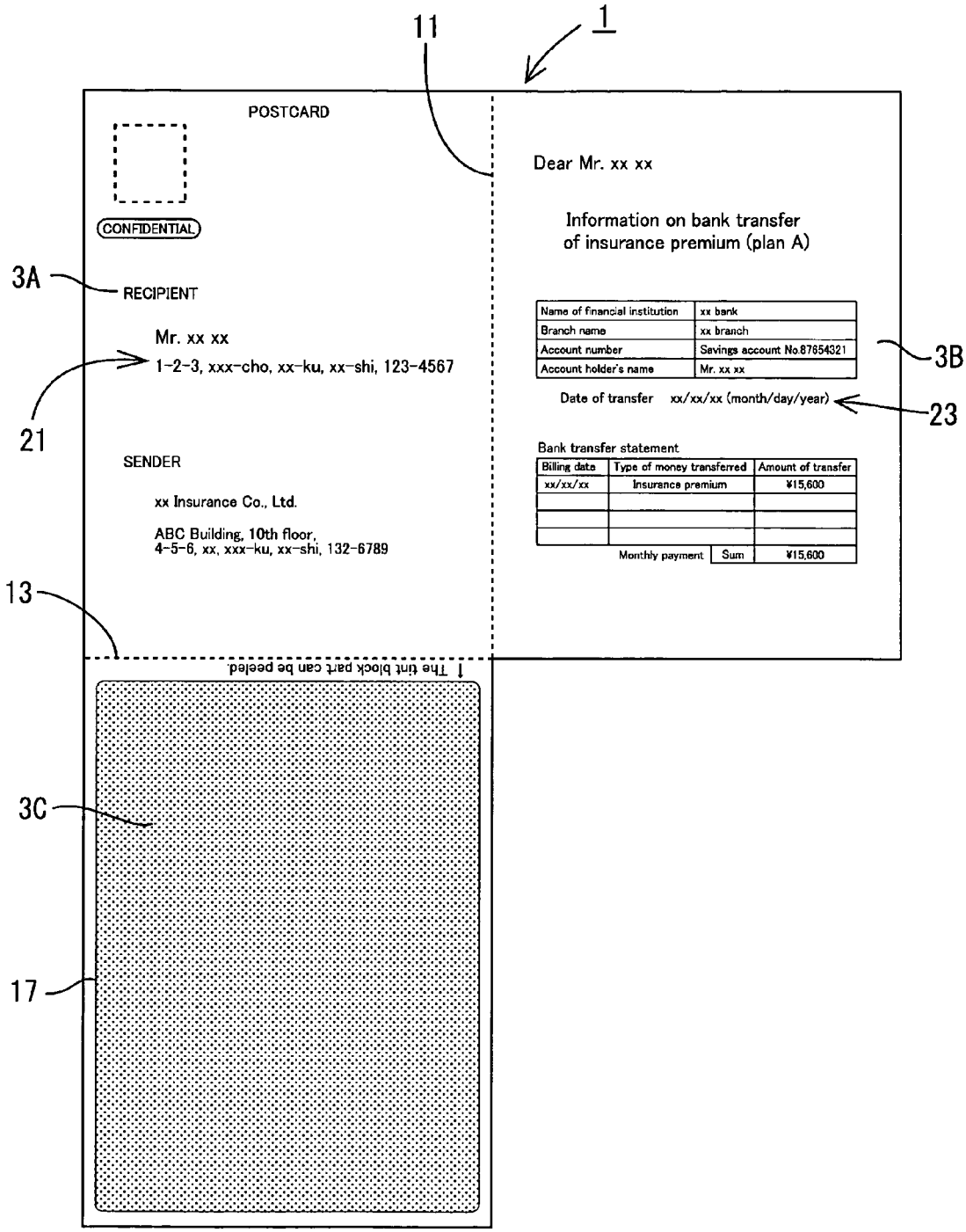
FIG. 5 is a front view of the postcard forming sheet showing the process of forming the postcard.

As shown in FIG. 5, the non-used part 3D is torn away along the first perforations 11 and the second perforations 13.

Figure 6:
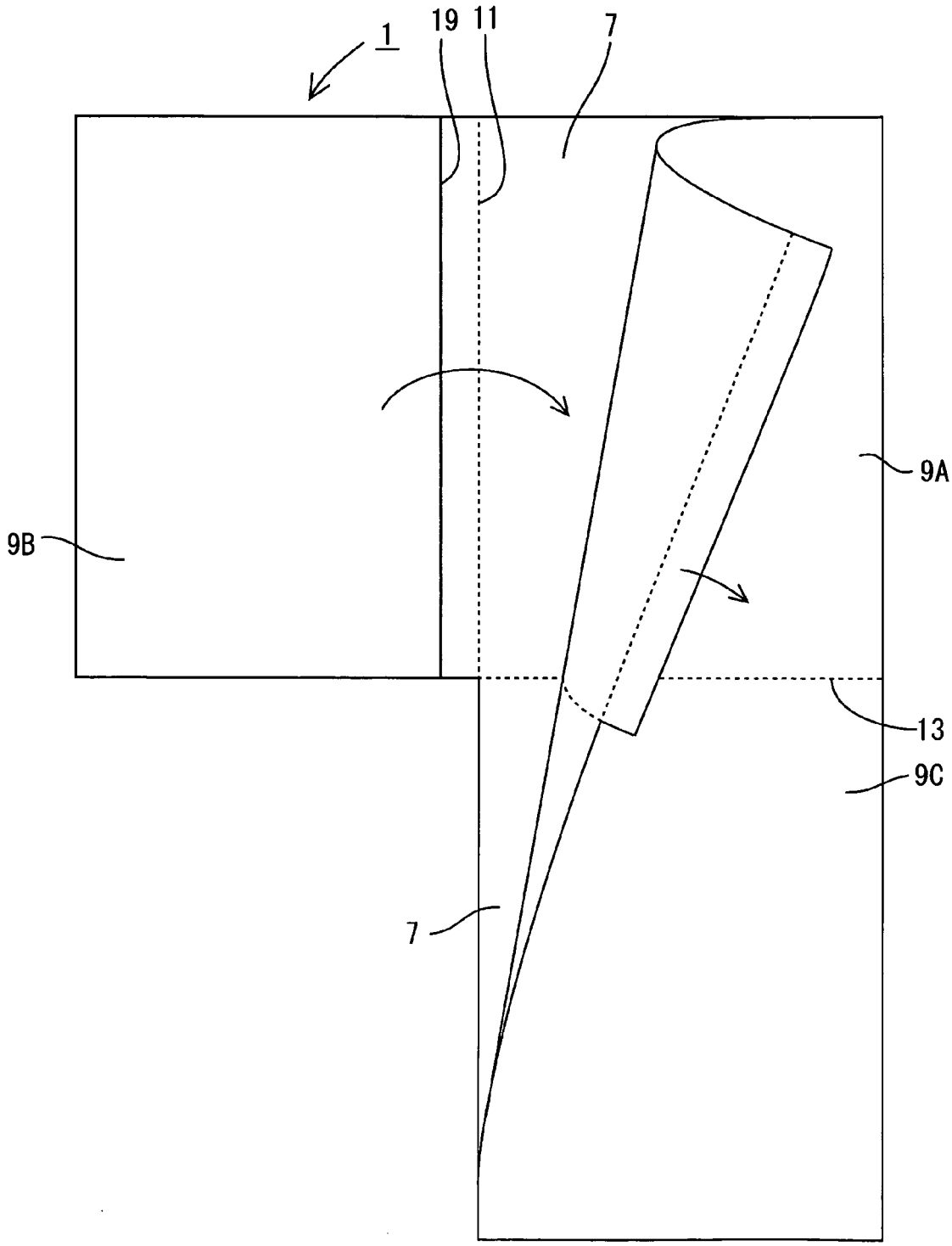
FIG. 6 is a back view of the postcard forming sheet showing the process of forming the postcard.
Figure 7:
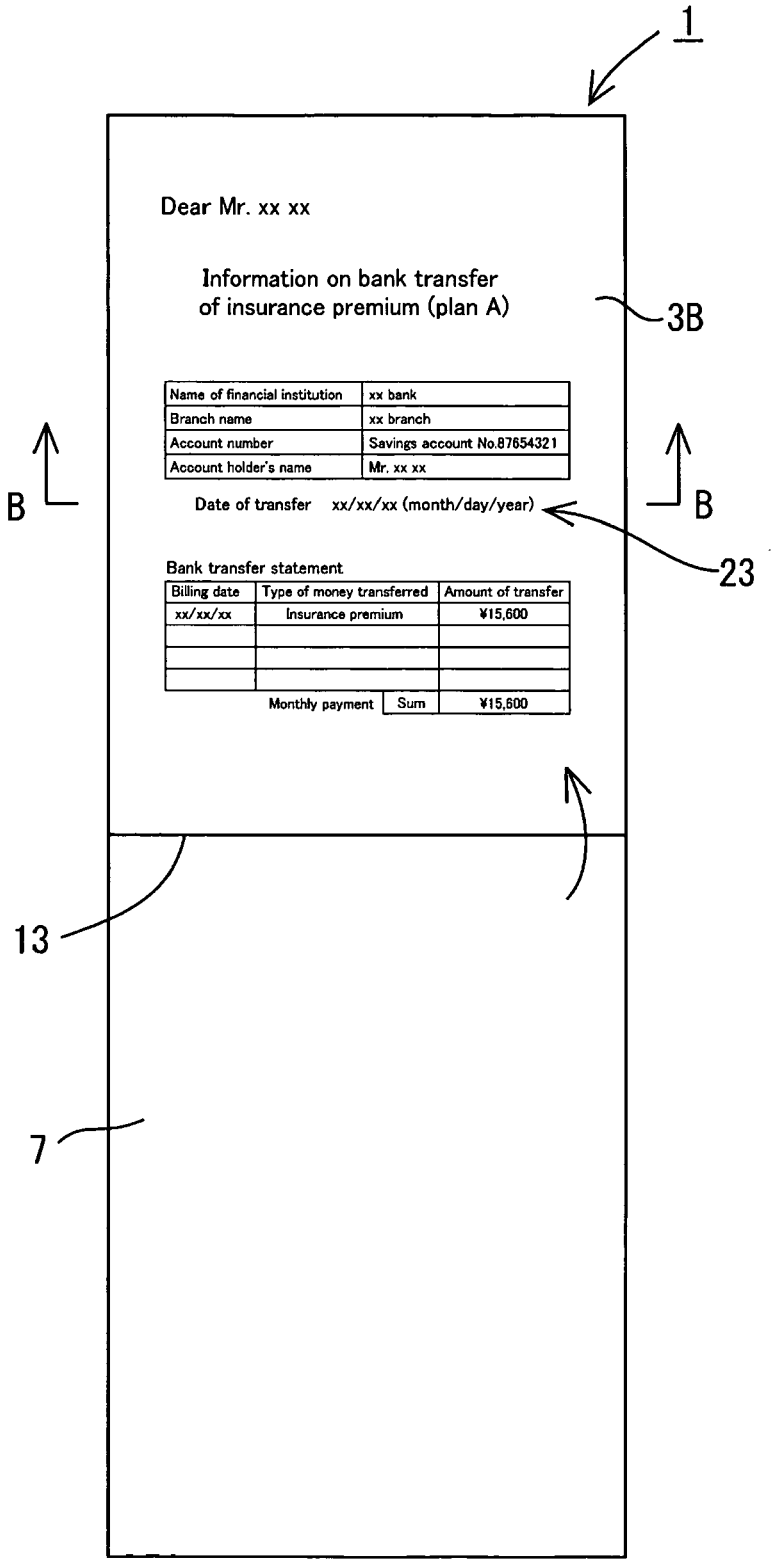
FIG. 7 is a back view of the postcard forming sheet showing the process of forming the postcard.
Figure 8:
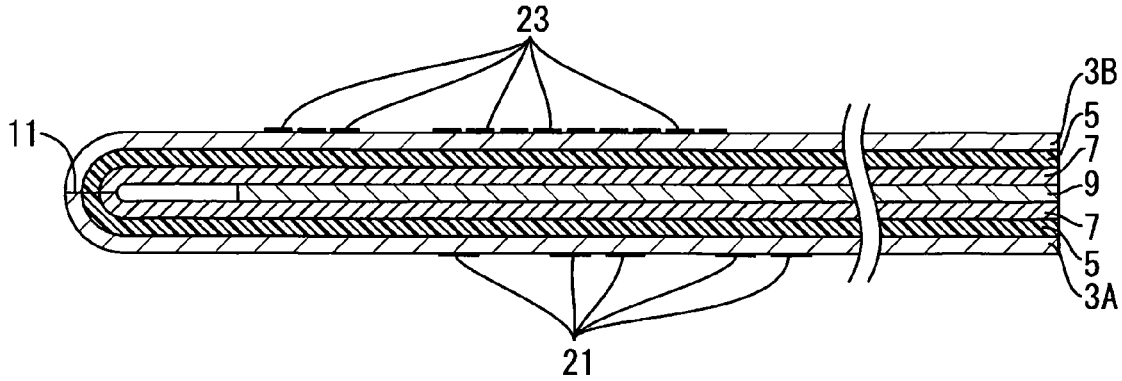
FIG. 8 is a sectional view taken along the line B-B in FIG. 7.

Then, as shown in FIG. 6, the peeling sheet 9 is peeled away along the second slit 19 in order to expose the adhesive layer 7 on the back surfaces of the address describing part 3A and the concealing part 3C.

The information describing part 3B is then folded along the first perforations 11 to bond together the back surfaces of the address describing part 3A and the information describing part 3B. This creates a postcard having the information describing part 3B on one surface and the address describing part 3A on the other surface, with the concealing part 3C being connected below (see FIGS. 7 and 8).

Figure 9:
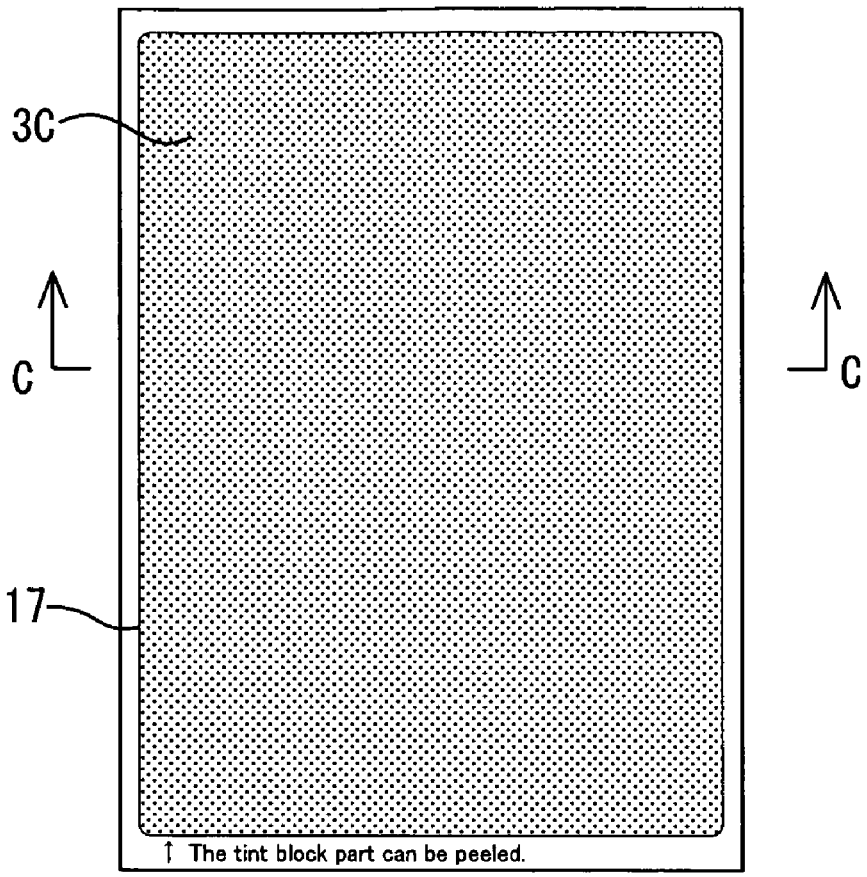
FIG. 9 is a back view of a completed postcard.
Figure 10:
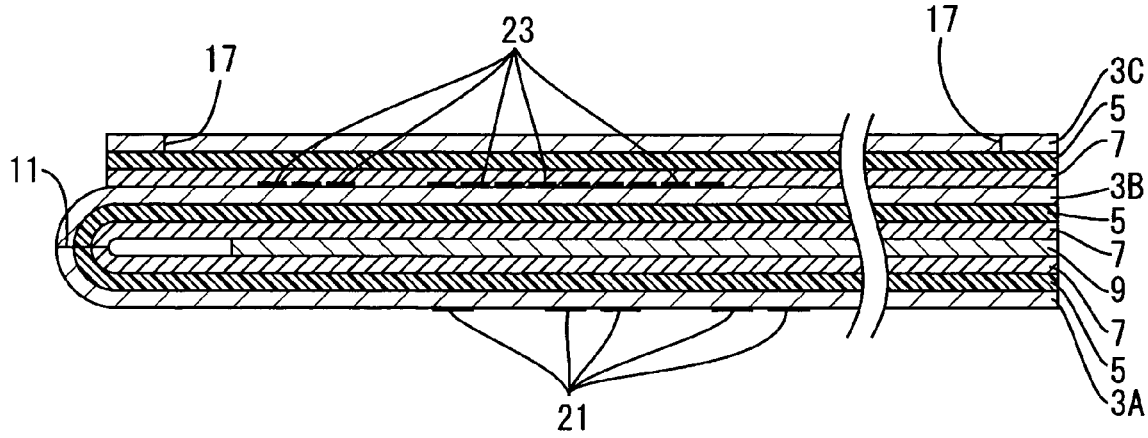
FIG. 10 is a sectional view taken along the line C-C in FIG. 9.
Figure 11:
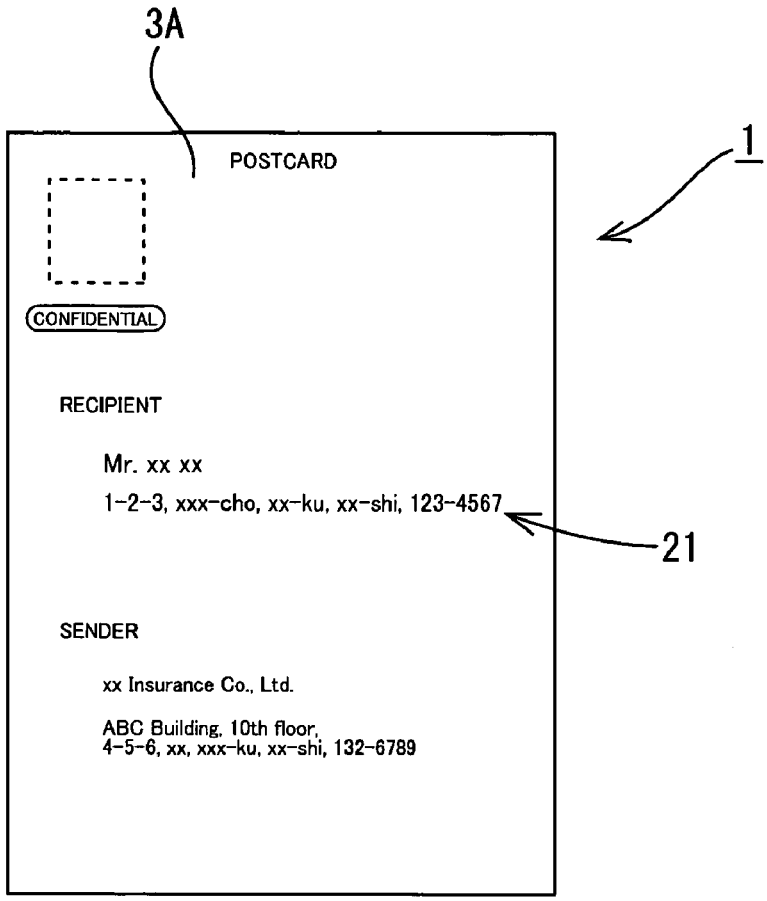
FIG. 11 is a front view of a completed postcard.

The concealing part 3C is folded along the second perforations 13 and bonded onto the information describing part 3B so as to complete the postcard that conceals the personal information 23 (see FIGS. 9, 10 and 11). Consequently, an operator can easily form a concealing postcard by simply folding the postcard forming sheet 1 along the first perforations 11 and the second perforations 13.

Figure 12:
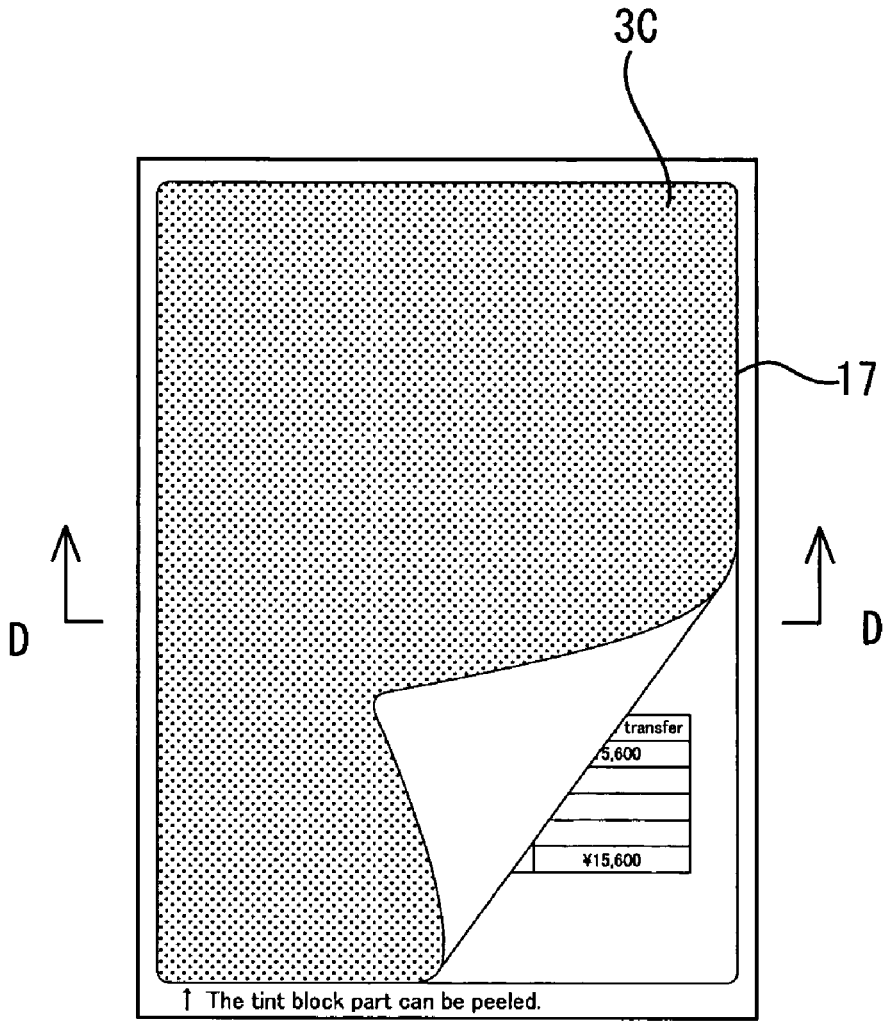
FIG. 12 is a back view of a state of use of the postcard.
Figure 13:
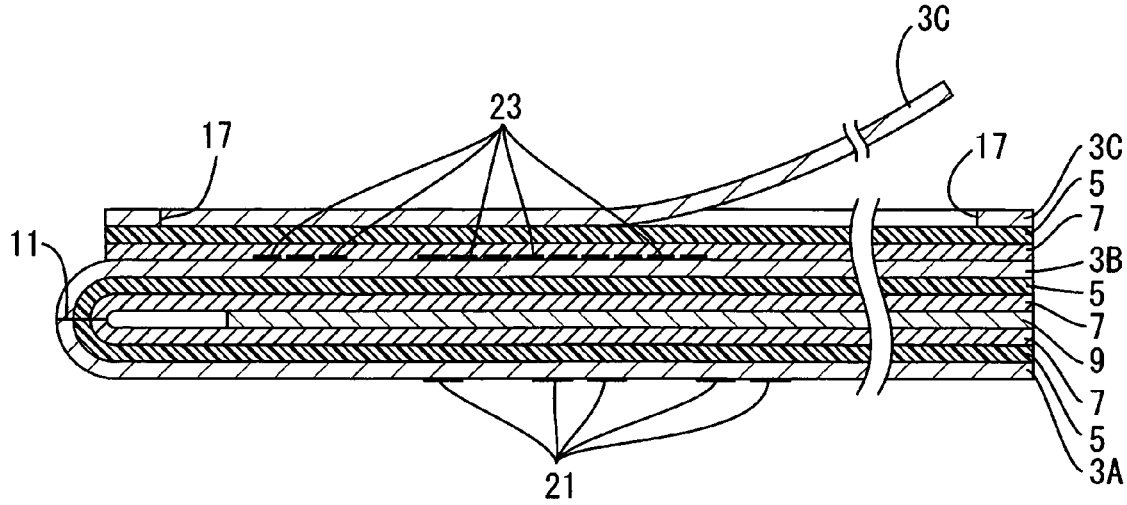
FIG. 13 is a sectional view taken along the line D-D in FIG. 12.

A customer who receives a postcard formed using such a postcard forming sheet 1 merely peels away the concealing part 3C, on which the tint block is printed, along the first slit 17 as shown in FIGS. 12 and 13. The customer can then see the personal information 23 printed on the information describing part 3B through the transparent film 5 and the adhesive layer 7.

As described above, according to this embodiment the postcard forming sheet 1 may simply be folded along a boundary between the concealing part 3C and the address describing part 3A in order to conceal the personal information 23 described on the information describing part 3B. As a result, allowing easier positioning than the case where a concealing seal is separately formed and applied.

According to this embodiment, the section of second perforations 13, operating as a fold line, are previously formed on the boundary between the address describing part 3A and the concealing part 3C. Therefore, folding the postcard forming sheet 1 along the section of the second perforations 13 allows for easier positioning of the concealing part 3C when attempting to conceal personal information 23.

Also according to this embodiment, a tint block is printed on the concealing part 3C. Therefore, other people cannot read the personal information 23 through the concealing part 3C.

Further, according to this embodiment, the postcard forming sheet 1 is of substantially A4 size. The address describing part 3A, the information describing part 3B, and the concealing part 3C, are partitioned by the crossing perforations (the first perforations 11 and the second perforations 13) formed in the postcard forming sheet 1. Consequently, the address and the personal information 23 can be easily printed using a general-purpose printer without having to apply special paper settings.

Second Embodiment

Figure 14:
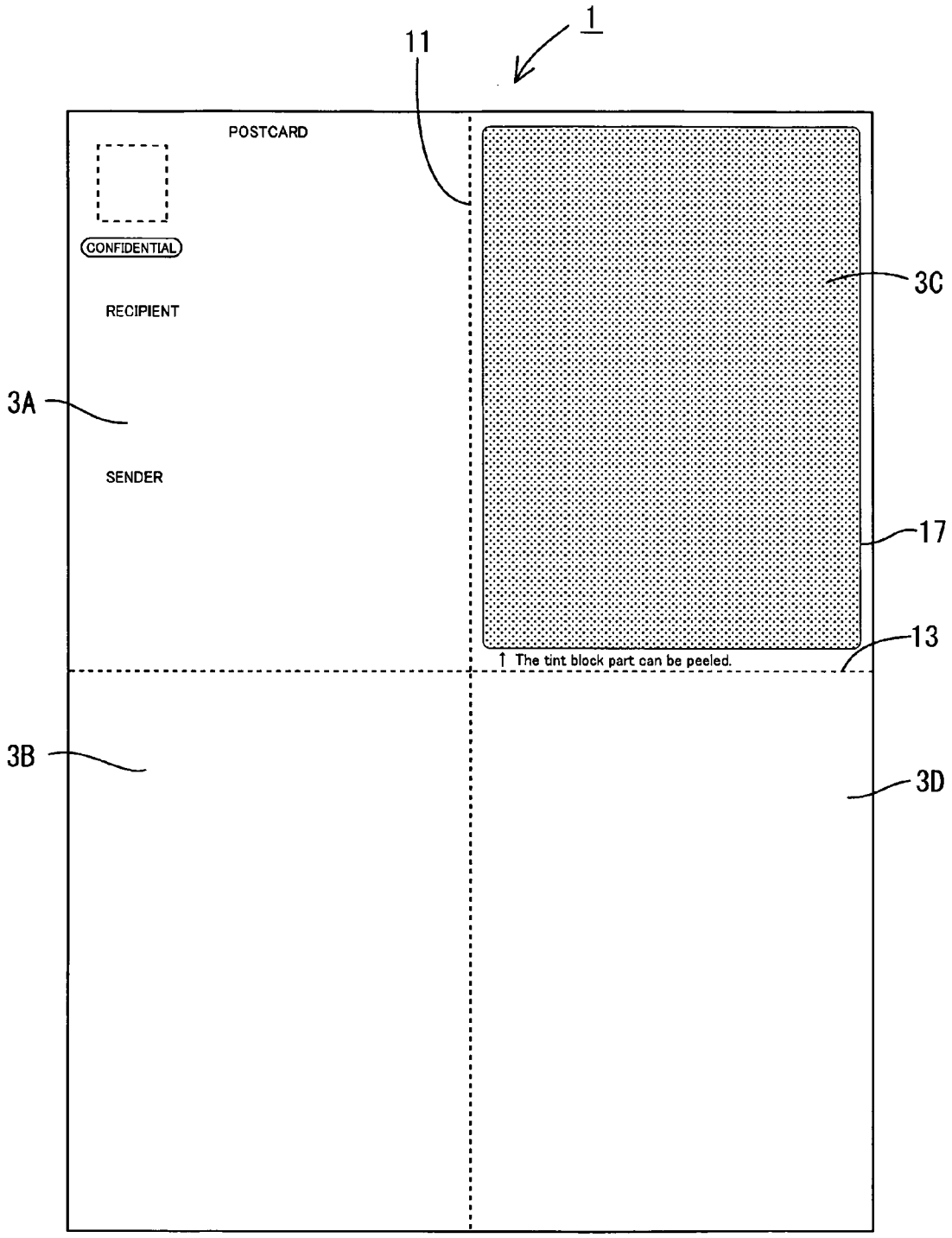
FIG. 14 is a front view of a postcard forming sheet according to a second embodiment.
Figure 15:
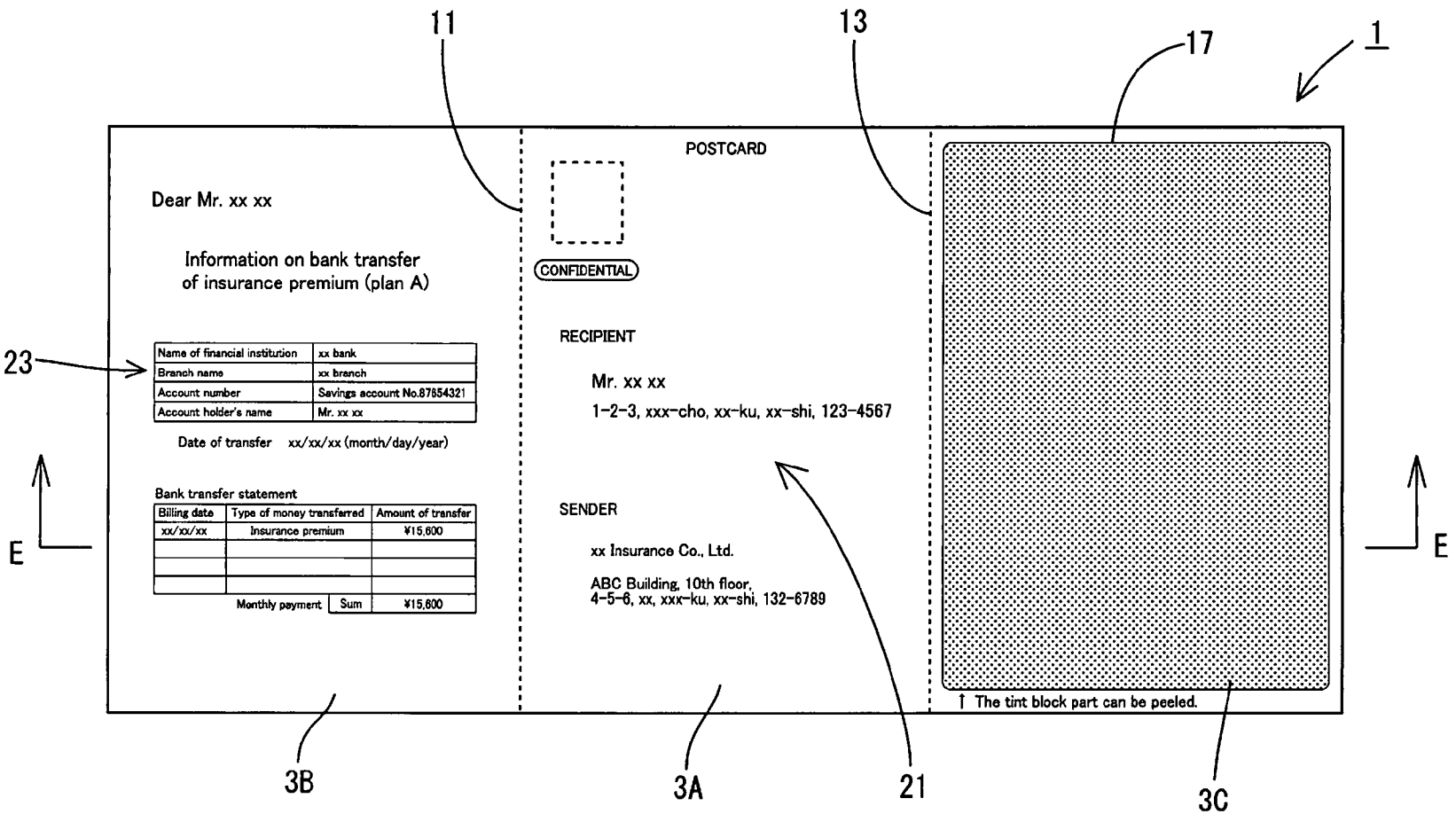
FIG. 15 is a front view of a postcard forming sheet according to a third embodiment.
Figure 16:
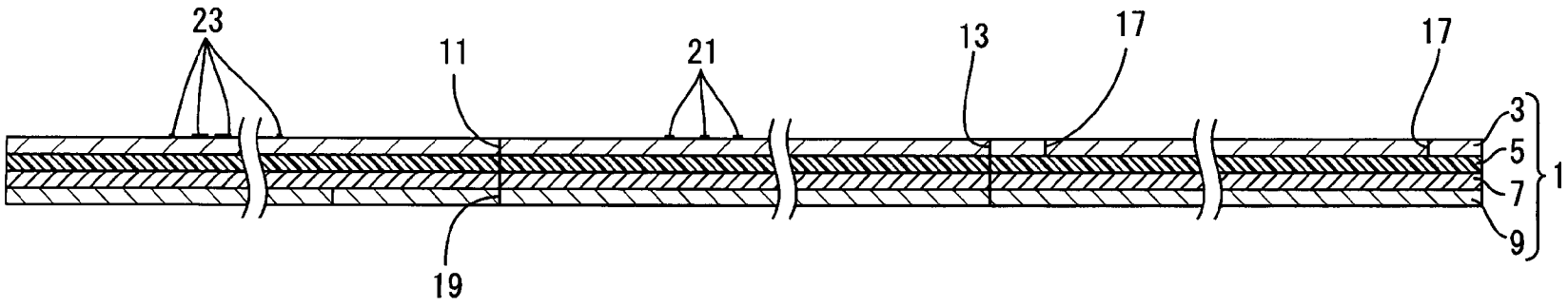
FIG. 16 is a sectional view taken along the line E-E in FIG. 15.
Figure 17:
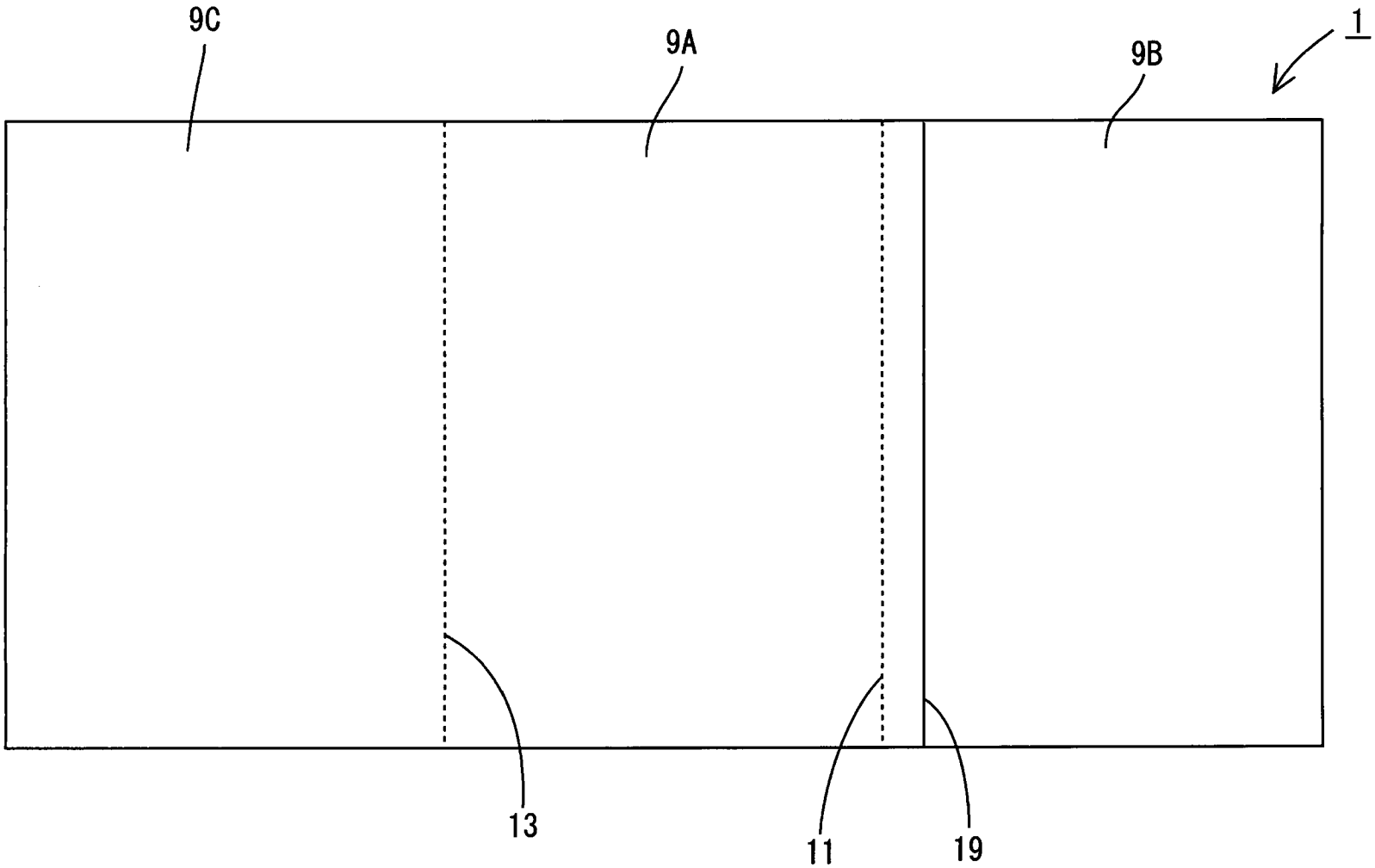
FIG. 17 is a back view of the postcard forming sheet.

Next, a second embodiment of the invention will be described with reference to FIG. 14. The same components as in the first embodiment will be denoted by the same reference numerals, and descriptions of similar structures, operations, and advantages thereof will be omitted.

In the second embodiment, the layout of an address describing part 3A, an information describing part 3B, and a concealing part 3C, is different from the layout in the first embodiment. Specifically, in the second embodiment there are formed: an address describing part 3A, an information describing part 3B adjacent to a lower short side of the address describing part 3A (corresponding to one side of the invention) and of substantially the same size and shape as the address describing part 3A, a concealing part 3C adjacent to a right long side of the address describing part 3A (corresponding to one different side of the invention) of substantially the same size and shape as the address describing part 3A and upon which a tint block is printed, and a remaining non-used part 3D.

Third Embodiment

Next, a third embodiment of the invention will be described with reference to FIGS. 15 to 19. The same components as in the first embodiment will be denoted by the same reference numerals, and descriptions of similar structures, operations, and advantages thereof will be omitted.

In the third embodiment, the layout of an address describing part 3A, an information describing part 3B, and a concealing part 3C, is different from the layout shown in the first embodiment. Specifically, in the third embodiment there are formed: a substantially rectangular address describing part 3A, an information describing part 3B adjacent to one long side of the address describing part 3A (corresponding to one side of the invention) and of substantially the same size and shape as the address describing part 3A, and a concealing part 3C adjacent to the other long side of the address describing part 3A (corresponding to one different side of the invention) of substantially the same size and shape as the address describing part 3A and upon which a tint block is printed.

A method of using a postcard forming sheet 1 according to this embodiment will be described next.

In the use of the postcard forming sheet 1, an address 21 or the like of a customer is printed on the address describing part 3A and personal information 23 is printed on the information describing part 3B.

Figure 18:
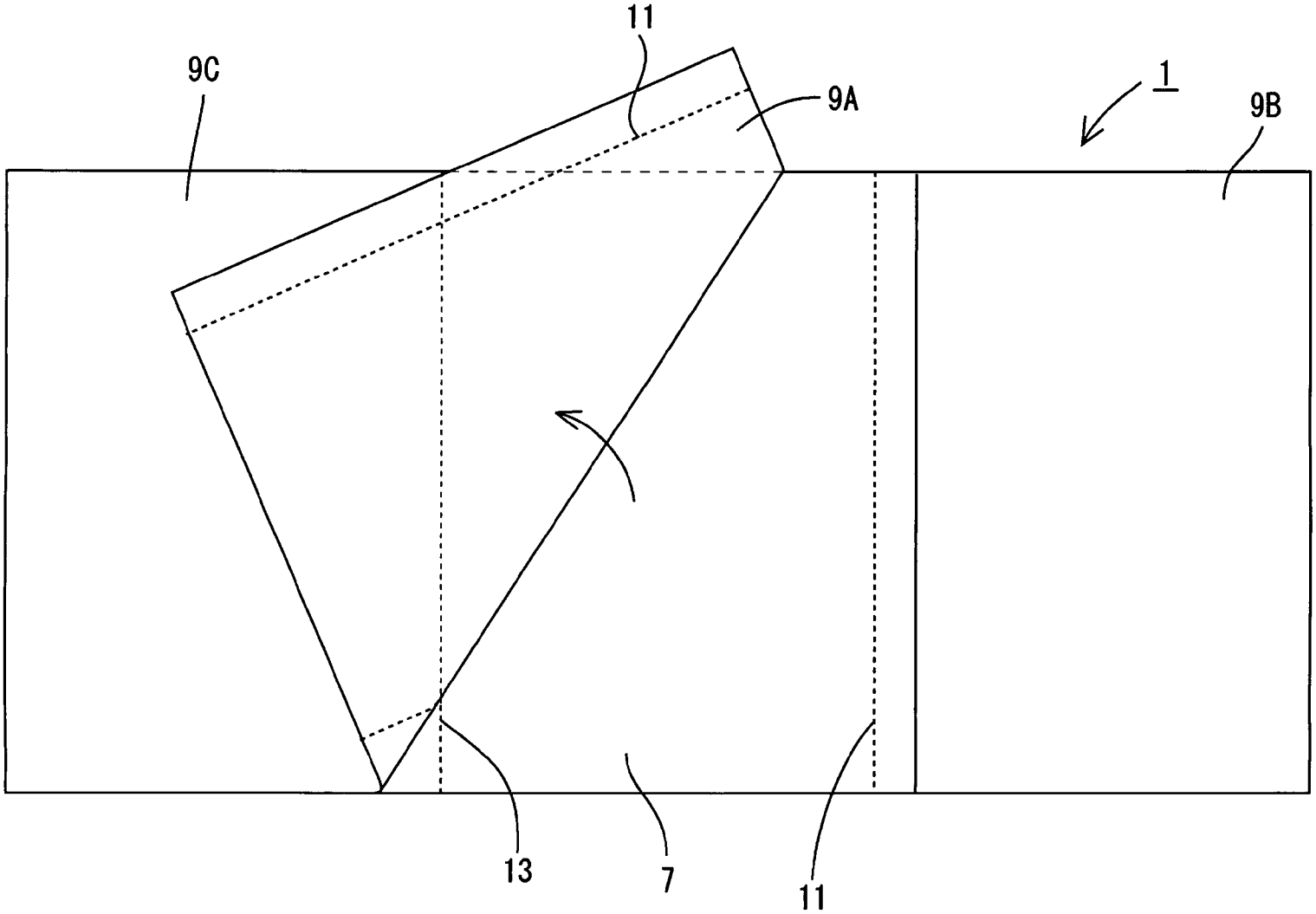
FIG. 18 is a back view of the postcard forming sheet showing a process of forming a postcard.

As shown in FIG. 18, a peeling sheet 9 is then peeled away to expose an adhesive layer 7 on the back surfaces of the address describing part 3A and the concealing part 3C.

The information describing part 3B is subsequently folded along the first perforations 11 to bond together the back surfaces of the address describing part 3A and the information describing part 3B.

Figure 19:
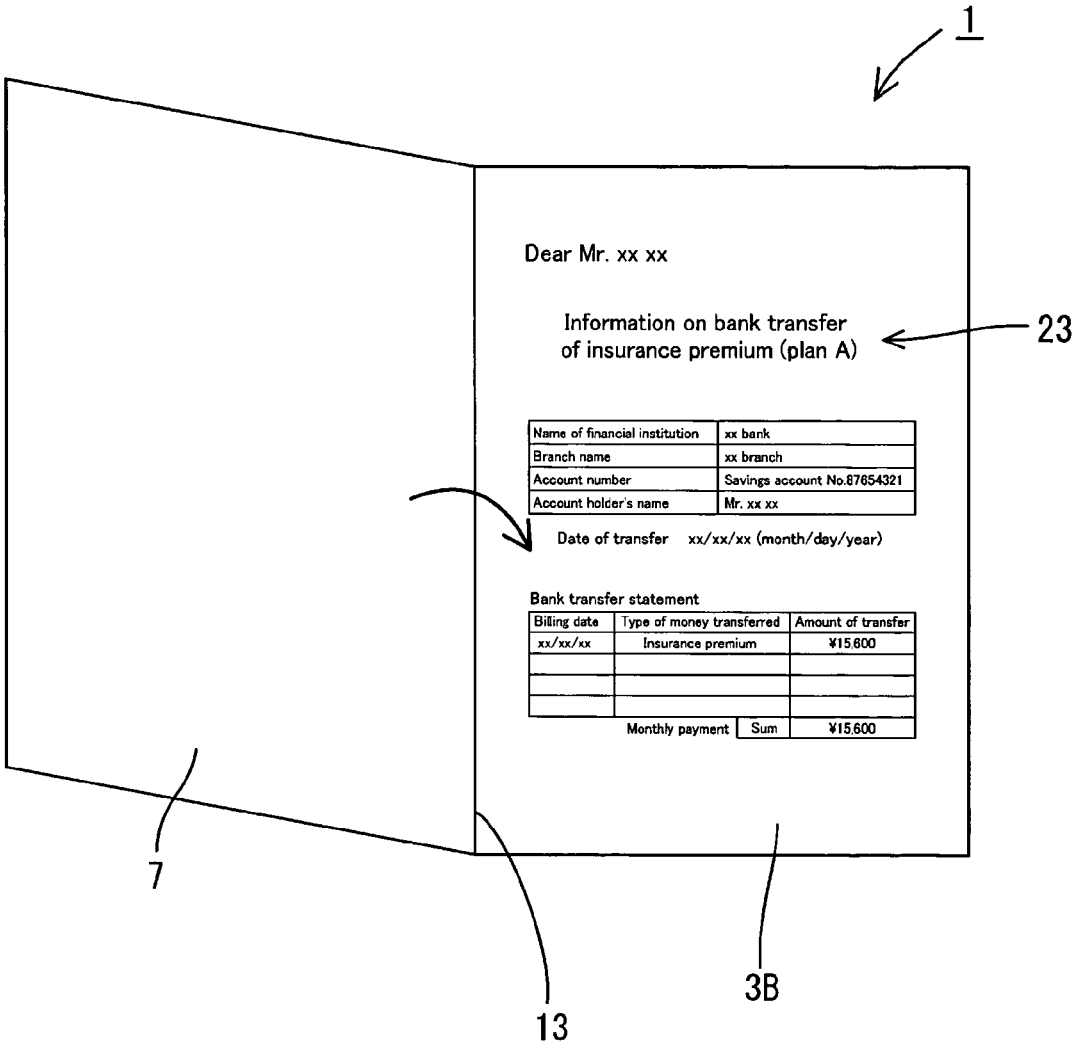
FIG. 19 is a back view of the postcard forming sheet showing the process of forming the postcard.
Figure 20:
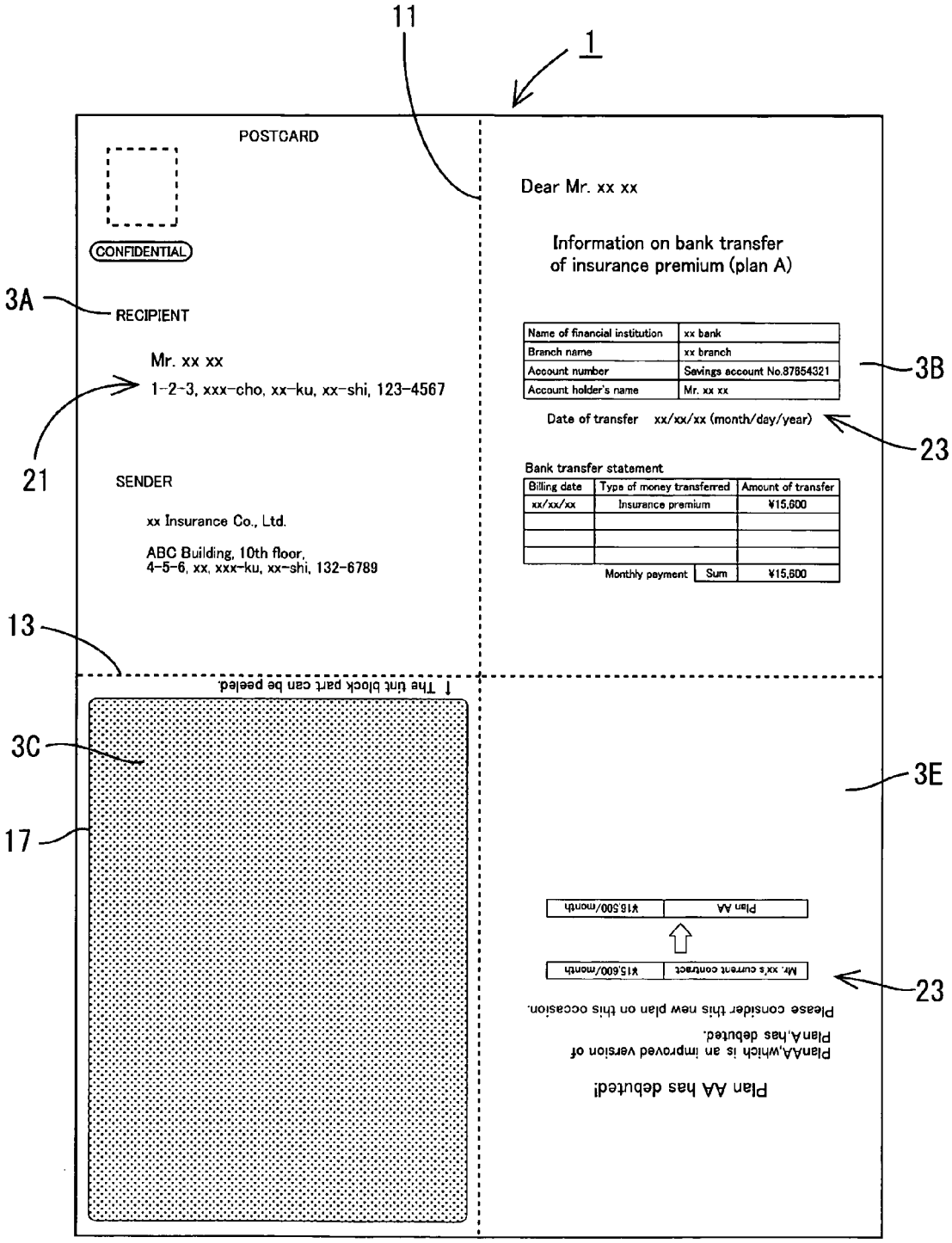
FIG. 20 is a front view of a fourth embodiment.
Figure 21:
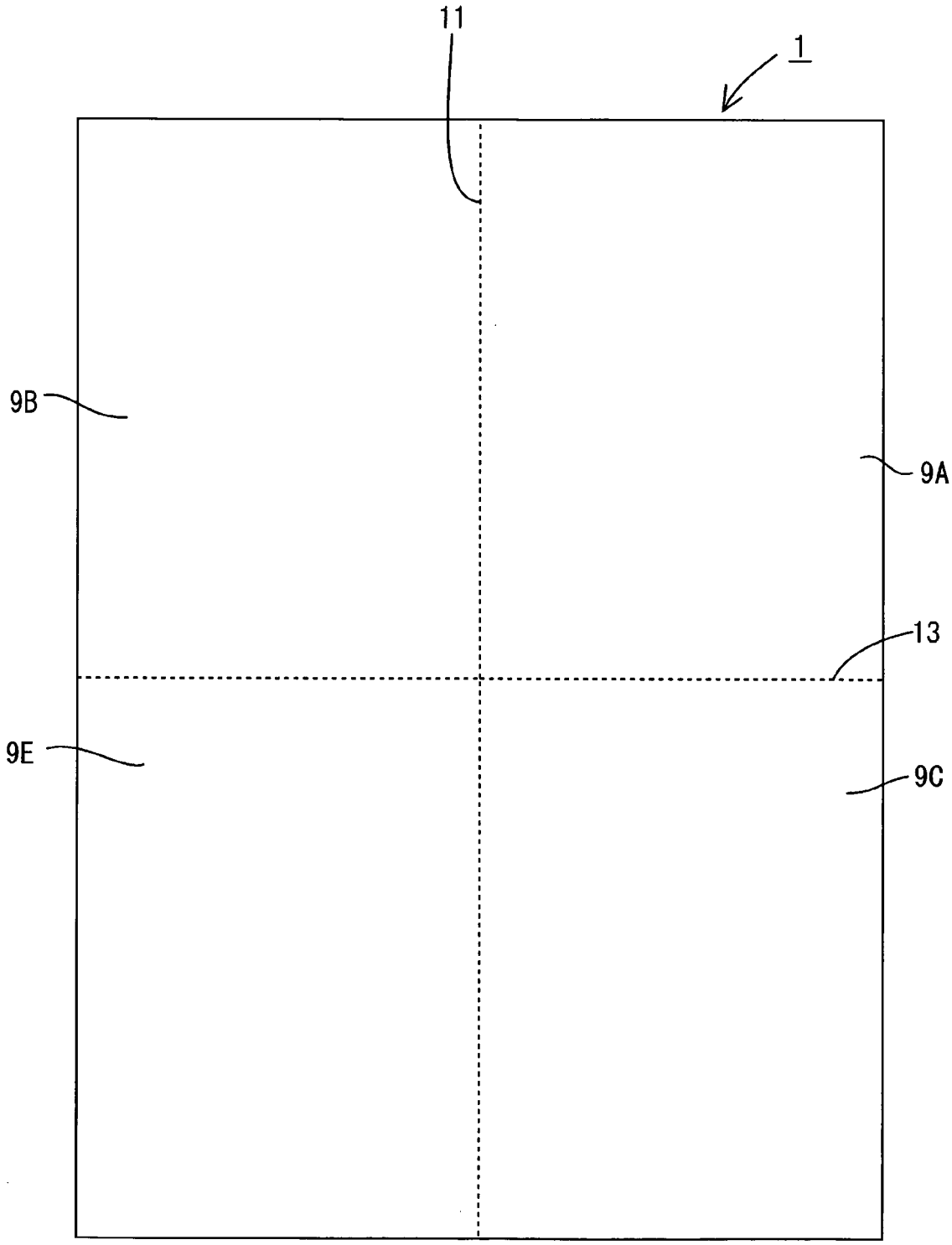
FIG. 21 is a back view of a postcard forming sheet.

As shown by the arrow in FIG. 19, the concealing part 3C is then folded along the second perforations 13 and bonded onto the information describing part 3B in order to complete a postcard that conceals the personal information 23. In this embodiment, a non-used area, as shown in the first embodiment for example, is eliminated in order to reduce costs.

Fourth Embodiment

Next, a fourth embodiment of the invention will be described with reference to FIGS. 20 through 25. The same components as in the first embodiment will be denoted by the same reference numerals, and descriptions of similar structures, operations, and advantages thereof will be omitted.

The fourth embodiment is different from the first embodiment in that a second information describing part 3E is provided instead of a non-used part 3D. In this embodiment, a part corresponding to the information describing part in the first embodiment is denoted by reference numeral 3B as a first information describing part. The peeling sheet upon a back surface of the second information describing part 3E is denoted by reference numeral 9E for identification. Specifically, in the fourth embodiment, a printing sheet 3 is divided by the crossing of first perforations 11 and second perforations 13 into a substantially rectangular address describing part 3A, the substantially rectangular first information describing part 3B adjacent to one long side of the address describing part 3A, a substantially rectangular concealing part 3C adjacent to one short side of the address describing part 3A, and the remaining second information describing part 3E.

A method of using a postcard forming sheet 1 according to this embodiment will be described next.

In use of the postcard forming sheet 1, an address 21 or the like of a customer is printed on the address describing part 3A. Personal information 23 to be confidentially communicated to the customer is printed on the first information describing part 3B and the second information describing part 3E (see FIG. 20).

Figure 22:
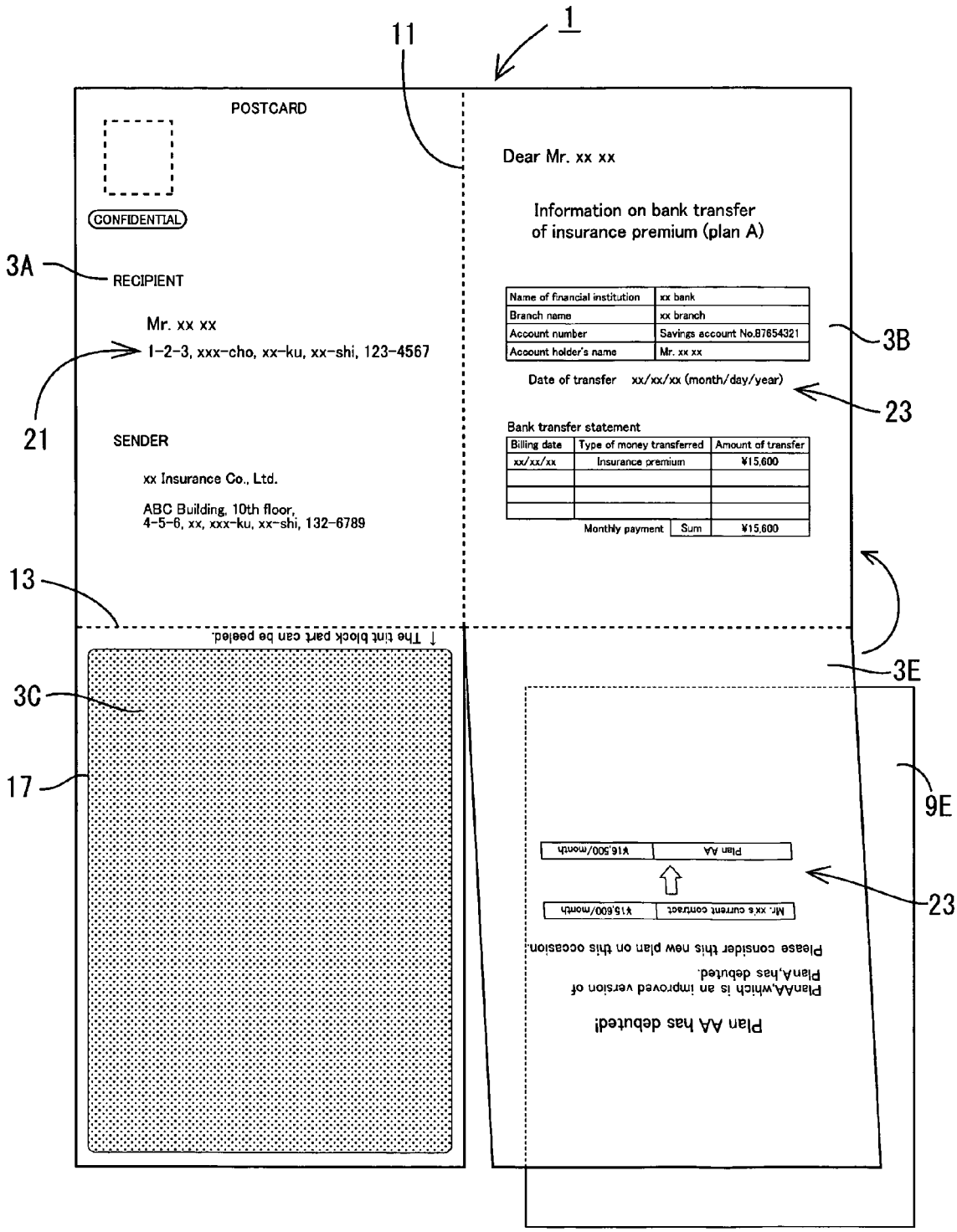
FIG. 22 illustrates a process of forming a postcard.

As shown in FIG. 22, the first perforations 11, a tearable line forming a boundary between the second information describing part 3E and the concealing part 3C, is torn apart, and the postcard forming sheet 1 is folded along the second perforations 13 (forming the boundary between the second information describing part 3E and the first information describing part 3B). The printing sheet 3 is placed to the outside with the peeling sheet 9, located on the backsides of the first information describing part 3B and the second information describing part 3E, being peeled away to expose the adhesive layer 7. The second information describing part 3E is then placed over and bonded to the first information describing part 3B.

Figure 23:
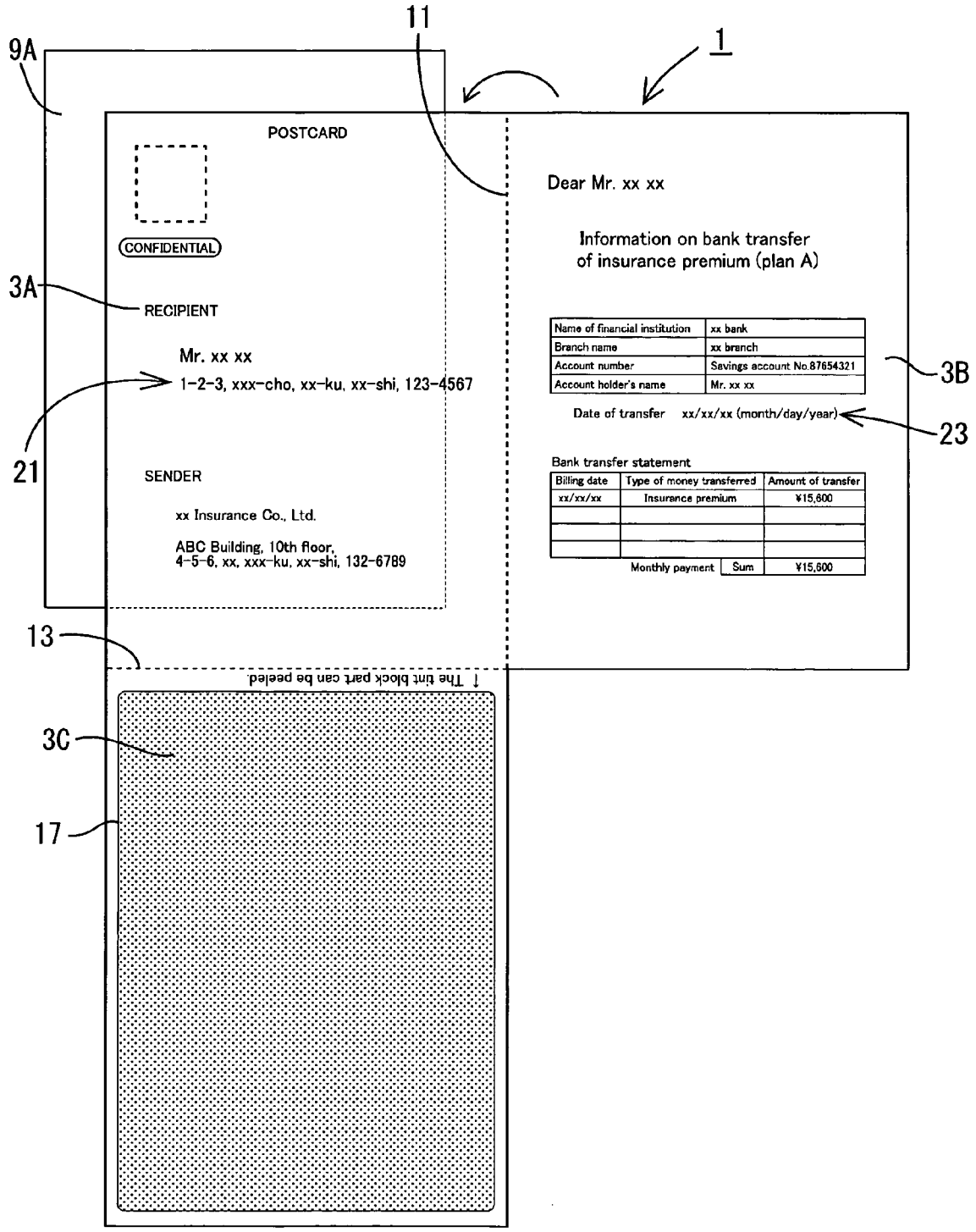
FIG. 23 illustrates the process of forming the postcard.

As shown in FIG. 23, the postcard forming sheet 1 is then folded along the first perforations 11 (a boundary between the address describing part 3A and the first information describing part 3B) so that the printing sheet 3 is placed to the outside. The peeling sheet 9, located on the backside of the address describing part 3A, is peeled away to expose the adhesive layer 7. The second information describing part 3E is placed over and bonded to the address describing part 3A.

Figure 24:
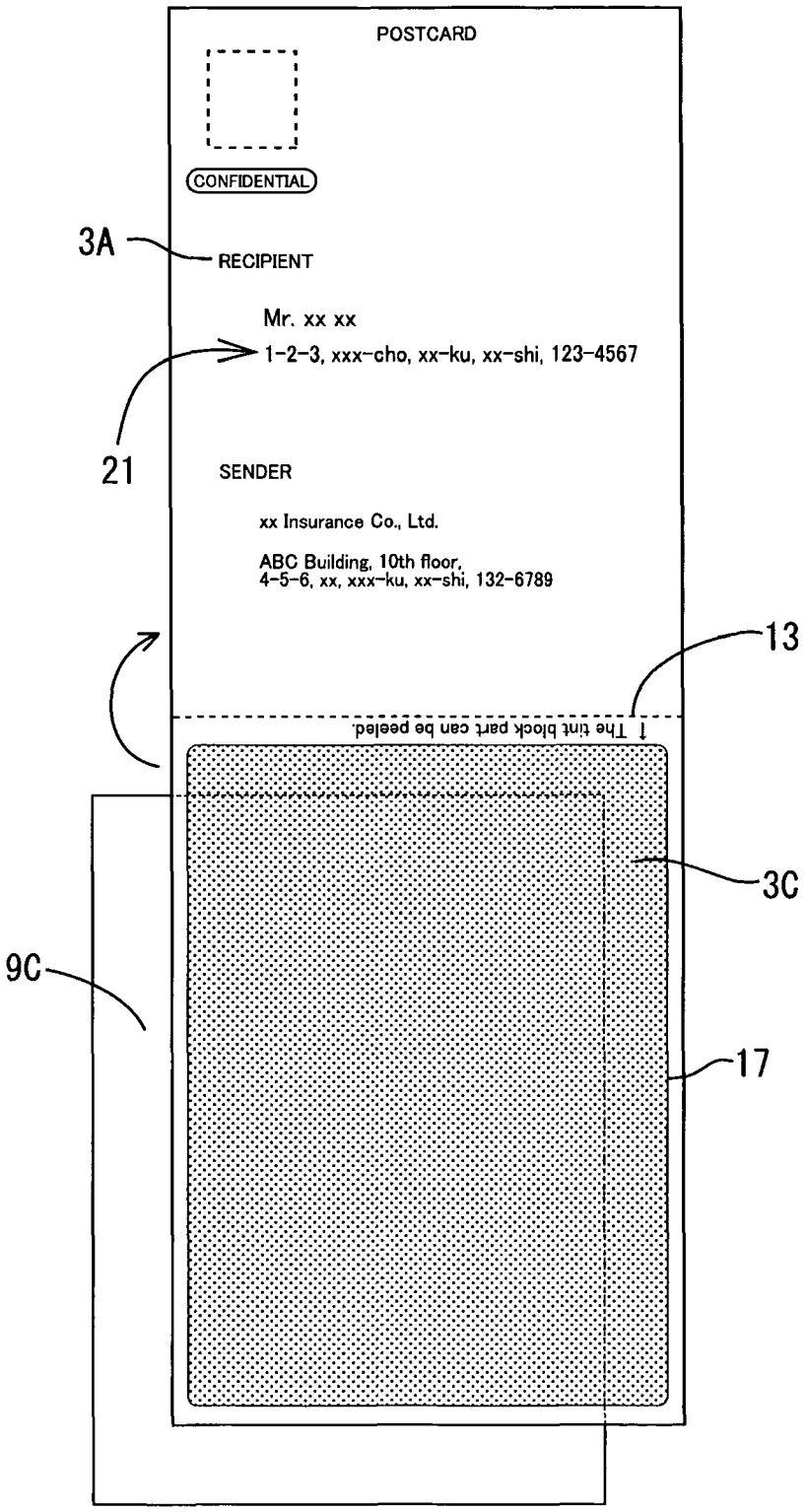
FIG. 24 illustrates the process of forming the postcard.
Figure 25:
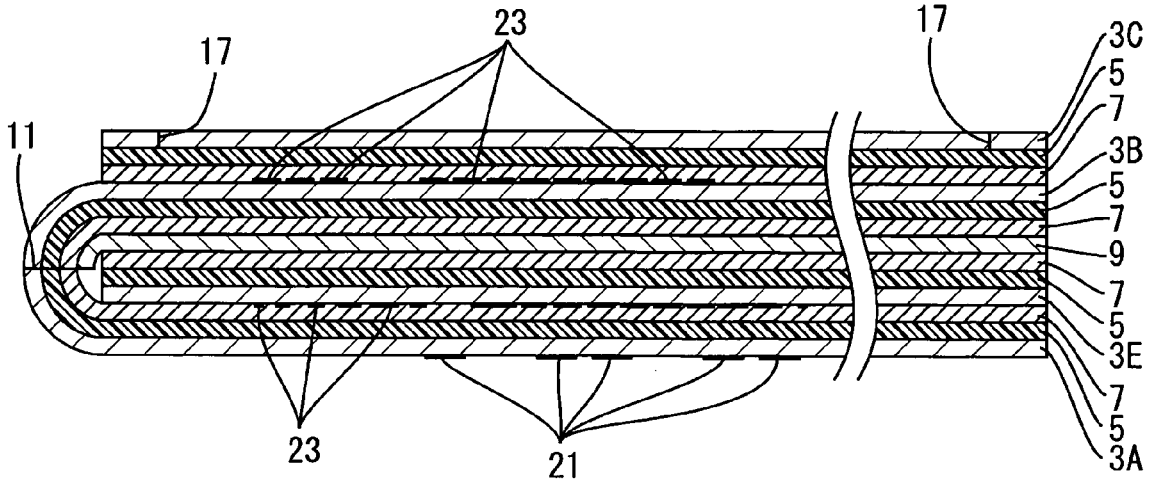
FIG. 25 is a sectional view of a completed postcard.

Finally, as shown in FIG. 24, the postcard forming sheet 1 is folded along the remaining section of second perforations 13 (i.e., the boundary between the concealing part 3C and the address describing part 3A) so that the printing sheet 3 is placed to the outside. The adhesive layer 7, exposed by peeling away the peeling sheet 9 located on the backside of the concealing part 3C, is placed over and bonded to the first information describing part 3B in order to complete the postcard.

A customer who receives the postcard formed using the postcard forming sheet 1 of this embodiment can peel the concealing part 3C and see the personal information 23 printed on the first information describing part 3B through the transparent film 5 and the adhesive layer 7. The customer can also peel away the address describing part 3A and read the personal information 23 printed on the second information describing part 3E through the transparent film 5 and the adhesive layer 7 (see FIG. 25).

Also, as described above, according to this embodiment's configuration, the postcard forming sheet 1 may simply be folded along the second perforations 13 in order to conceal the personal information 23 described on the first information describing part 3B, thereby allowing easier positioning than the case where a concealing seal is separately formed and applied. The postcard forming sheet 1 may be simply folded along the first perforations 11 in order to conceal the personal information 23 described on the second information describing part 3E, thereby also allowing for easy positioning.

Further, according to the configuration of this embodiment, a first information describing part 3B and a second information describing part 3E are provided. Thus a relatively large amount of information can be advantageously described.

Fifth Embodiment

A fifth embodiment of the invention will be described next with reference to FIGS. 26 through 30. The same components as in the first embodiment will be denoted by the same reference numerals, and descriptions of similar structures, operations, and advantages thereof will be omitted.

In the fifth embodiment, the layout of an address describing part 3A, an information describing part 3B, and a concealing part 3C, is different from the layout of the first embodiment. Specifically, in the fifth embodiment there are formed: a substantially rectangular address describing part 3A, the information describing part 3B adjacent to one long side of the address describing part 3A (corresponding to one side of the invention) and of substantially the same size and shape as the address describing part 3A, and a concealing part 3C adjacent to the other long side of the address describing part 3A (corresponding to one different side of the invention) of substantially the same size and shape as the address describing part 3A, and upon which a tint block is printed.

Figure 28:
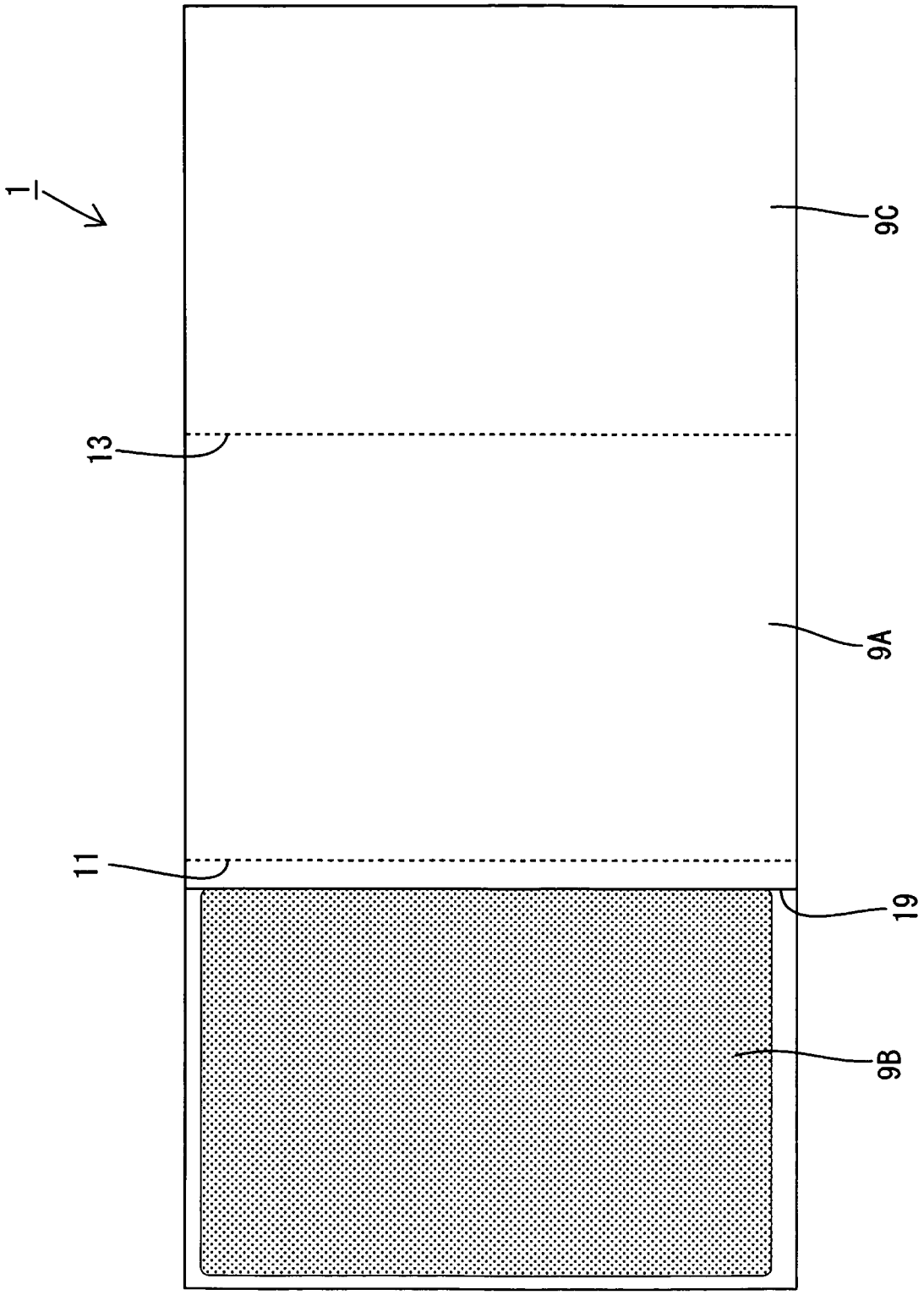
FIG. 28 is a back view of the postcard forming sheet.

Further as shown in FIG. 28, a tint block is printed on the peeling sheet 9B on the back surface of the information describing part 3B.

A first slit 17 in the concealing part 3C is formed into a substantially rectangular closed-loop shape. One side 17A thereof is aligned with the second perforations 13 as a boundary between the address describing part 3A and the concealing part 3C. This is to ensure that the printing sheet 3 is folded along a predetermined location (i.e., the second perforations 13) with one side 17A of the first slit 17 being aligned with the second perforations 13 as in this embodiment. When the first slit 17 is not aligned with the second perforations 13, the printing sheet 3 may be folded along the first slit 17 by mistake, even when attempting to fold the printing sheet 3 along the second perforations 13.

A method of using the postcard forming sheet 1 according to this embodiment will be described next.

In the use of the postcard forming sheet 1, an address 21 or the like of a customer is printed on the address describing part 3A of the printing sheet 3 and personal information 23 is printed on the information describing part 3B.

Figure 29:
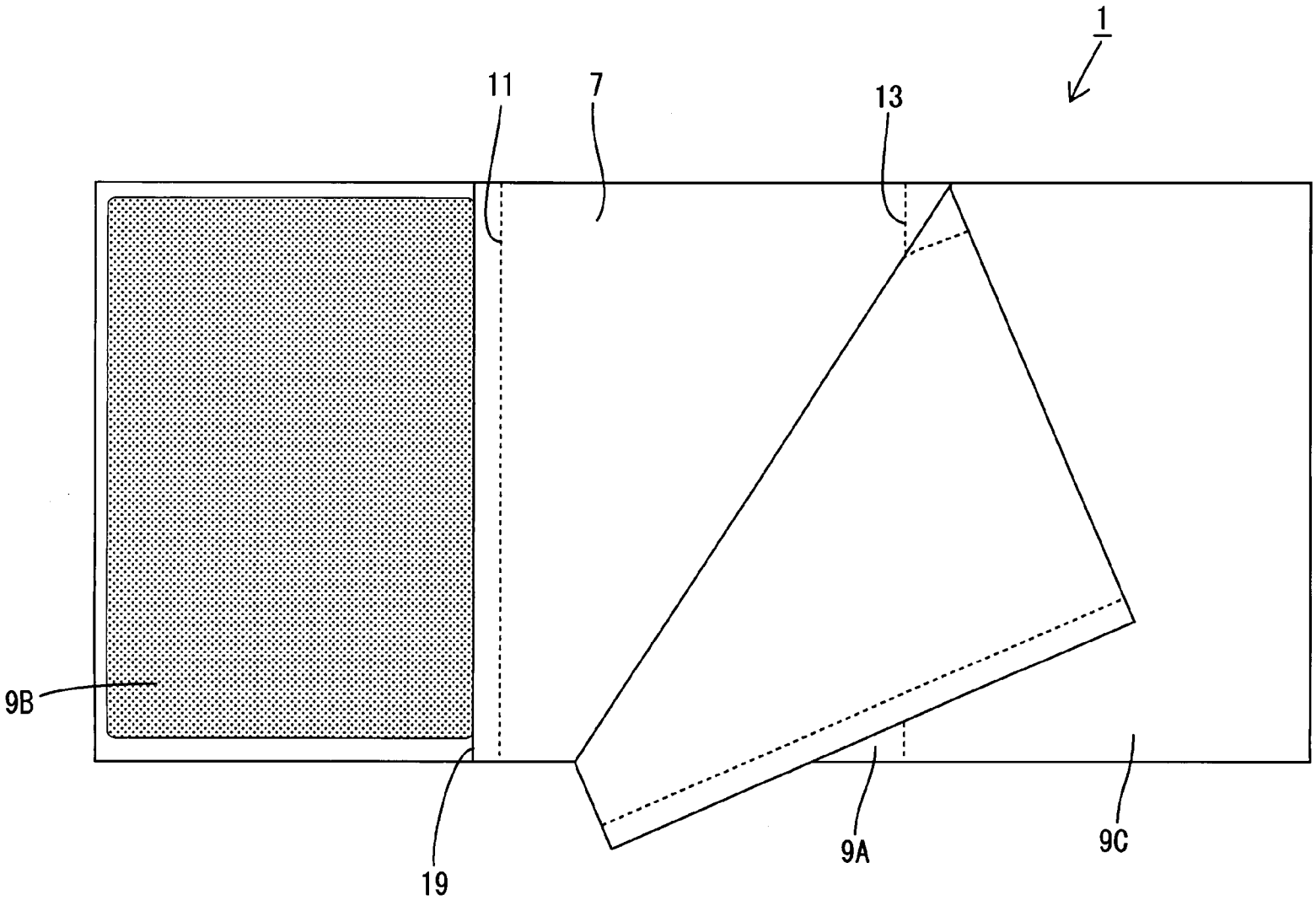
FIG. 29 is a back view of the postcard forming sheet showing a process of forming a postcard.

As shown in FIG. 29, peeling sheets 9A and 9C on the back surfaces of the address describing part 3A and the concealing part 3C are then peeled away to expose the adhesive layer 7 on the back surfaces of the address describing part 3A and the concealing part 3C. The peeling sheet 9B on the back surface of the information describing part 3B is left remaining.

Figure 30:
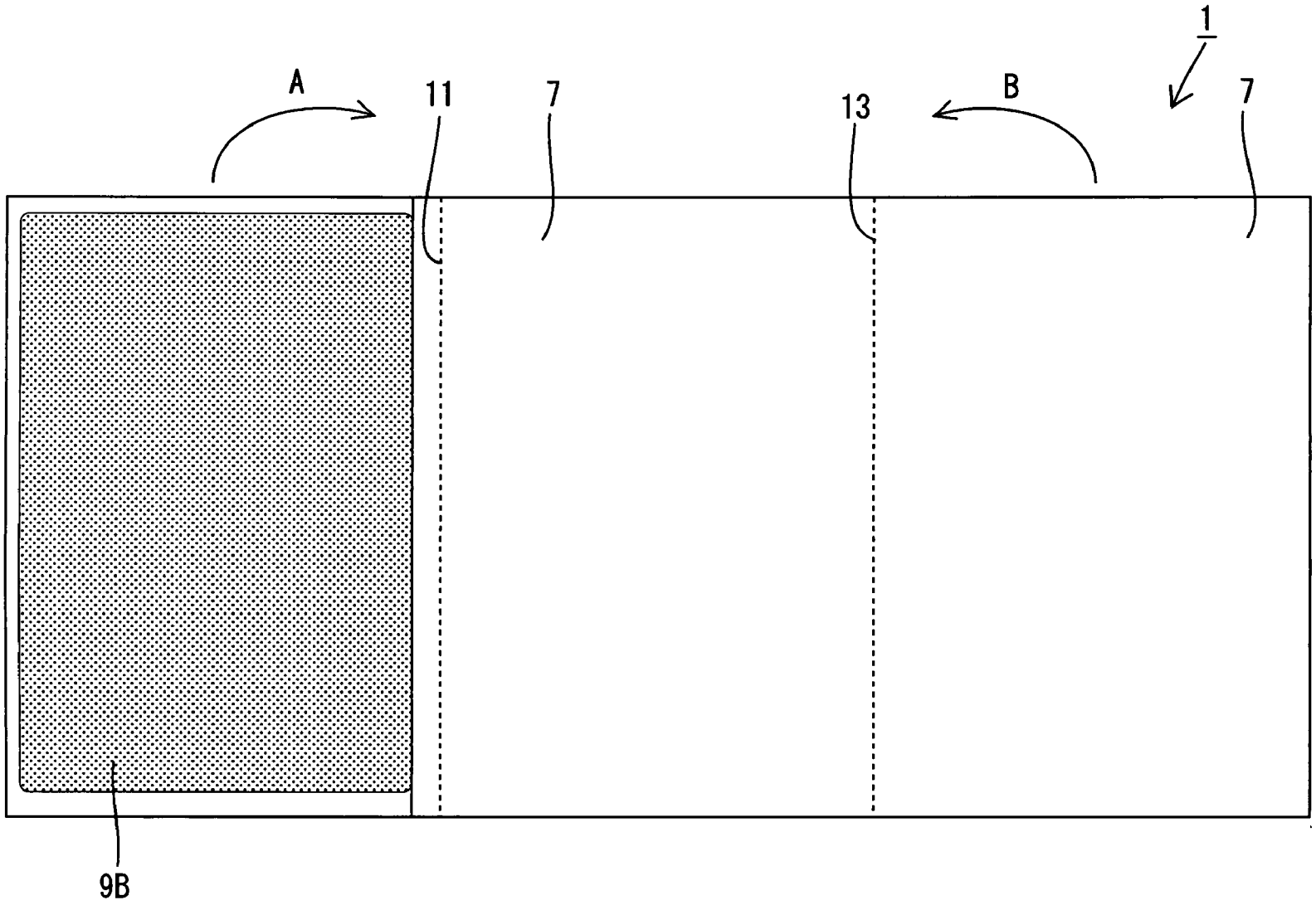
FIG. 30 is a back view of the postcard forming sheet showing the process of forming the postcard.
Figure 31:
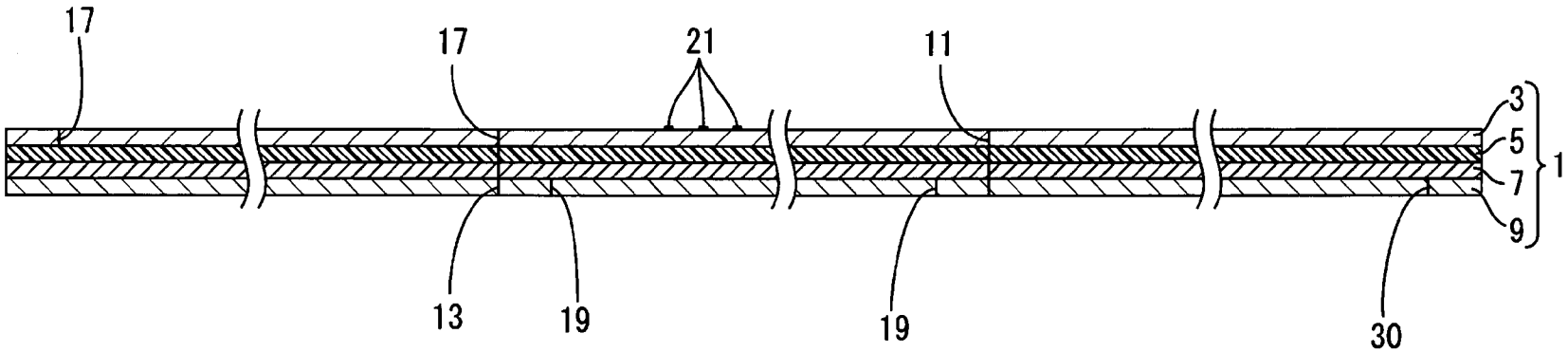
FIG. 31 is a sectional view of a postcard forming sheet according to a sixth embodiment.

As shown by the arrow A in FIG. 30, the information describing part 3B is then folded along the first perforations 11 to bond together the back surfaces of the address describing part 3A and the information describing part 3B.

Next, as shown by the arrow B in FIG. 30, the concealing part 3C is folded along the second perforations 13 and bonded onto the information describing part 3B in order to complete a postcard that conceals the personal information 23.

In this embodiment, the tint block is printed on the peeling sheet 9B on the back surface of the information describing part 3B. The information describing part 3B is placed over and bonded to the address describing part 3A with the peeling sheet 9B on the back surface of the information describing part 3B remaining attached. Thus, the tint block on the peeling sheet 9B aids in preventing other people from reading the personal information from the side of the printing sheet 3.

Sixth Embodiment

Next, a sixth embodiment of the invention will be described with reference to FIGS. 31 through 35. The same components as in the first embodiment will be denoted by the same reference numerals, and descriptions of similar structures, operations, and advantages thereof will be omitted. In addition, a separate front view will be omitted because the front view is the same as FIG. 26 of the fifth embodiment.

In the sixth embodiment, like in the fifth embodiment, the layout of an address describing part 3A, an information describing part 3B, and a concealing part 3C, is different from the layout in the first embodiment.

Further, a tint block is printed upon a peeling sheet 9A on the back surface of the address describing part 3A.

Figure 32:
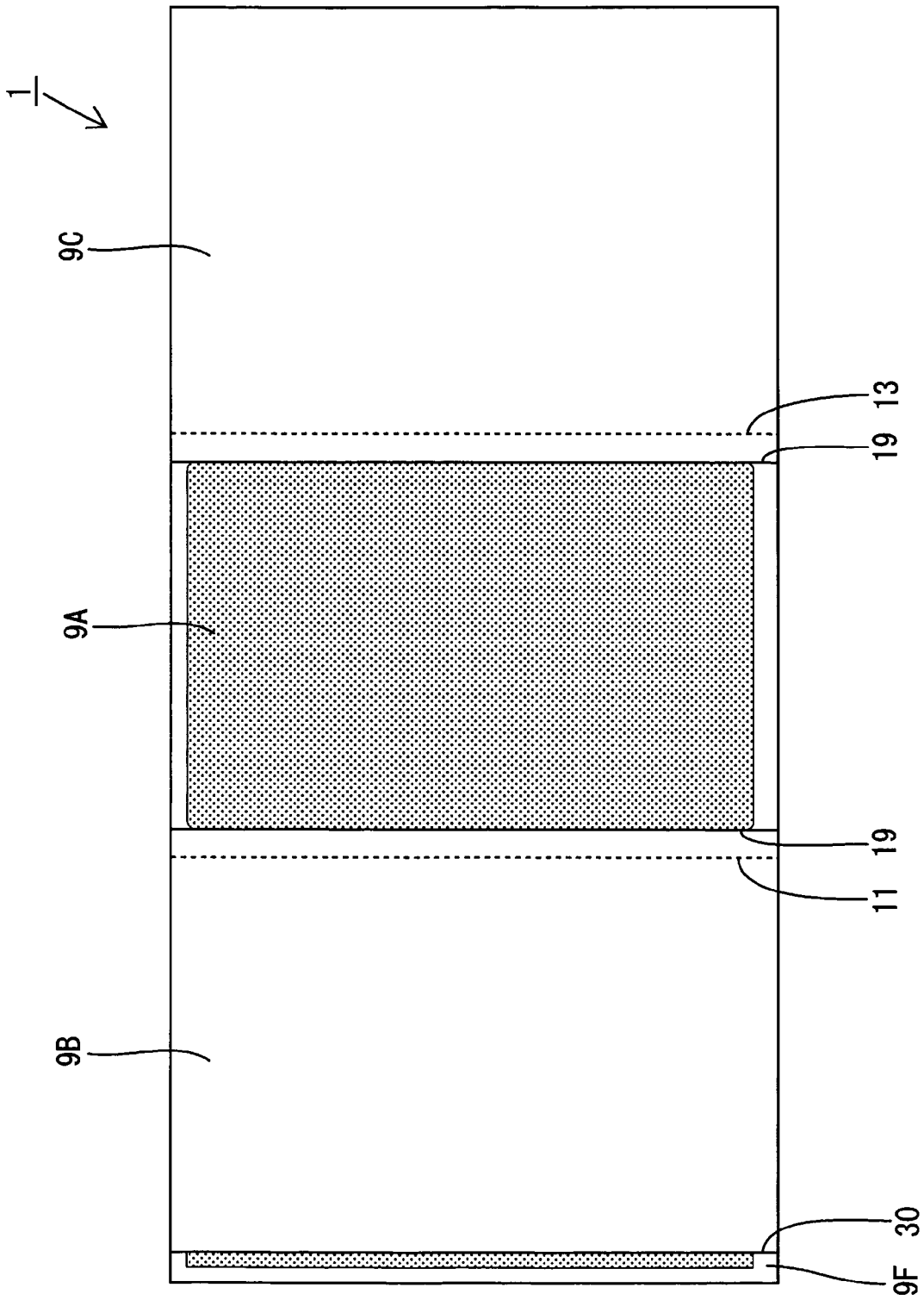
FIG. 32 is a back view of the postcard forming sheet.
Figure 33:
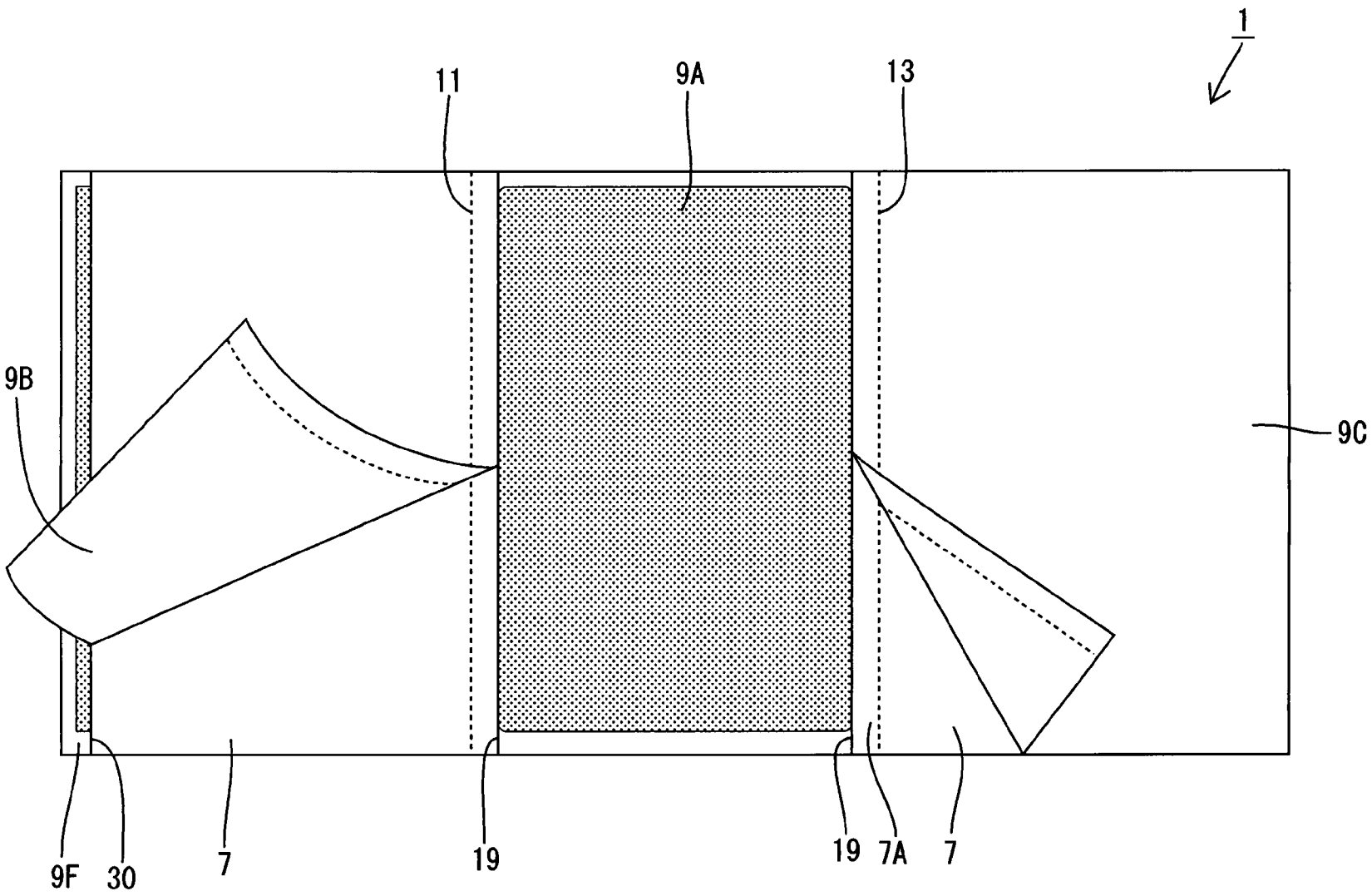
FIG. 33 is a back view of the postcard forming sheet showing a process of forming a postcard.

In the peeling sheet 9A on the back surface of the address describing part 3A, second slits 19 for peeling the peeling sheet 9 are respectively formed a few millimeters to the inside of the first perforations 11 and the second perforations 13 (see FIGS. 32 and 33).

When the peeling sheet 9 is peeled away along the one of the second slits 19 located closer to the second perforations 13 (the right one in FIG. 32) as shown in FIG. 33, an adhesive area 7A is exposed between the second perforations 13 and the nearest second slits 19. The adhesive area 7A has substantially the same size as the area 9F described below.

In the peeling sheet 9B located on the back surface of the information describing part 3B, a slit 30 is formed in a position close to the left long side (a long side opposite from the first perforations 11 as seen in FIG. 32). A tint block is printed upon the area 9F between the slit 30 and the left long side.

When the peeling sheet 9B on the back surface of the information describing part 3B is peeled away along the second slit 19, as shown in FIG. 33, the slit 30 allows the area 9F to remain without being peeled away.

Figure 34:
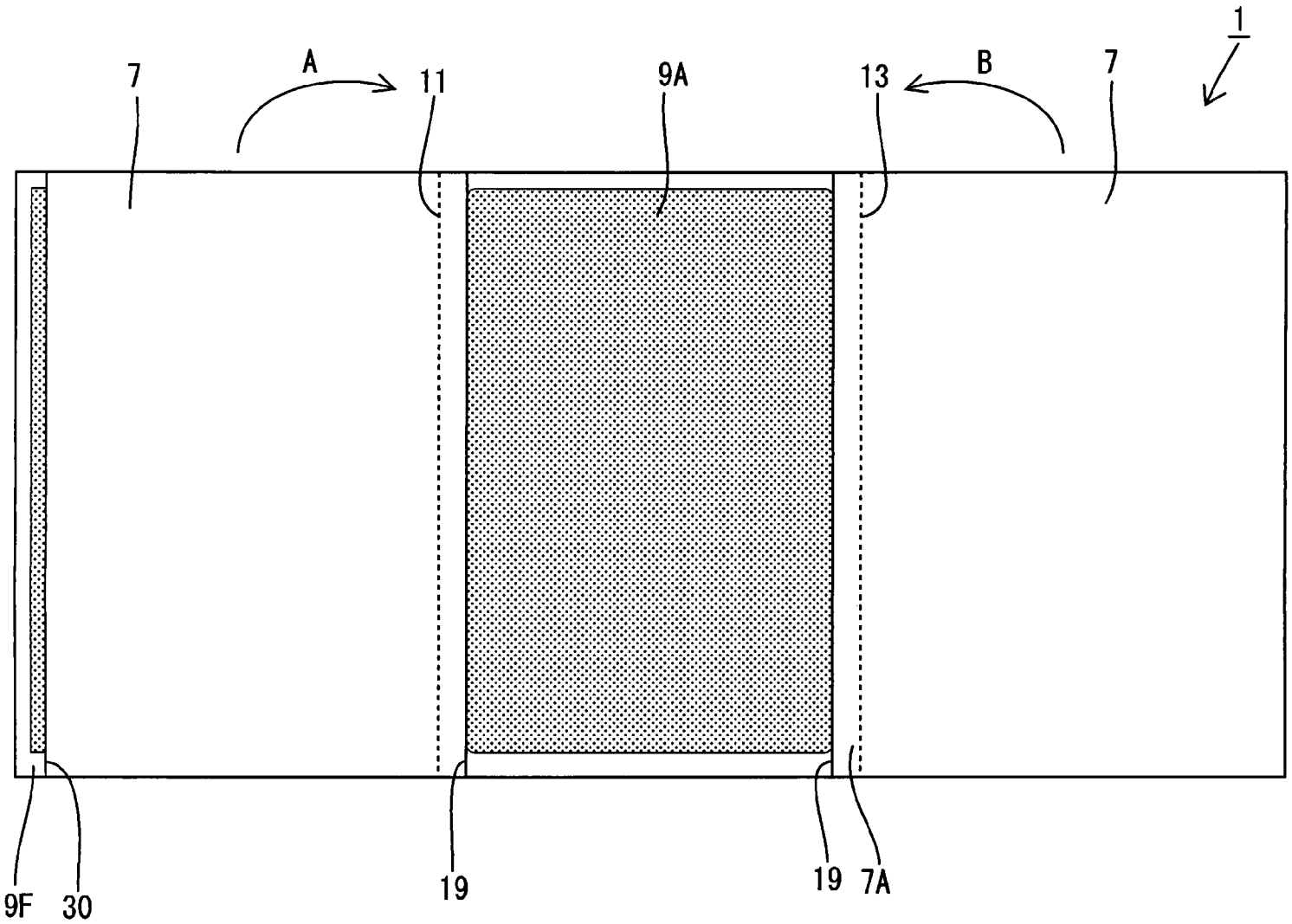
FIG. 34 is a back view of the postcard forming sheet showing the process of forming the postcard.

As shown in FIG. 34, when the information describing part 3B is folded along the first perforations 11, as shown by the arrow A, and bonded to the address describing part 3A, the area 9F is inserted onto the adhesive area 7A between the second perforations 13 and the second slit 19 on the back surface of the address describing part 3A. This prevents potential unevenness of the postcard caused by the area 9F.

A method of using the postcard forming sheet 1 according to this embodiment will be described next.

Figure 26:
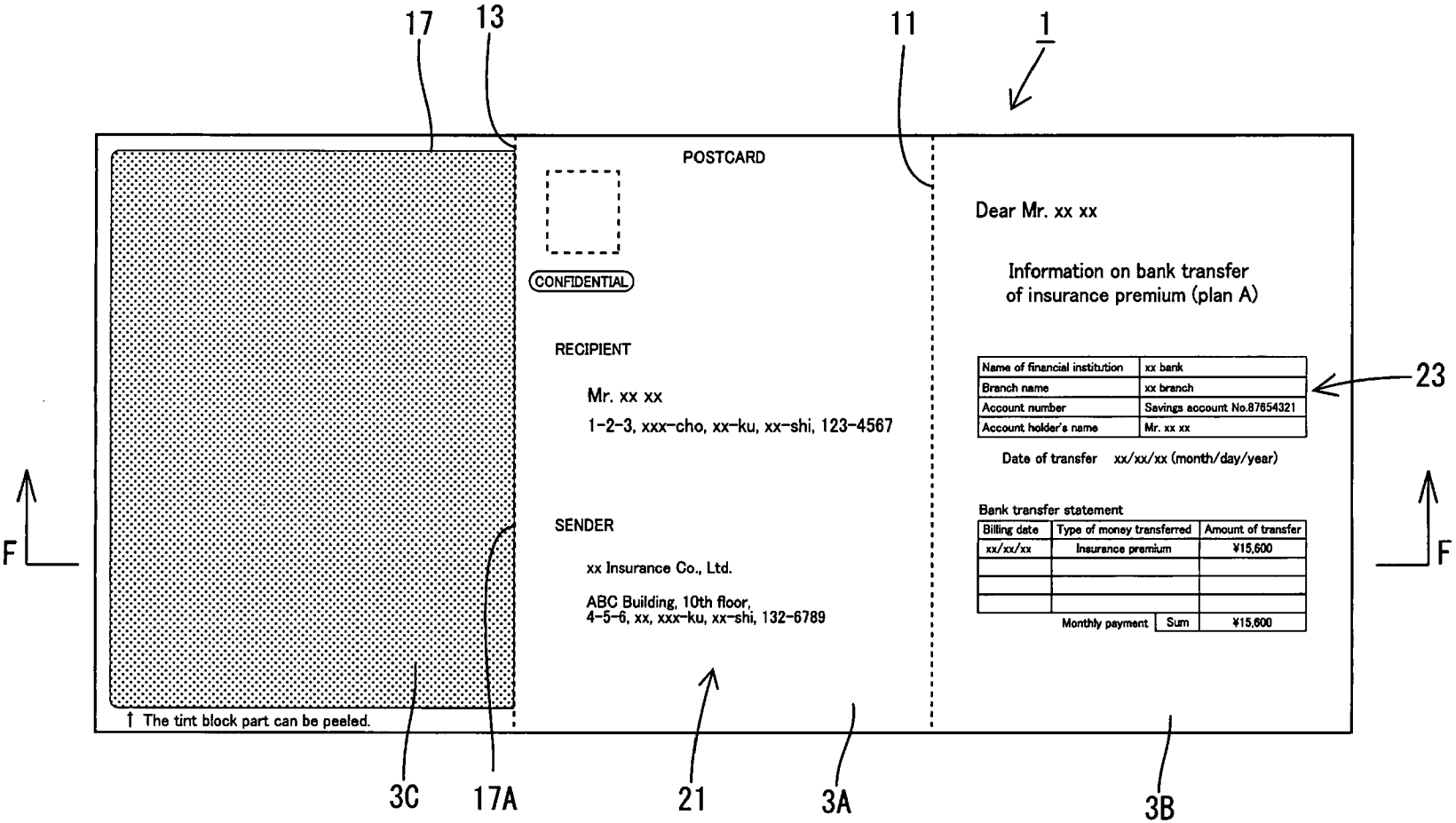
FIG. 26 is a front view of a postcard forming sheet according to a fifth embodiment.
Figure 27:
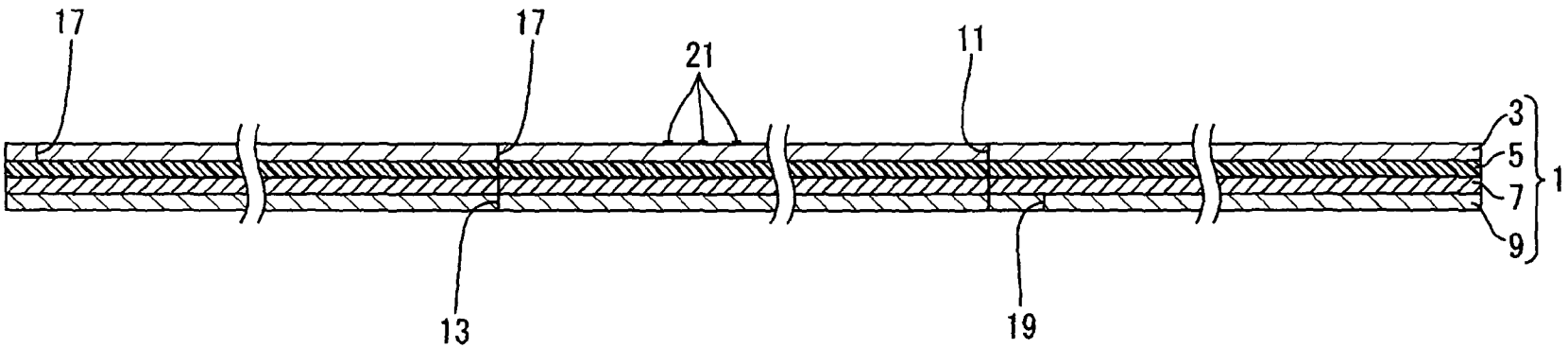
FIG. 27 is a sectional view taken along the line F-F in FIG. 26.

In the use of the postcard forming sheet 1, an address 21 or the like of a customer is printed on the address describing part 3A and personal information 23 is printed on the information describing part 3B (see FIG. 26).

As shown in FIG. 33, the peeling sheets 9B and 9C on the back surfaces of the information describing part 3B and the concealing part 3C are then respectively peeled away along the second slits 19. In this condition, the peeling sheet 9A remains in the area between the second slits 19 on the back surface of the address describing part 3A, and the adhesive layer 7 is exposed on the back surfaces of the information describing part 3B and the concealing part 3C. The area 9F on the back surface of the information describing part 3B also remains without having been peeled away.

Then, as shown by the arrow A in FIG. 34, the information describing part 3B is folded along the first perforations 11 in order to bond together the back surfaces of the address describing part 3A and the information describing part 3B.

At this point, an end of the information describing part 3B has elasticity provided by the peeling sheet 9 (the area 9F) and is thus easy to grasp and fold.

Next, as shown by the arrow B in FIG. 34, the concealing part 3C is folded along the second perforations 13 and bonded onto the information describing part 3B in order to complete a postcard that conceals the personal information 23.

In this embodiment, the tint block is printed on the peeling sheet 9A on the back surface of the address describing part 3A. The information describing part 3B is placed over and bonded to the address describing part 3A with the peeling sheet 9A remaining on the back surface of the address describing part 3A. Thus, the tint block on the peeling sheet 9A prevents other people from reading the personal information from the side of the printing sheet 3.

Figure 35:
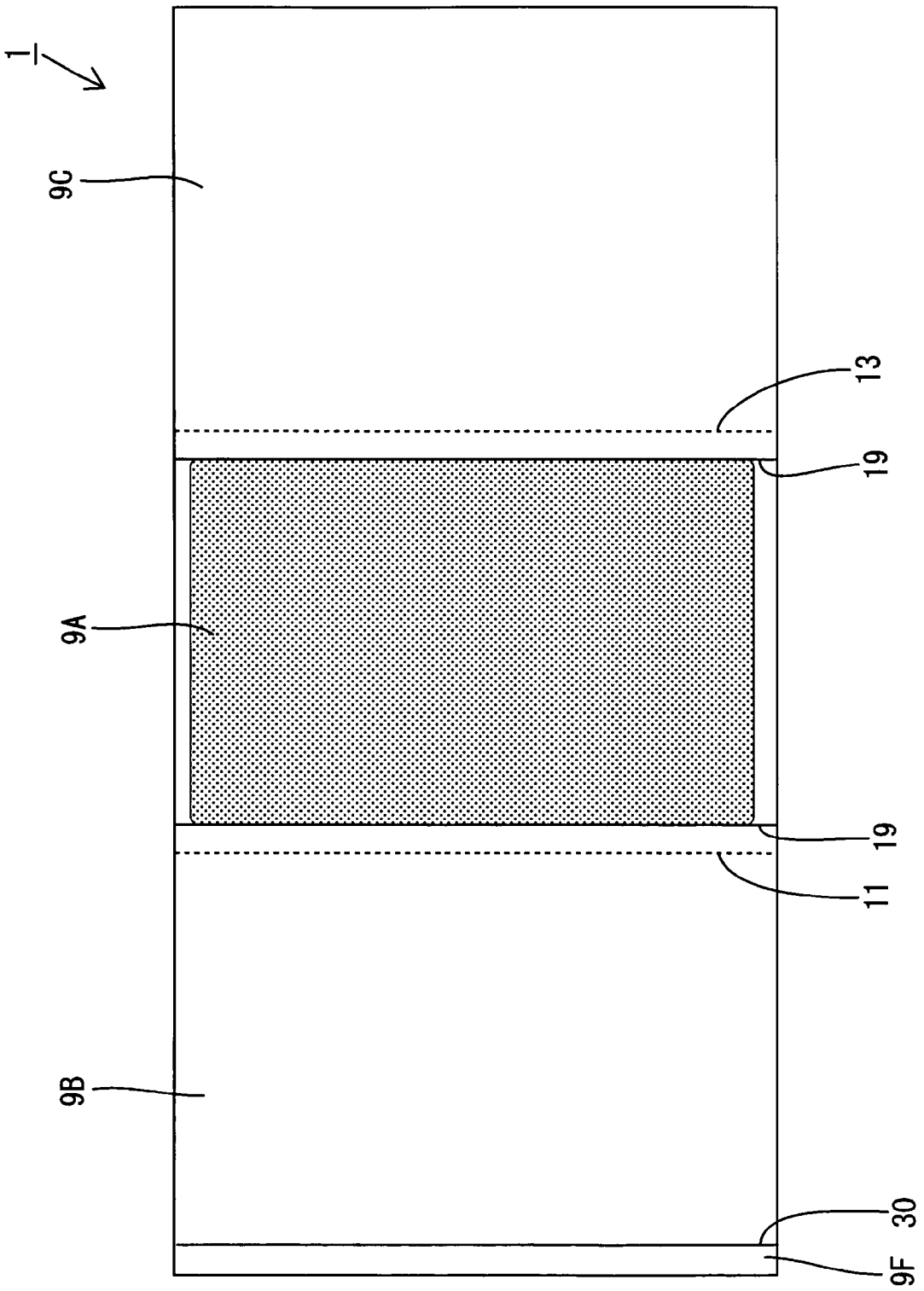
FIG. 35 is a back view of a postcard forming sheet according to another embodiment.

In this embodiment, an example is shown in which the tint block is printed on the area 9F of the peeling sheet 9B of the information describing part 3B, but alternatively no tint block may be printed on the area 9F as shown in FIG. 35.

Seventh Embodiment

A seventh embodiment of the invention will be described next with reference to FIGS. 36 through 45. The same components as in the third embodiment will be denoted by the same reference numerals, and descriptions of similar structures, operations, and advantages thereof will be omitted.

The seventh embodiment differs from the third embodiment mainly in the formation of the shapes of the closed-loop first to third auxiliary card tearing perforations 51A, 51B, and 51C.

The first auxiliary card tearing perforations 51A are of a closed-loop shape and are formed to penetrate an address describing part 3A, a transparent film 5 at a location over the address describing part 3A, an adhesive layer 7 at a location over the address describing part 3A, and a peeling sheet 9 at a location over the address describing part 3A.

The second auxiliary card tearing perforations 51B are also of a closed-loop shape and are also formed to penetrate an information describing part 3B, the transparent film 5 at a location over the information describing part 3B, the adhesive layer 7 at a location over the information describing part 3B, and the peeling sheet 9 at a location over the information describing part 3B.

The third auxiliary card tearing perforations 51C are of closed-loop shape and are formed to penetrate the transparent film 5 at a location over the concealing part 3C, the adhesive layer 7 at a location over the concealing part 3C, and the peeling sheet 9 at a location over the concealing part 3C.

Figure 42:
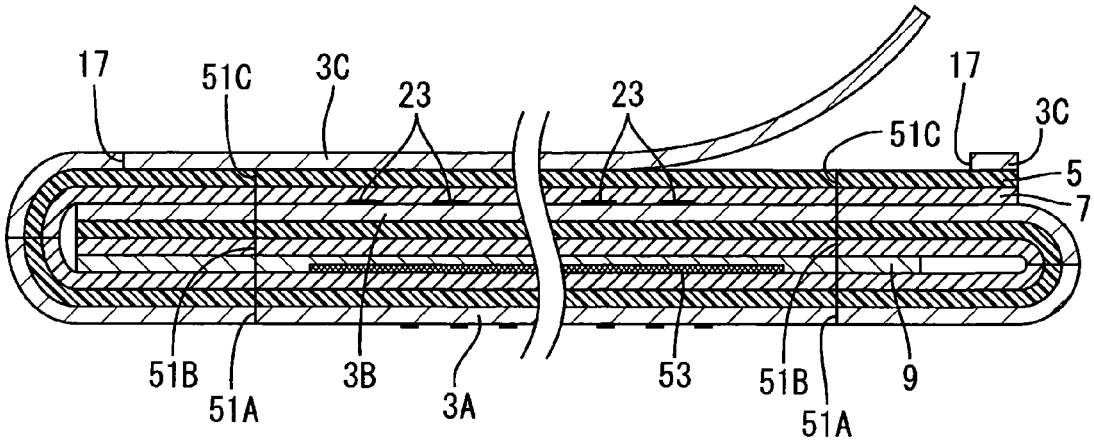
FIG. 42 is a sectional view taken along the line H-H in FIG. 41.

The auxiliary card tearing perforations 51A, 51B, and 51C, are positioned so as to be aligned with one another when the postcard is completed, as shown in a sectional view in FIG. 42.

Figure 37:
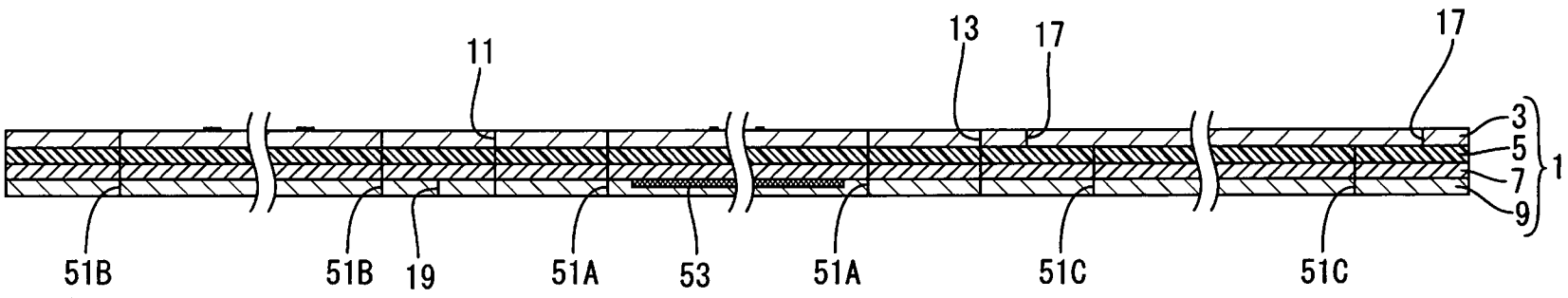
FIG. 37 is a sectional view taken along the line G-G in FIG. 36.
Figure 38:
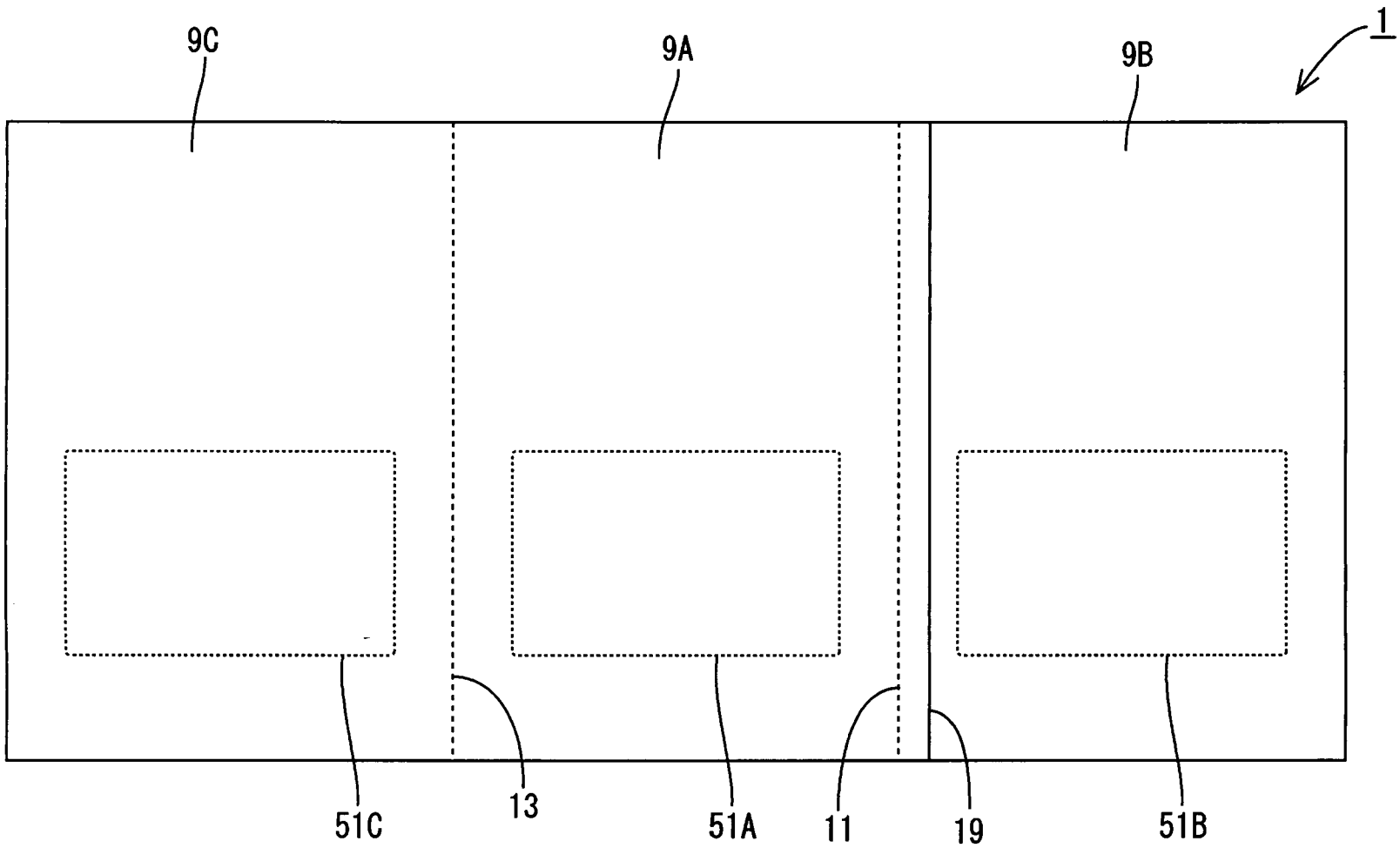
FIG. 38 is a back view of the postcard forming sheet.

Further, in this embodiment as shown in FIG. 37, an IC chip unit 53, such as an IC tag having an IC tip or an antenna, may be embedded between the peeling sheet 9 and the adhesive layer 7 in an area surrounded by the first auxiliary card tearing perforations 51A.

A method of using the postcard forming sheet 1 according to this embodiment will be described next.

Figure 36:
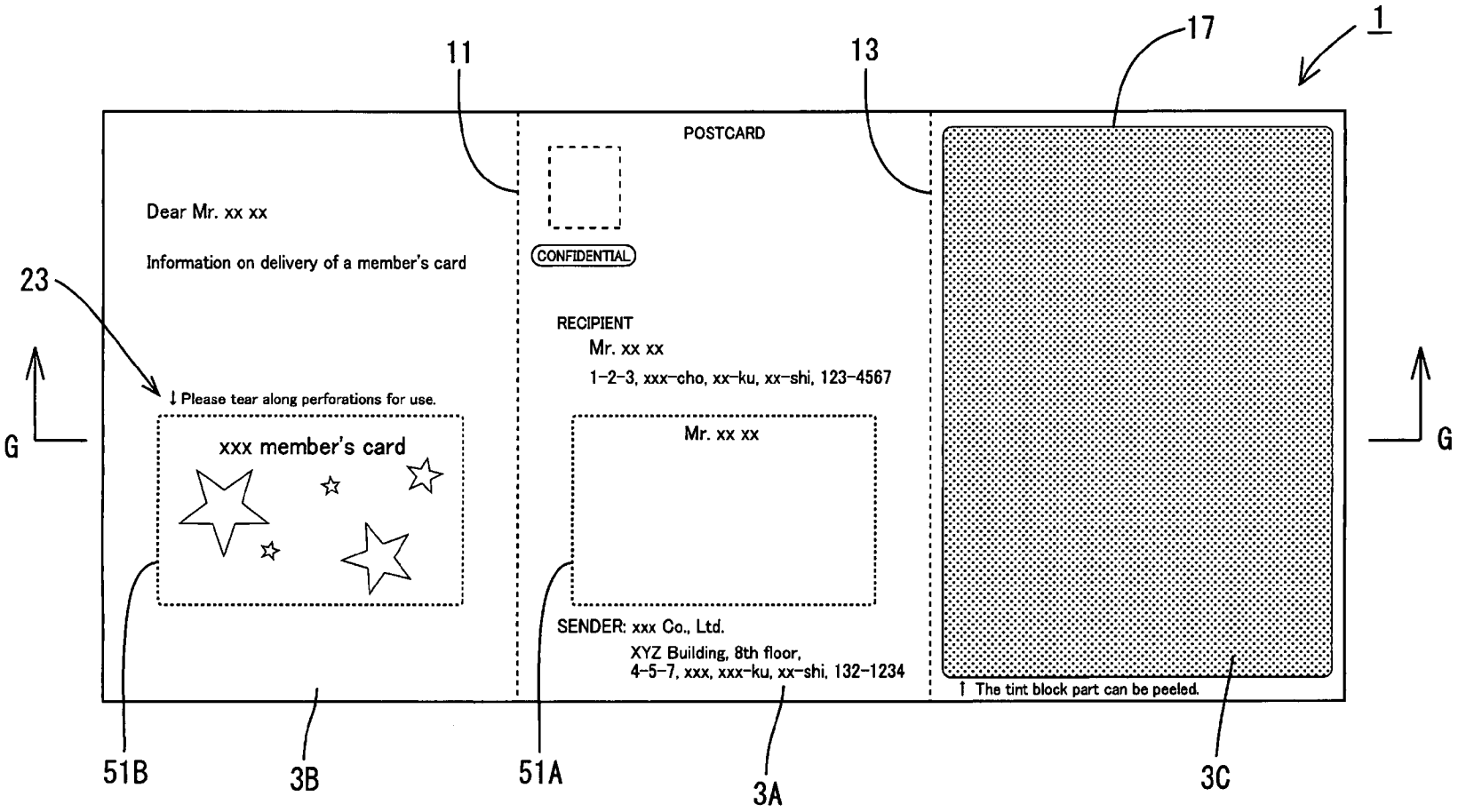
FIG. 36 is a front view of a postcard forming sheet according to a seventh embodiment.

In the use of the postcard forming sheet 1, as shown in FIG. 36, first, an address or the like of a customer is printed on the address describing part 3A and personal information 23, such as card describing information for the customer, is printed on the information describing part 3B.

Figure 39:
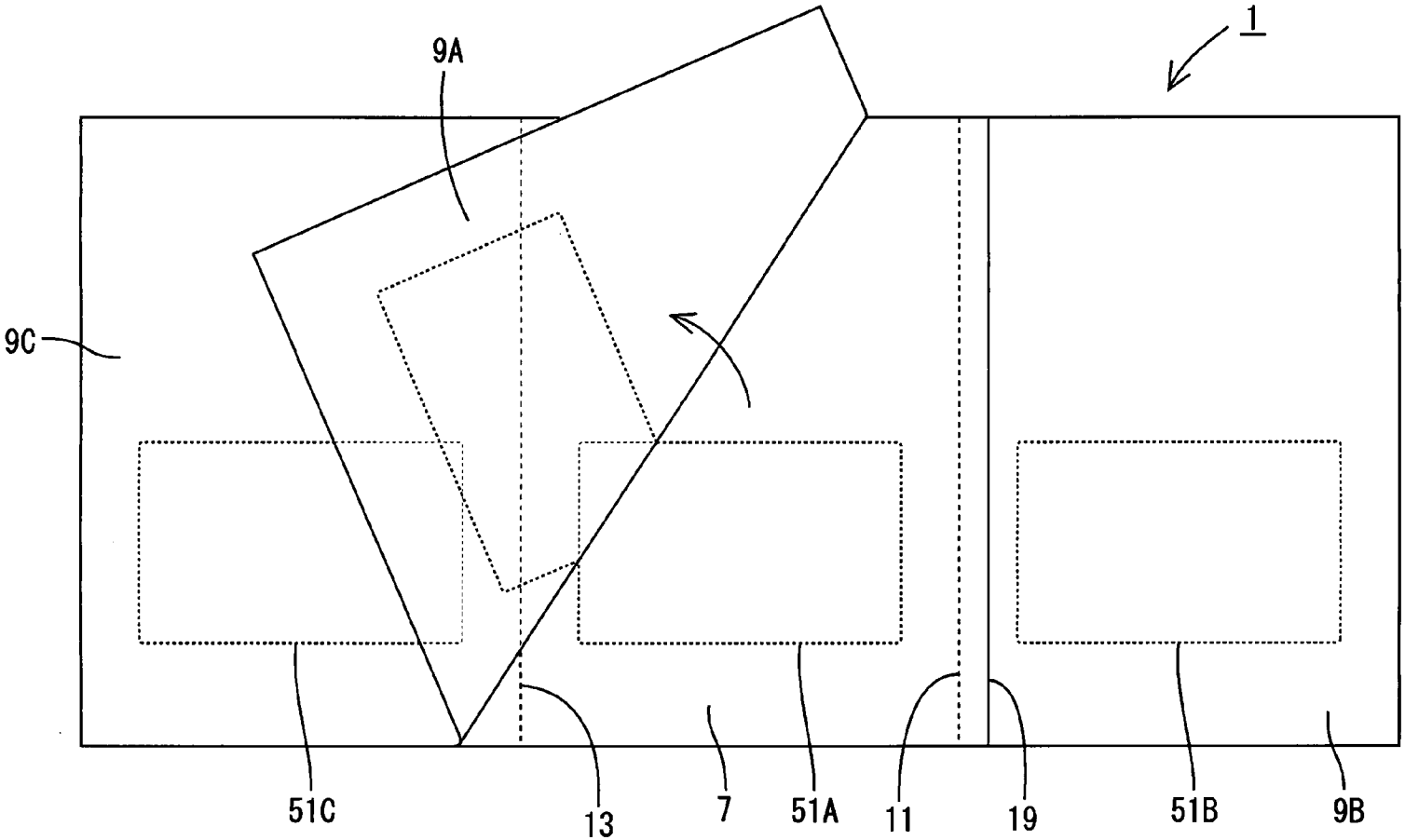
FIG. 39 is a back view of the postcard forming sheet showing a process of forming a postcard.
Figure 40:
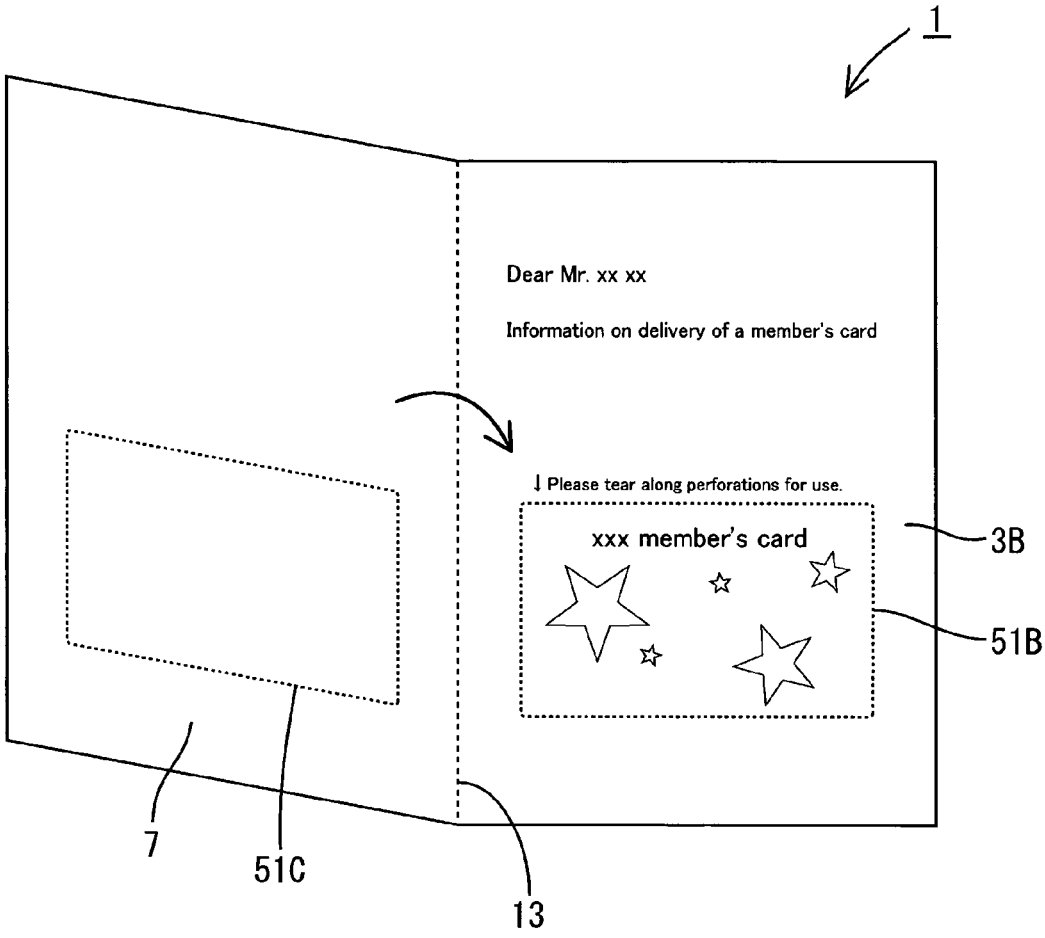
FIG. 40 is a back view of the postcard forming sheet showing the process of forming the postcard.

Next, as shown in FIG. 39, the peeling sheet 9 is peeled away along a second slit 19 to expose the adhesive layer 7 on the back surfaces of the address describing part 3A and the concealing part 3C.

The information describing part 3B is then folded along first perforations 11 to bond together the back surfaces of the address describing part 3A and the information describing part 3B. This provides a postcard having the information describing part 3B on one surface and the address describing part 3A on the other surface, with the concealing part 3C being connected (see FIG. 40).

Figure 41:
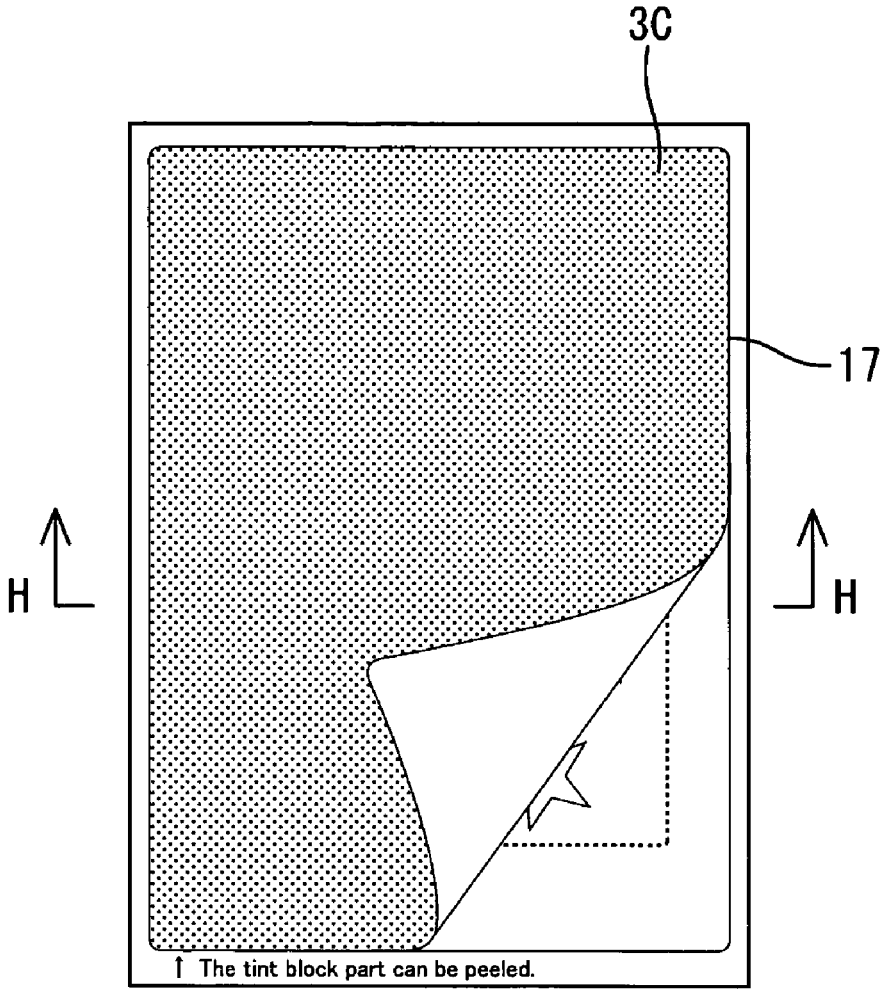
FIG. 41 is a back view of a state of use of the postcard.

The concealing part 3C is then folded along the second perforations 13 and bonded onto the information describing part 3B in order to complete the postcard that conceals the personal information 23 (see FIGS. 41 and 42).

Figure 43:
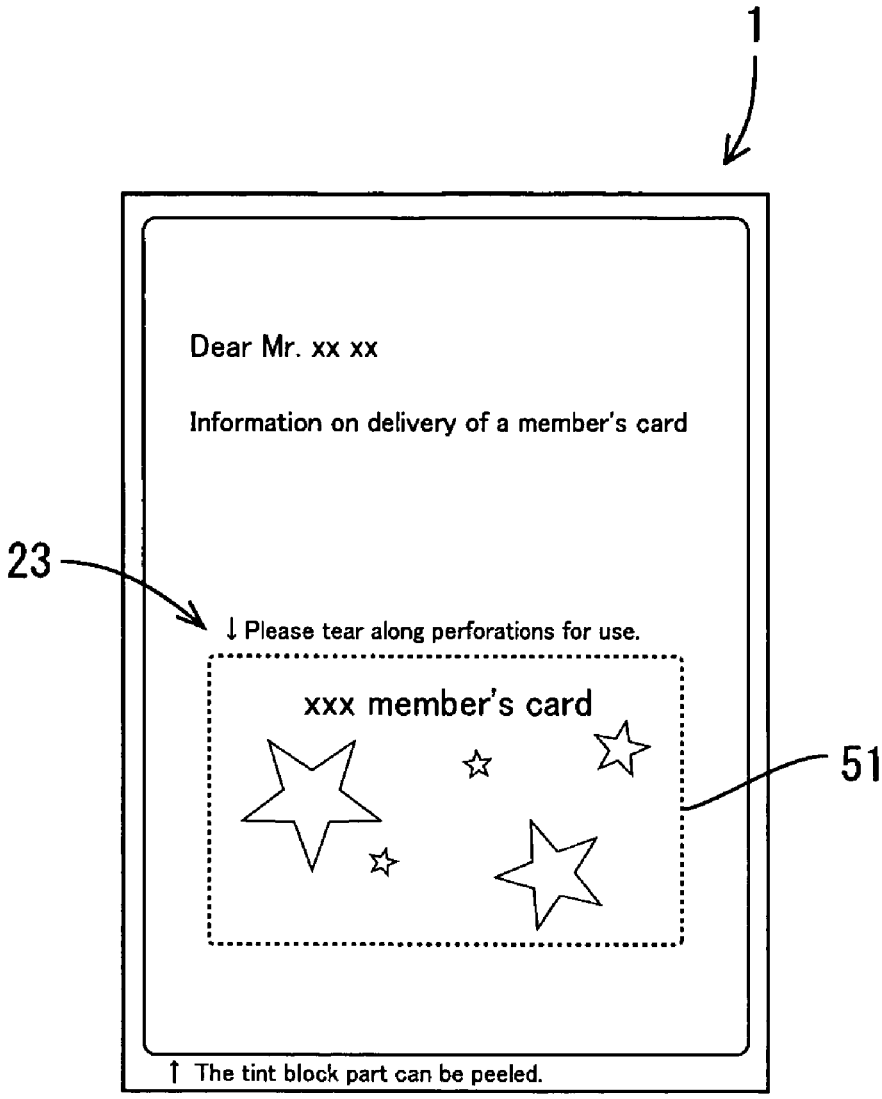
FIG. 43 is a back view of a state of use of the postcard.

A customer who receives a postcard formed using such a postcard forming sheet 1, peels away the concealing part 3C, on which a tint block is printed, bounded by first slit 17 as shown in FIG. 41 and 42. The customer can then see the personal information 23 printed on the information describing part 3B, through the transparent film 5 and the adhesive layer 7, as shown in FIG. 43.

Figure 44:
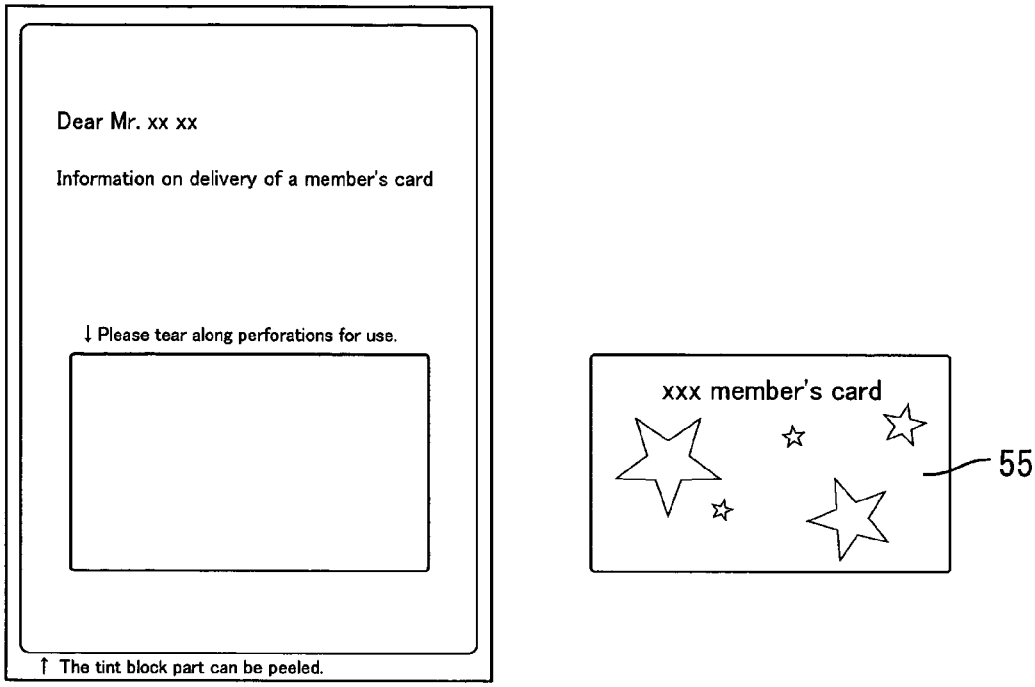
FIG. 44 is a back view of a state where an auxiliary card is separated from the postcard.
Figure 45:
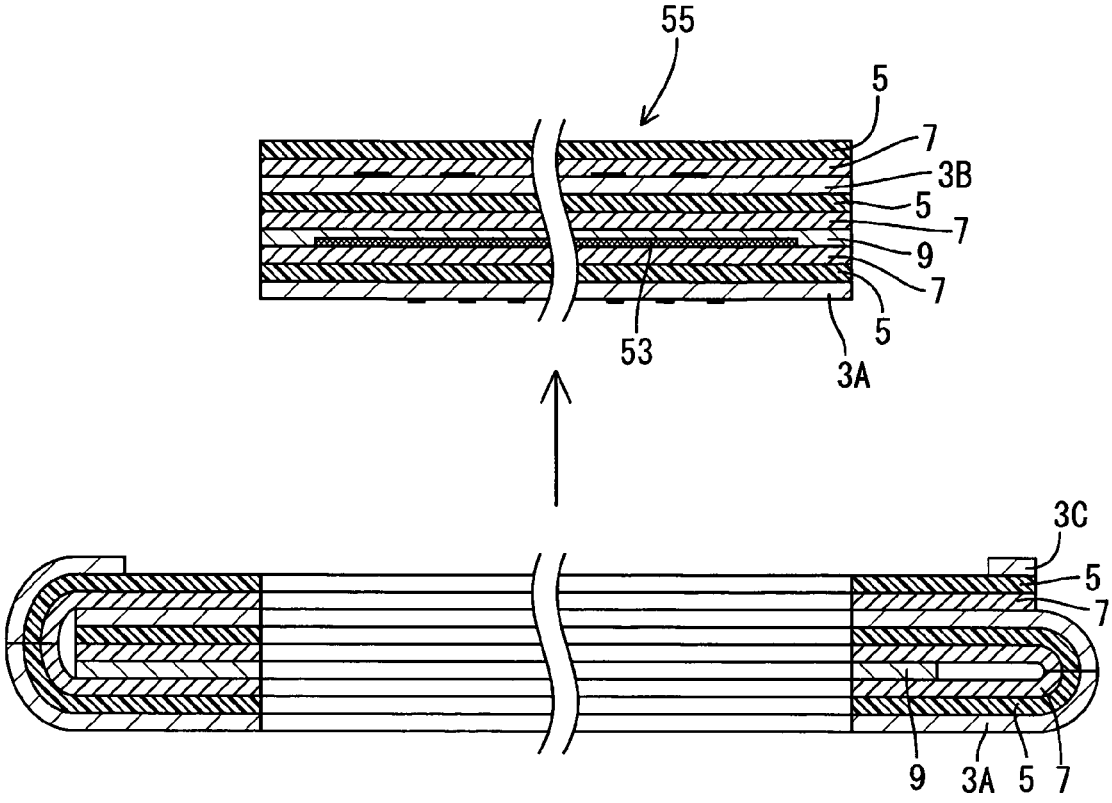
FIG. 45 is a sectional view of FIG. 44.

Further, in this configuration, tearing along the auxiliary card tearing perforations 51 (51A, 51B and 51C) allows an auxiliary card 55 to be torn away and separated from the rest of the postcard, as shown in FIGS. 44 and 45. Because an IC chip unit 53 may be embedded in the auxiliary card 55, the auxiliary card 55 may be widely used as a card for a variety of purposes, such as an ID card, a ticket, or a cash card.

Eighth Embodiment

An eighth embodiment of the invention will be described next with reference to FIGS. 46A through 50.

Figure 47:
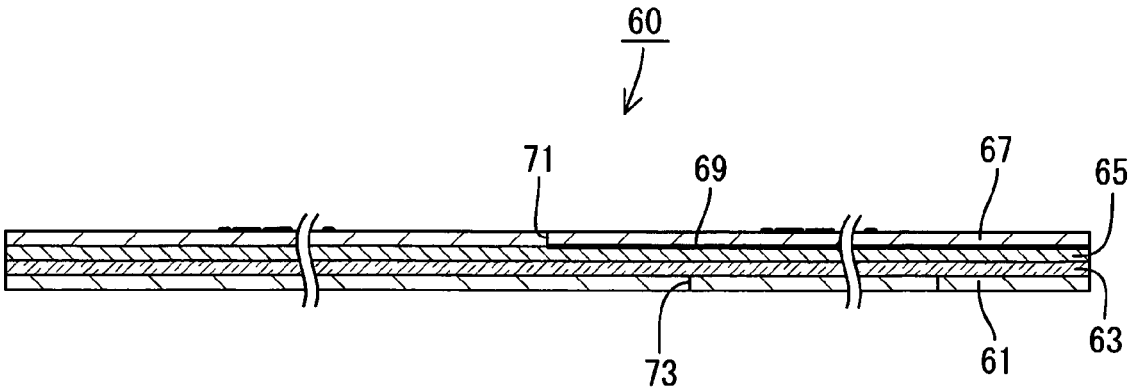
FIG. 47 is sectional view taken along the line A-A in FIG. 46A.

A card forming sheet 60, for forming a confidential card according to this embodiment, is applied to a pay statement distributed to individual workers. As shown in FIG. 47, the card forming sheet 60 is a B5 size sheet including: a base sheet 61, a transparent or translucent film 63 made of polyethylene for example, an adhesive layer 65 made of a general adhesive, and a peeling sheet 67 made of paper on which printing can be performed by an inkjet printer for example, placed over one another in the order described. The base sheet 61 and the film 63 are placed over each other so that they can be peeled apart by breaking the quasi-bonding and after which, the base sheet 61 and the film 63 cannot be re-bonded to each other.

Figure 46A:
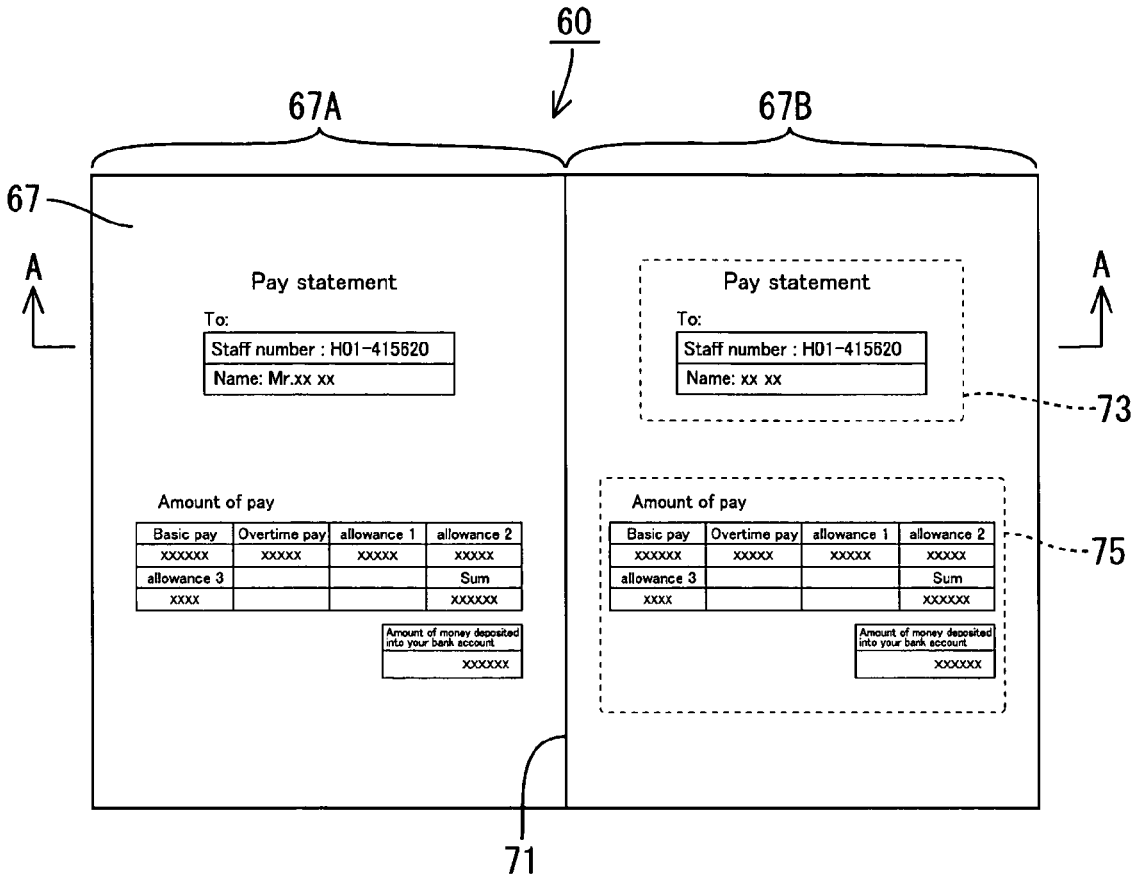
FIG. 46A is a back view of a card forming sheet according to an eighth embodiment.
Figure 46B:
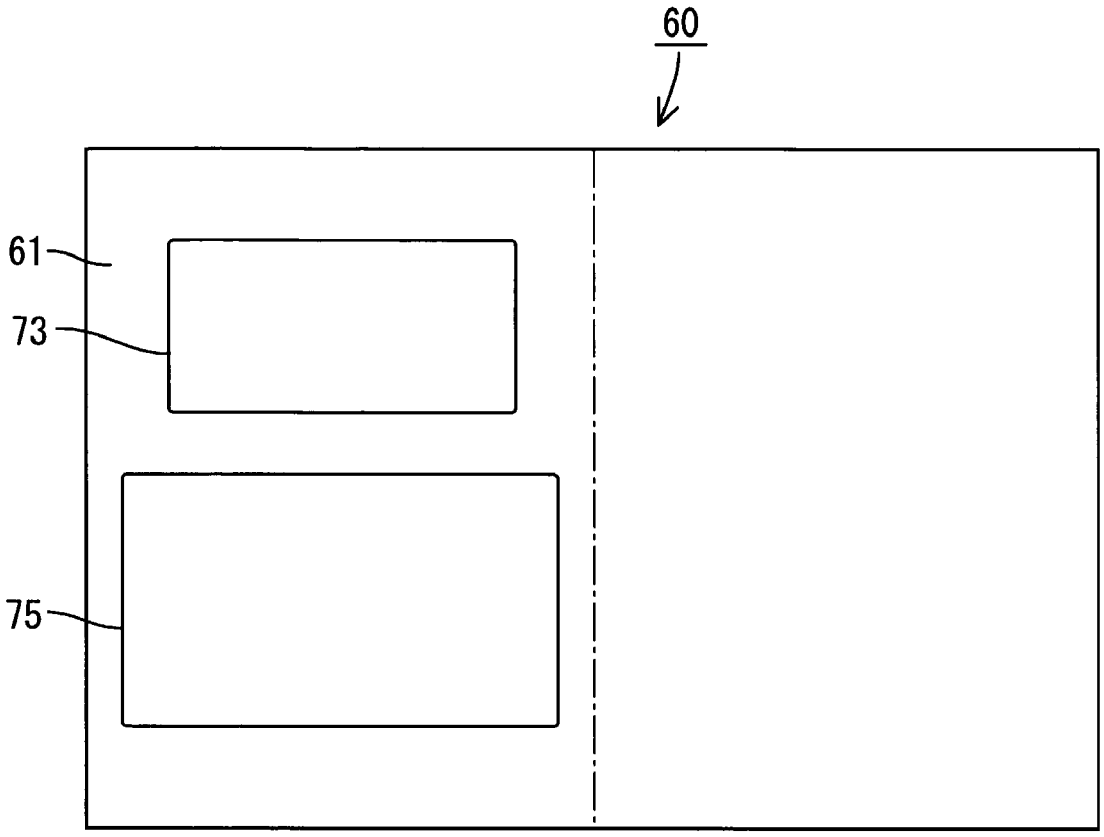
FIG. 46B is a front view of the card forming sheet in FIG. 46A.

FIG. 46A is a back view of the card forming sheet 60 according to this embodiment as seen from the side of the peeling sheet 67. FIG. 46B is a front view thereof as seen from the side 11 of the base sheet 61. As shown in FIGS. 46A, 46B, and 47, in the peeling sheet 67, a half-cut tearable line 71 divides the peeling sheet 67 into two areas; a first area 67A and a second area 67B are formed at a location where the peeling sheet 67 is longitudinally divided into two. The first area 67A is an area for the recipient of the pay and the second area 67B is an area for the payer (i.e., the company for example).

In an area of the base sheet 61, placed over the second area 67B of the peeling sheet 67, two tearable lines 73 and 75 are formed in closed loop shapes. The two tearable lines 73 and 75 are respectively placed in upper and lower locations, as shown in FIGS. 46A and 46B, and have different sizes such that an area surrounded by the upper line (hereinafter referred to as a first tearable line 73) is smaller, and an area surrounded by the lower line (hereinafter referred to as a second tearable line 75) is larger.

On the surface of the second area 67B of the peeling sheet 67 that faces an adhesive layer 65, a peeling agent layer 69 is provided that allows the second area 67B to be easily peeled away from the adhesive layer 65 (see FIG. 47).

A method of using a card forming sheet 60 according to this embodiment will be described next.

Figure 48A:
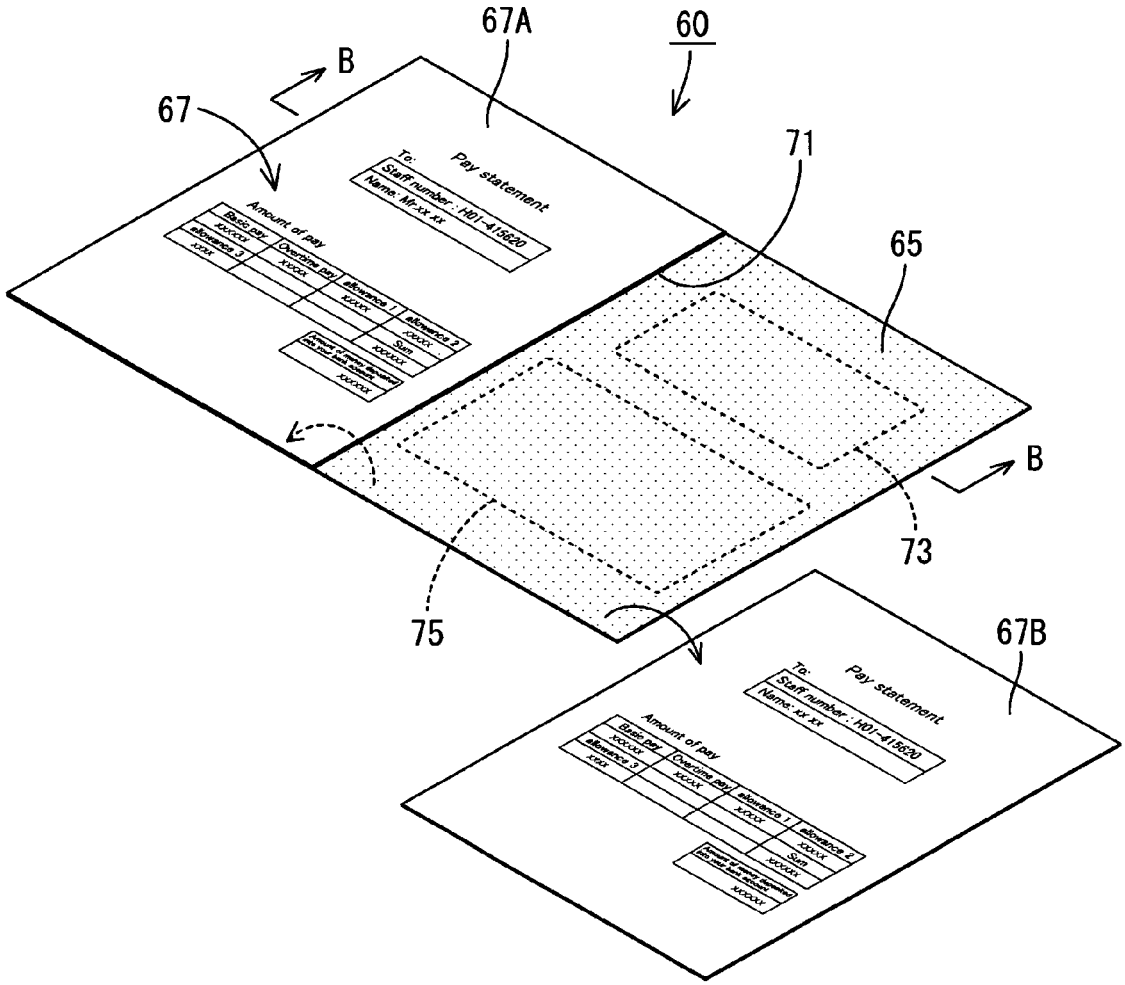
FIG. 48A is a perspective view of a state where a second area of a peeling sheet is peeled.

In the use of the card forming sheet 60, a staff number, name, and pay statement of each worker are first printed by a printer at two locations; the first area 67A and the second area 67B of the peeling sheet 67, as shown in FIG. 46. At this time, the staff number and name printed on the first area 67A are printed at a location corresponding to an area surrounded by the first tearable line 73 when the card forming sheet 60 is folded into two, as shown in FIG. 48A mentioned below. Similarly, the pay statement is printed at a location corresponding to an area surrounded by the second tearable line 75.

Figure 48B:
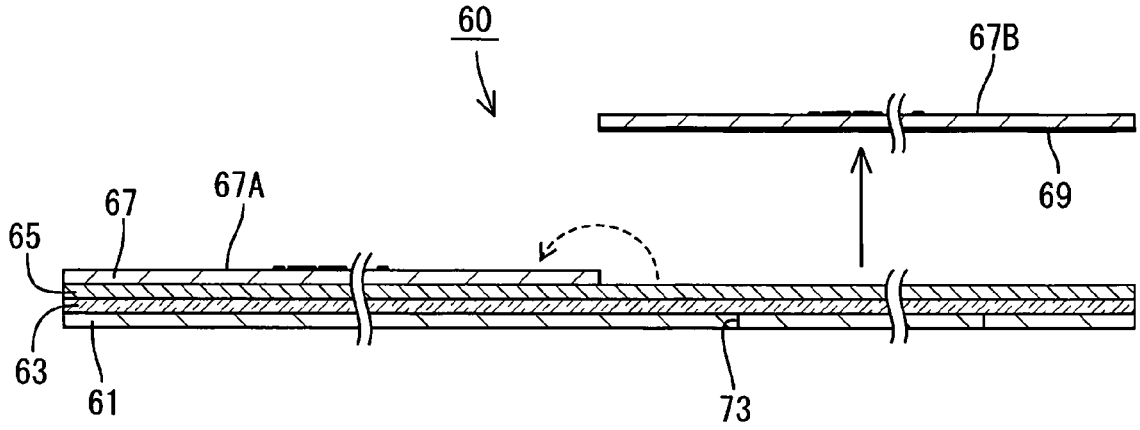
FIG. 48B is a sectional view taken along the line B-B in FIG. 48A.
Figure 49A:
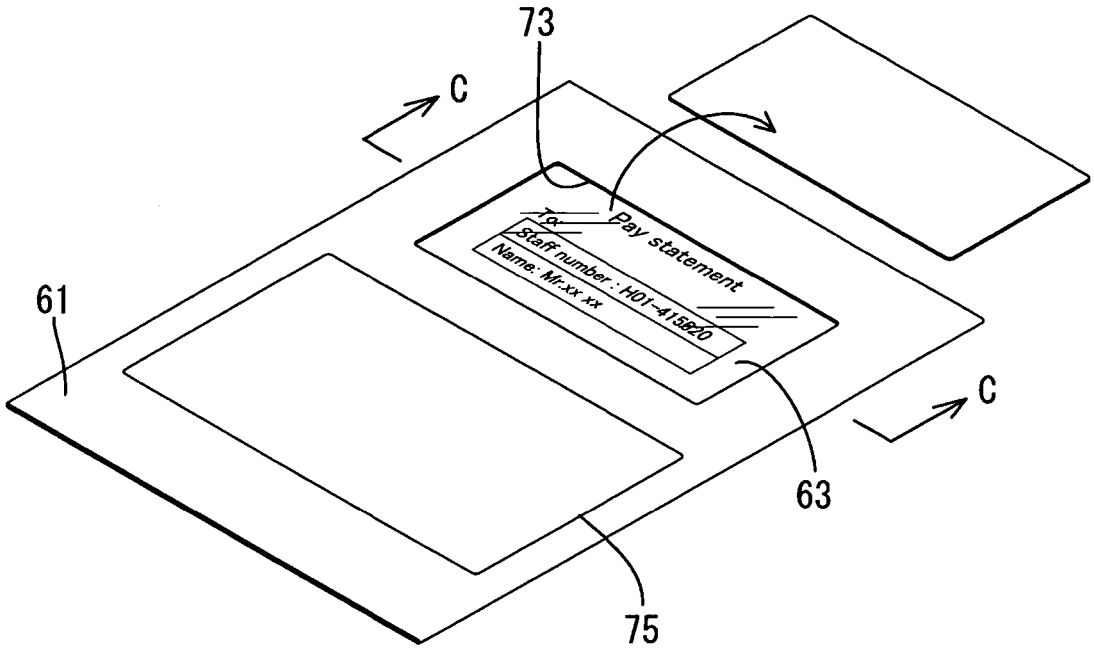
FIG. 49A is a perspective view of a state where the card forming sheet is folded into two.
Figure 49B:
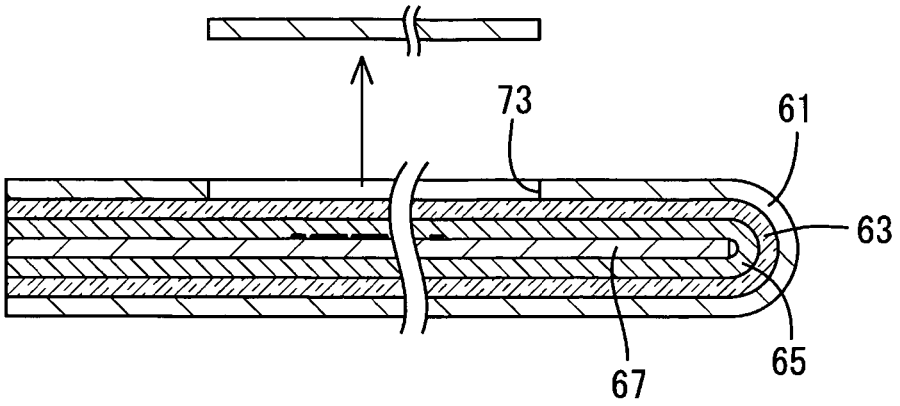
FIG. 49B is a sectional view taken along the line C-C in FIG. 49A.

For example, a corner of the second area 67B of the peeling sheet 67 is picked up from the adhesive layer 65, and the second area 67B is separated from the first area 67A along the tearable line 71 and peeled away from the adhesive layer 65 (see FIGS. 48A and 48B). The peeled away second area 67B can then be stored for the company as a pay stub record of the pay statement.

At this point, the peeling of the second area 67B of the peeling sheet 67 exposes a part of the adhesive layer 65 (i.e., the part corresponding to the second area 67B of the peeling sheet 67).

The card forming sheet 60 is then folded into two along the tearable line 71 so that the exposed adhesive layer 65 is placed to the inside. The adhesive layer 65 is placed over and bonded to the first area 67A of the peeling sheet 67 in order to conceal the first area 67A. One end of an inner area of the first tearable line 73, formed in the base sheet 61, is picked up and the interior area is peeled away from the film 63 bounded by the first tearable line 73 (see FIGS. 49A and 49B). This allows the staff number and name printed on the first area 67A of the peeling sheet 67 to be visible to the outside through the film 63 and the adhesive layer 65. On the other hand, the pay statement is still protected by the base sheet 61 so that the confidential contents of the pay statement cannot be read. In this configuration, a confidential pay statement card is distributed to each worker.

Figure 50:
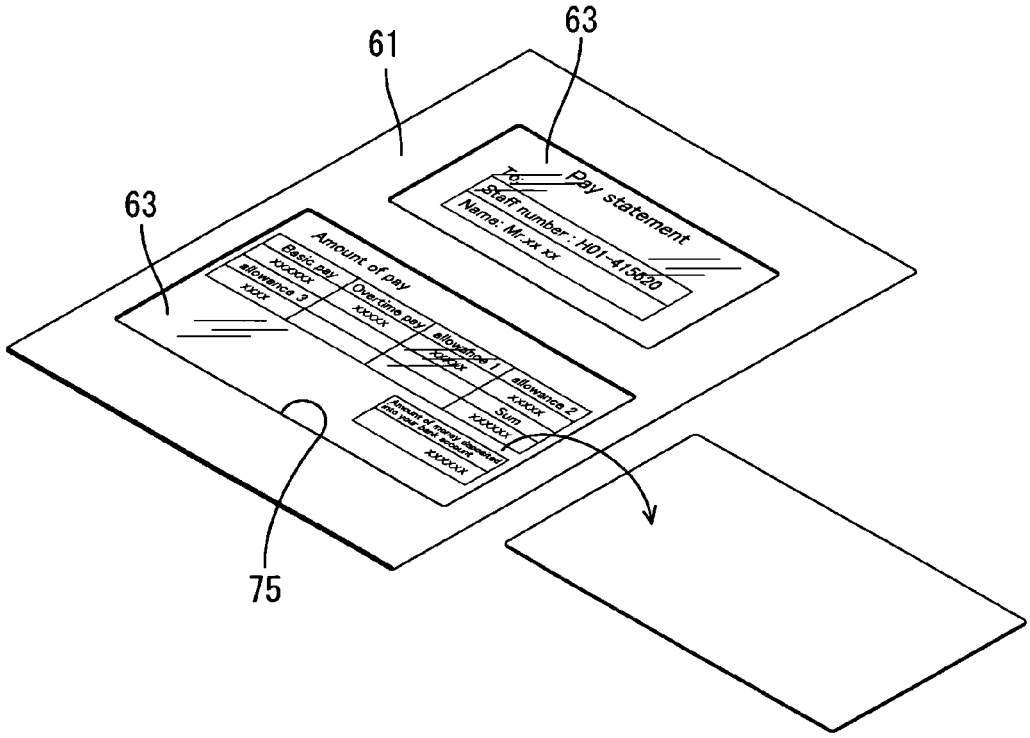
FIG. 50 is a perspective view of a case where information printed on the peeling sheet is read.

The worker who receives the confidential card formed using such a card forming sheet 60 picks up one end of the interior area of the second tearable line 75, formed in the base sheet 61, and peels away the interior area from the film 63 bounded by the tearable line 75 (see FIG. 50). This allows the pay statement information printed on the first area 67A of the peeling sheet 67 to be read through the film 63 and the adhesive layer 65.

Consequently, the card forming sheet 60 according to this embodiment allows a pay statement to be distributed to a worker and a pay stub of the pay statement for the company records to be formed at the same time through the relatively easy operations of printing upon the peeling sheet 67, peeling away a part of the peeling sheet 67 (the second area 67B) from the adhesive layer 65, folding and bonding the remaining card forming sheet 60, and peeling away an interior area bounded by the first tearable line 73 of the base sheet 61. Also, the base sheet 61 cannot be bonded again to the film 63, which ensures the confidentiality of the information concealed by the base sheet 61. Further, the confidential card formed using the card forming sheet 60 produces reduced waste and is environmentally friendly.

Ninth Embodiment

Next, a ninth embodiment of the invention will be described with reference to FIGS. 51A through 53. The same components as in the eighth embodiment will be denoted by the same reference numerals, and descriptions of similar structures, operations, and advantages thereof will be omitted.

Figure 51A:
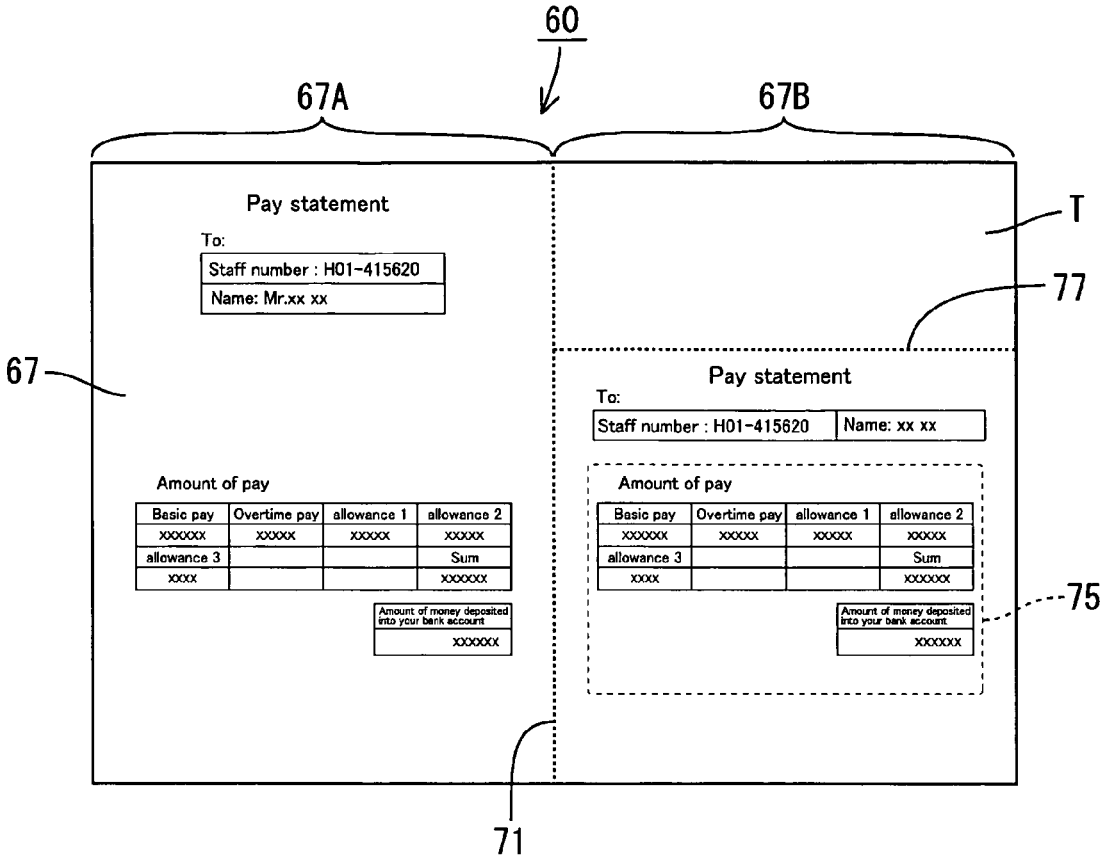
FIG. 51A is a back view of a card forming sheet according to a ninth embodiment.
Figure 51B:
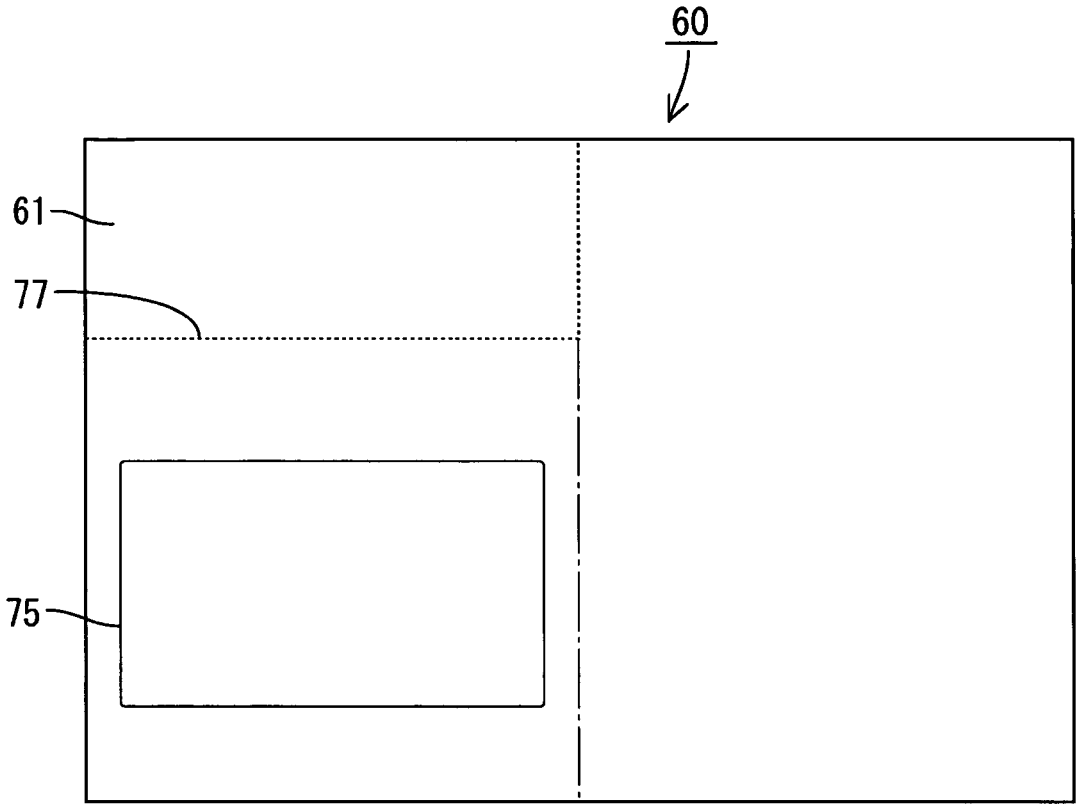
FIG. 51B is a front view of the card forming sheet in FIG. 51A.
Figure 52:
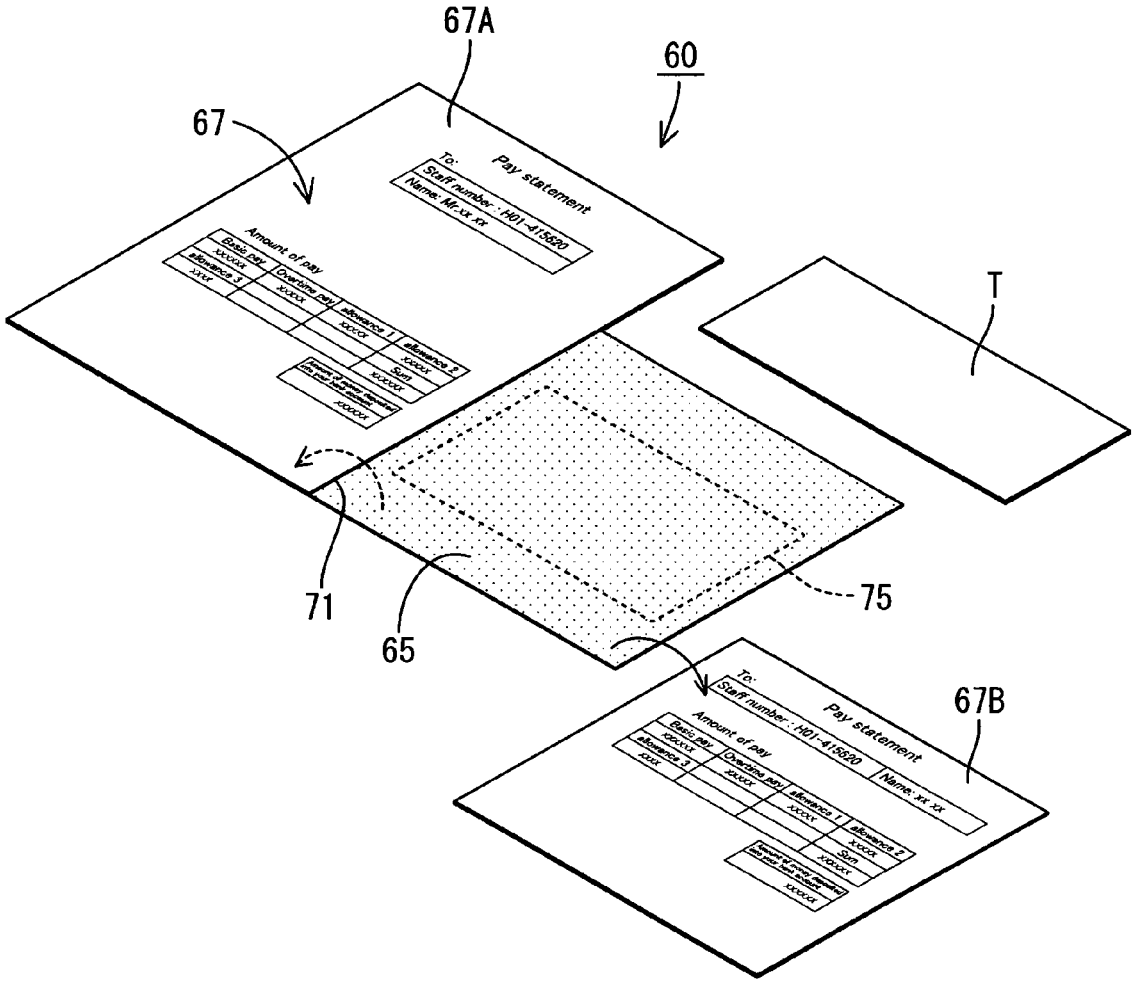
FIG. 52 is a perspective view of a case where a part of the card forming sheet is separated and a second area of a peeling sheet is peeled.
Figure 53:
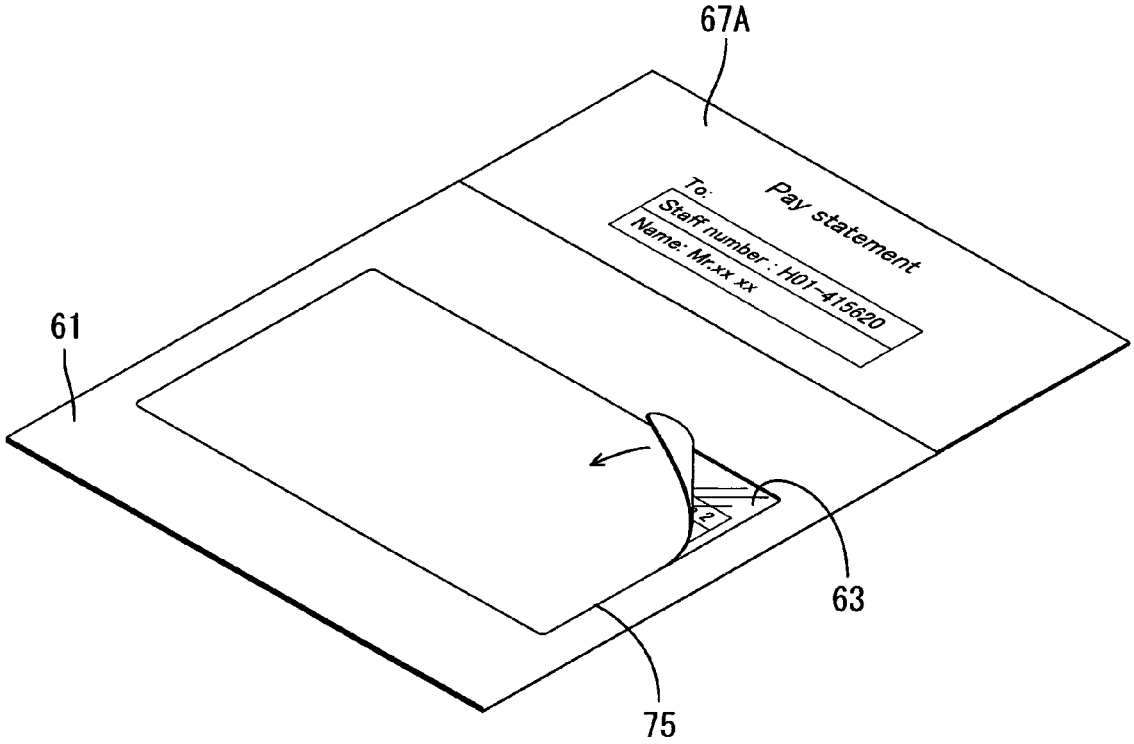
FIG. 53 is a perspective view of a state where the card forming sheet is folded into two.

A card forming sheet 60 according to this embodiment is different from that according to the eighth embodiment in that a tearable line 77 further divides the second area 67B into two sections and is formed in addition to the tearable line 71 formed at a location where the peeling sheet 67 is longitudinally divided into two, as shown in FIG. 51A. The tearable line 77 is formed along an upper side in an upper location of the second area 67B, as seen in FIGS. 51A and 51B. The tearable line 77 is provided to penetrate the peeling sheet 67 and also an adhesive layer 65, a transparent film 63, and a base sheet 61. An upper portion of the tearable line 71, above the tearable line 77 in the drawings, is formed to collectively penetrate the adhesive layer 65, the film 63, and the base sheet 61. Consequently, a partial area T in the second area 67B, surrounded by a part of the tearable line 71 and the tearable line 77, can be integrally separated apart from other areas.

The tearable line 71 in the eighth embodiment is a half cut line. However, the tearable lines 71 and 77 in the ninth embodiment can be formed by micro-perforations for example.

In an area of the base sheet 61 placed over the second area 67B of the peeling sheet 67, a tearable line 75 is formed in a closed loop shape.

Similarly to the eighth embodiment, in using the card forming sheet 60 according to this embodiment, the staff number, name, and pay statement information of a worker are printed by a printer in two places; a first area 67A and a second area 67B of the peeling sheet 67. The partial area T of the peeling sheet 67, surrounded by the tearable lines 71 and 77, is integrally separated apart from other areas together with the adhesive layer 65, the film 63, and the base sheet 61 (see FIG. 52). The remainder of the second area 67B of the peeling sheet 67 is then separated from the first area 67A and peeled away from the adhesive layer 65. The peeled away second area 67B is stored as a pay stub record of the pay statement for the company.

The card forming sheet 60 is then folded along the tearable line 71 so that the exposed adhesive layer 65 is placed to the inside. The adhesive layer 65 is placed over and bonded to the first area 67A of the peeling sheet 67 (see FIG. 53).

At this point in time, an upper portion of the first area 67A, where non-confidential information such as the name of the worker is printed, is exposed due to the removal of the partial area T of the second area 67B. This allows some information, such as the name, to be read.

Consequently, the card forming sheet 60 according to this embodiment also allows a pay statement to be distributed to the worker and a pay stub of the pay statement for the company records to be formed at the same time by a series of relatively easy operations.

Tenth Embodiment

A tenth embodiment of the invention will be described next with reference to FIGS. 54A through 56. The same components as in the eighth embodiment will be denoted by the same reference numerals, and descriptions of similar structures, operations, and advantages thereof will be omitted.

Figure 54A:
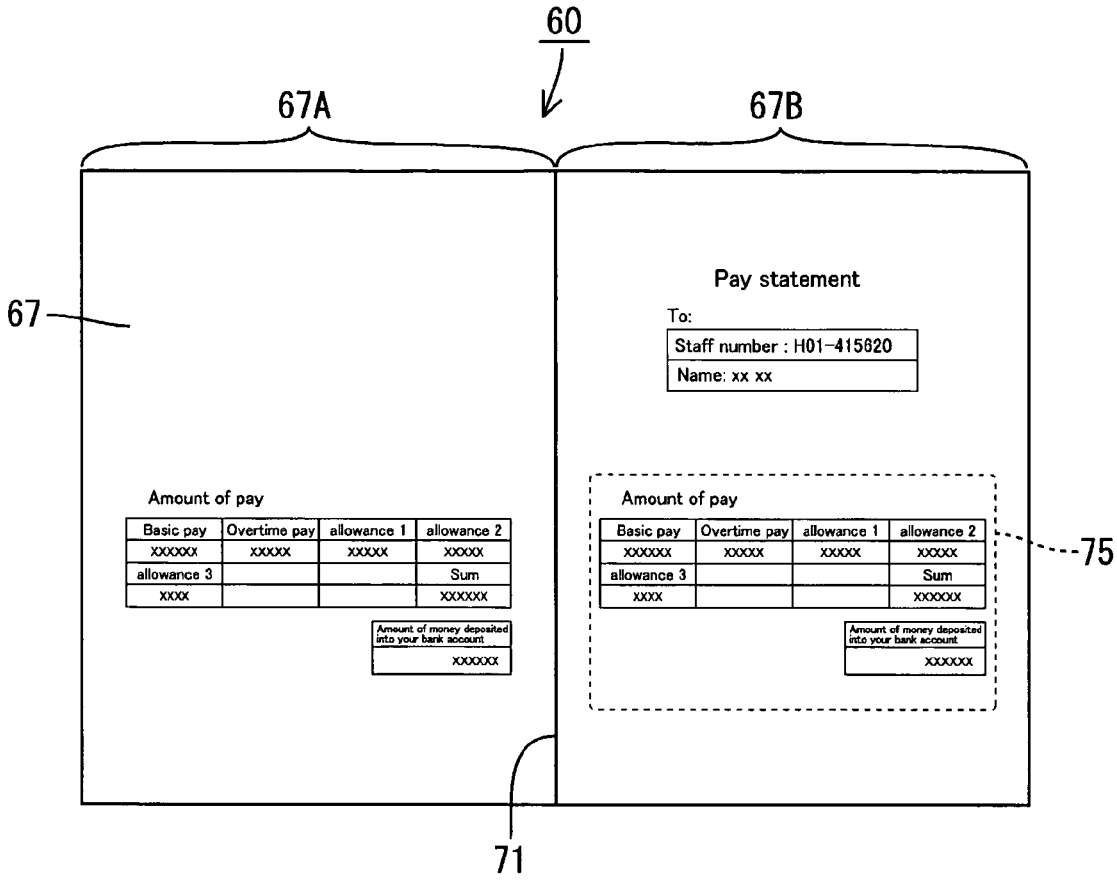
FIG. 54A is a back view of a card forming sheet according to a tenth embodiment.
Figure 54B:
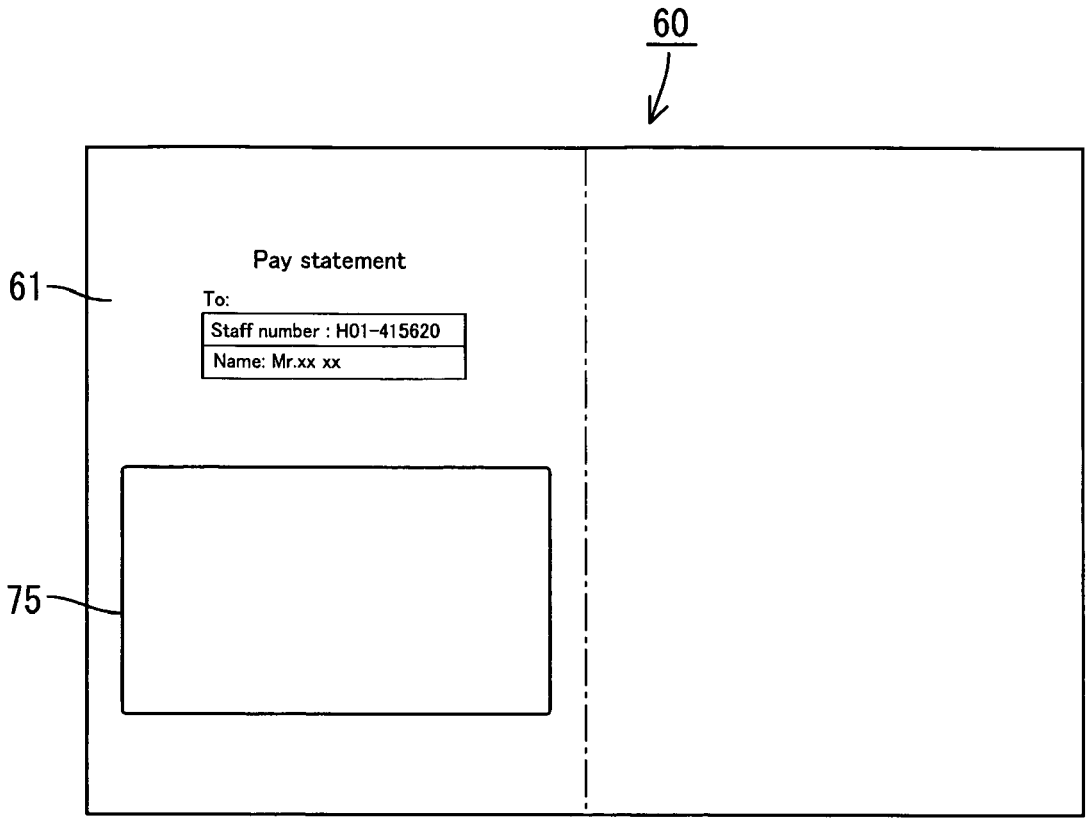
FIG. 54B is a front view of the card forming sheet in FIG. 54A.
Figure 55:
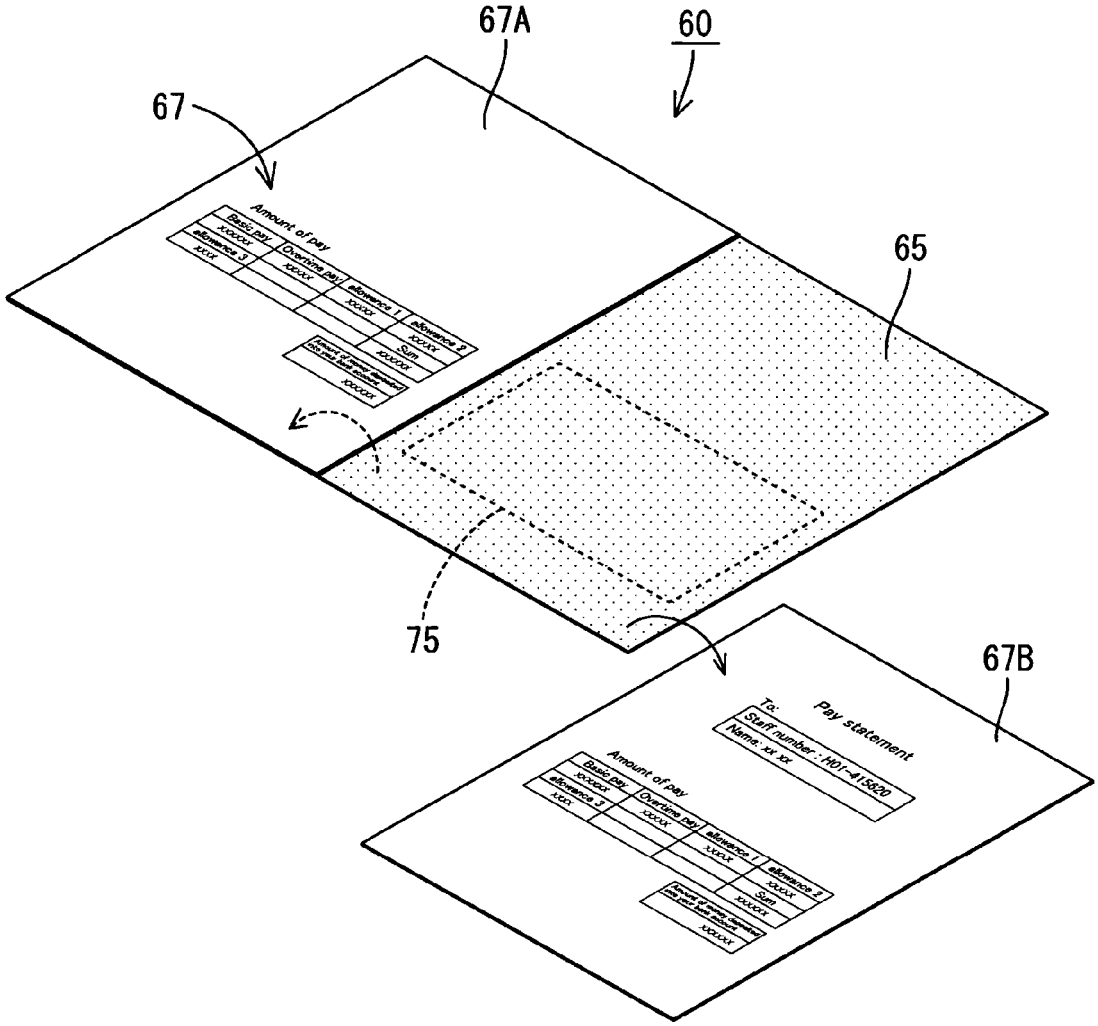
FIG. 55 is a perspective view of a state where a second area of a peeling sheet is peeled.
Figure 56:
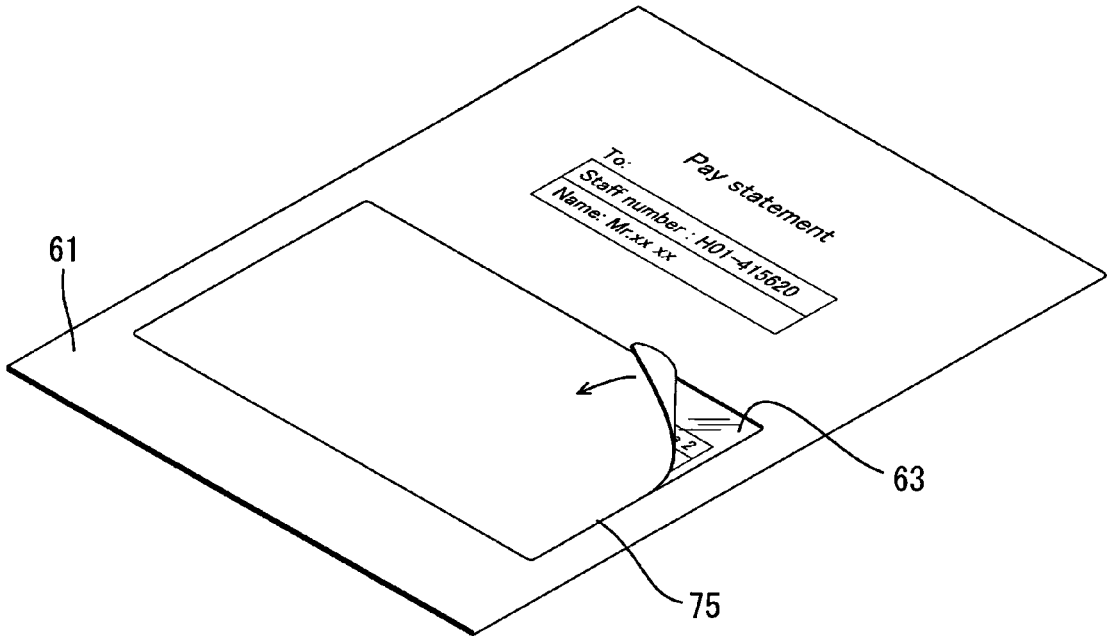
FIG. 56 is a perspective view of a state where the card forming sheet is folded into two.

A card forming sheet 60 according to this embodiment is different from the card forming sheet 60 according to the eighth embodiment in that information such as a staff number or name is not printed on a peeling sheet 67, but is instead directly printed on a base sheet 61 so as to be visible from the outside of a completed card (as shown in FIG. 54B).

In the use of the card forming sheet 60 according to this embodiment, a pay statement is first printed in two places; a first area 67A and a second area 67B of the peeling sheet 67, as shown in FIG. 54A. However, information such as a staff number or name is not printed on the first area 67A, but is instead printed on the base sheet 61 (a back surface of the second area 67B). The second area 67B is then separated from the first area 67A along a tearable line 71 and peeled away from an adhesive layer 65. The separated second area 67B is used as a pay stub for the company records (see FIG. 55). The exposed adhesive layer 65 is placed over and bonded to the first area 67A in order to complete a confidential pay statement card to be distributed to a worker (see FIG. 56).

Therefore, the card forming sheet 60, according to this embodiment, allows for a relatively easy operation in forming the confidential card.

Other Embodiments

The invention is not limited to the embodiments described in the above description and drawings. For example, the following embodiments also fall within the technical scope of the invention. In addition to the following embodiments, various modifications may be made without departing from the teachings and subject matter of the invention.

(1) In the first through seventh embodiments, the tint block is shown as being printed upon the concealing part 3C, but no tint block is required to be printed on the concealing part 3C.

(2) In the first through seventh embodiments, the layout of the address describing part 3A, the information describing part 3B, and the concealing part 3C, is shown by examples limited to a specific configuration. However, the layout is not limited as long as the information describing part 3B is adjacent to one side of the address describing part 3A, and the concealing part 3C is adjacent to one different side.

(3) In the first through seventh embodiments, the first perforations 11 and the second perforations 13 are used as the fold lines. However, the folds are not limited to perforations, and may instead be a folding line or a half cut. In addition, no fold may be provided.

(4) In the first through seventh embodiments, the tearable line is embodied by the perforations. However, the tearable line is not limited to the perforations as long as the line is tearable.

(5) In the first through seventh embodiments, the postcard forming sheet 1 is described as being used for a specific purpose. However, the use of the postcard forming sheet 1 is not limited and may instead be used in any appropriate situation.

(6) In the first through seventh embodiments, the printing sheet 3 made of paper is quasi-bonded to the transparent film 5 made of polyethylene. However, a printing sheet 3 made of composite paper having a back surface coated with polyethylene may be quasi-bonded at the polyethylene side on the back surface to a transparent film 5 made of PET film. When the printing sheet 3 is a composite paper having a back surface coated with polyethylene, a tint block may be printed on the polyethylene on the back surface at a part corresponding to the concealing part 3C.

(7) In the first through seventh embodiments, the postcard forming sheet 1 is folded along a boundary between the address describing part 3A and the information describing part 3B so that the printing sheet 3 is placed to the outside. The peeling sheet 9 on the back surface of the address describing part 3A is peeled away to expose the adhesive layer 7, and the peeling sheet 9B on the back surface of the information describing part 3B is placed over and bonded to the adhesive layer 7 on the back surface of the address describing part 3A. However, the postcard forming sheet 1 may be folded along the boundary between the address describing part 3A and the information describing part 3B so that the printing sheet 3 is placed to the outside, with the peeling sheet 9B on the back surface of the information describing part 3B being peeled away to expose the adhesive layer 7, and the adhesive layer 7 on the back surface of the information describing part 3B may be placed over and bonded to the peeling sheet 9A on the back surface of the address describing part 3A. Alternatively, the postcard forming sheet 1 may be folded along the boundary between the address describing part 3A and the information describing part 3B so that the printing sheet 3 is placed to the outside, with both the peeling sheets 9A and 9B on the back surfaces of the address describing part 3A and the information describing part 3B being peeled away in order to expose the adhesive layer 7, and the adhesive layer 7 on the back surface of the address describing part 3A may be placed over and bonded to the adhesive layer 7 on the back surface of the information describing part 3B.

(8) In the first through seventh embodiments, the example in which the tint block is printed is as a transparency prevention printing. However, the transparency prevention printing is not limited as long as the tint block is printed so as to prevent personal information from being readable there through. For example, solid print may also be used.

(9) In the first through seventh embodiments, the card formed using the card forming paper is a postcard. However, the card is not limited to the form of a postcard, and for example may be a card for communicating a pay statement. The use thereof is also not limited.

(10) In the seventh embodiment, the IC chip unit 53 is shown as embedded in an area surrounded by the first auxiliary card tearing perforations 51A. However, the IC chip unit 53 may be embedded in the area surrounded by the second auxiliary card tearing perforations 51B or the area surrounded by the third auxiliary card tearing perforations 51C. Further, the IC chip unit 53 may be embedded outside of the areas surrounded by the auxiliary card tearing perforations 51A, 51B, and 51C.

(11) In the seventh embodiment, the third auxiliary card tearing perforations 51C is provided from the transparent film 5 to the peeling sheet 9, but instead may be provided from the printing sheet 3 to the peeling sheet 9.

(12) In the seventh embodiment, the size of the auxiliary card 55 to be separated is not limited, and may be of a business card size or an L size for example.

Figure 57A:
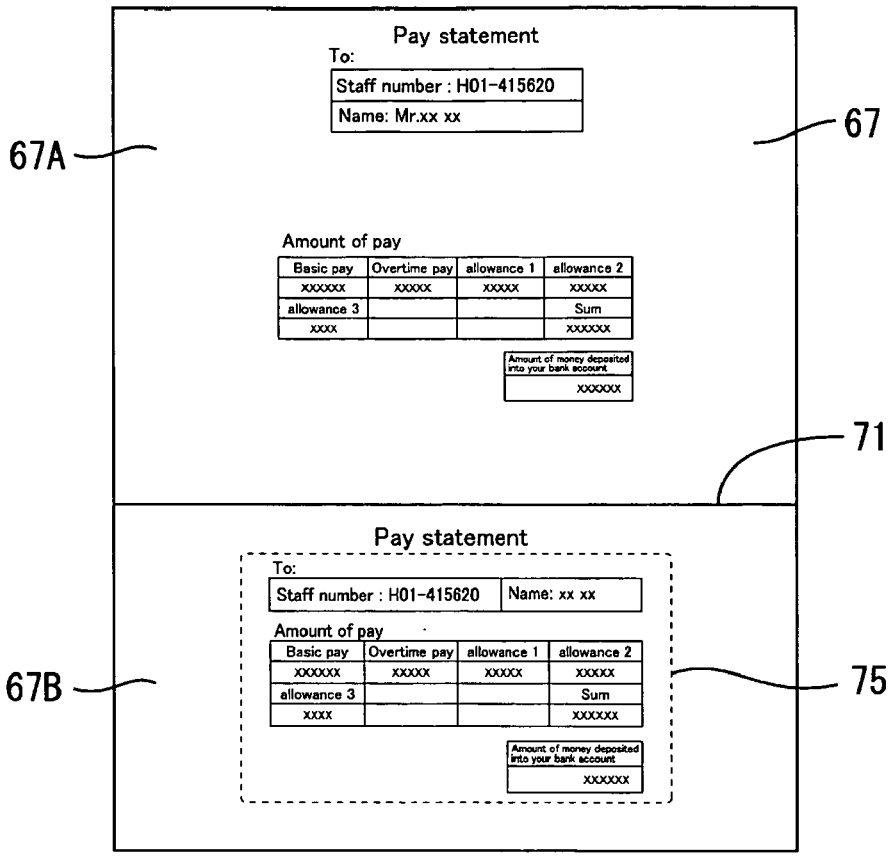
FIG. 57A is a back view of a card forming sheet according to another embodiment.
Figure 57B:
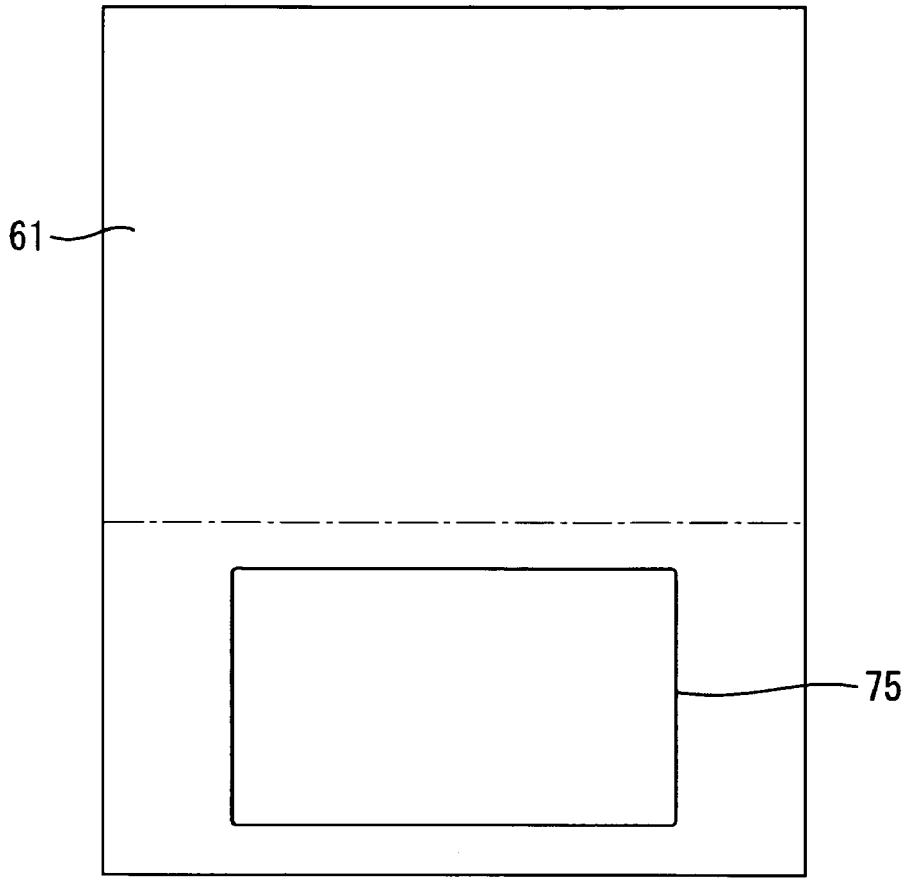
FIG. 57B is a front view of the card forming sheet in FIG. 57A.
Figure 58:
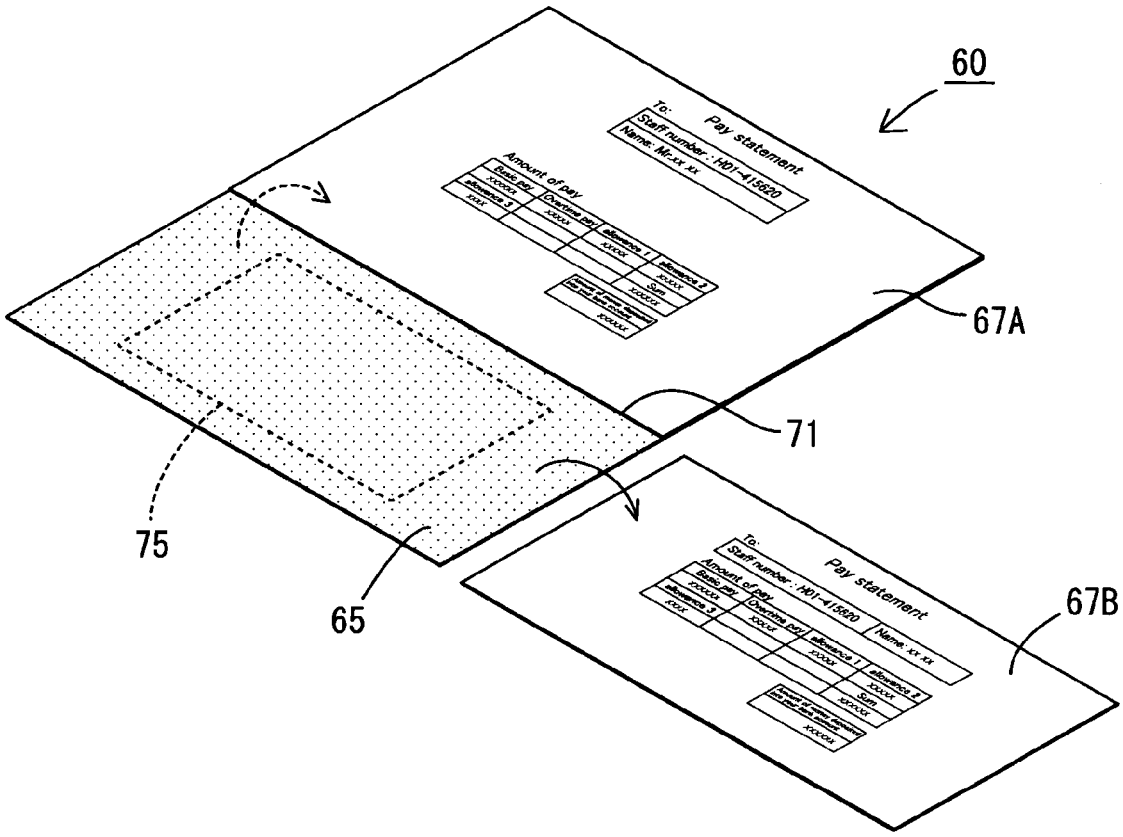
FIG. 58 is a perspective view of a case where a second area of a peeling sheet is peeled.
Figure 59:
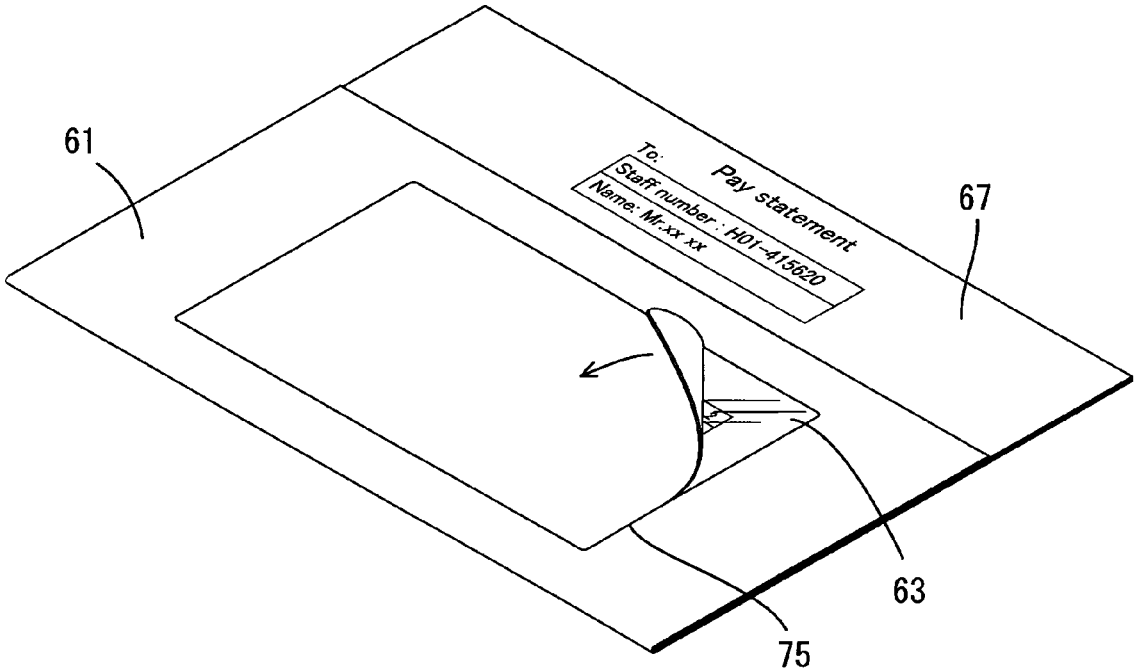
FIG. 59 is a perspective view of a case where the card forming sheet is folded into two.

(13) In the eighth through tenth embodiments, the pay statement to be distributed to the worker and the pay stub of the pay statement for the company records are printed in a laterally arranged manner. However, the printing is not limited to this, and the information may be printed in a vertically arranged manner as shown in FIGS. 57A and 57B. The tearable line 71 in the peeling sheet 67 may be formed in a position slightly displaced downward from a central position, as shown in FIG. 57A, rather than a position where the peeling sheet 67 is equally divided into two. In this case, when a card forming sheet 60 is folded along a tearable line 71 so that an exposed adhesive layer 65 is placed inside as shown in FIG. 58, and the adhesive layer 65 is placed over and bonded to a first area 67A of a peeling sheet 67, information such as the staff number or name printed on an upper end of the peeling sheet 67 is exposed so as to be directly readable on the completed card, as shown in FIG. 59.

Figure 60A:
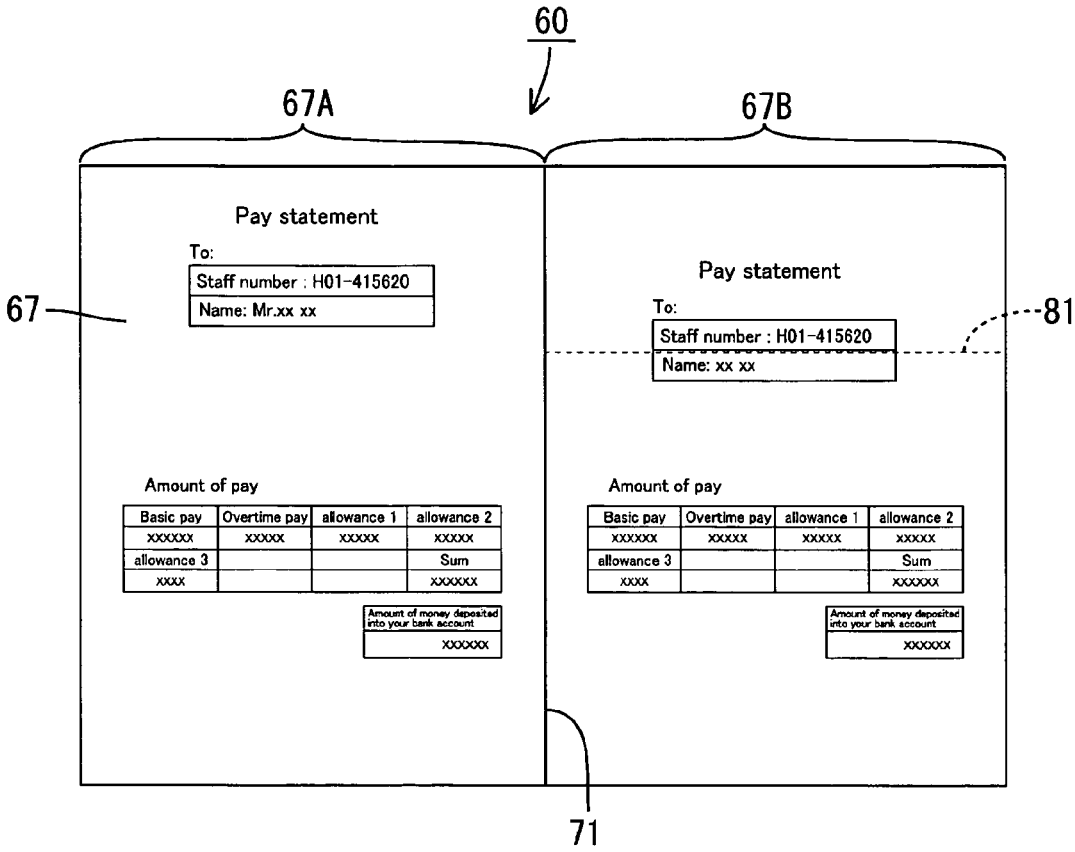
FIG. 60A is a back view of a card forming sheet according to another embodiment.
Figure 60B:
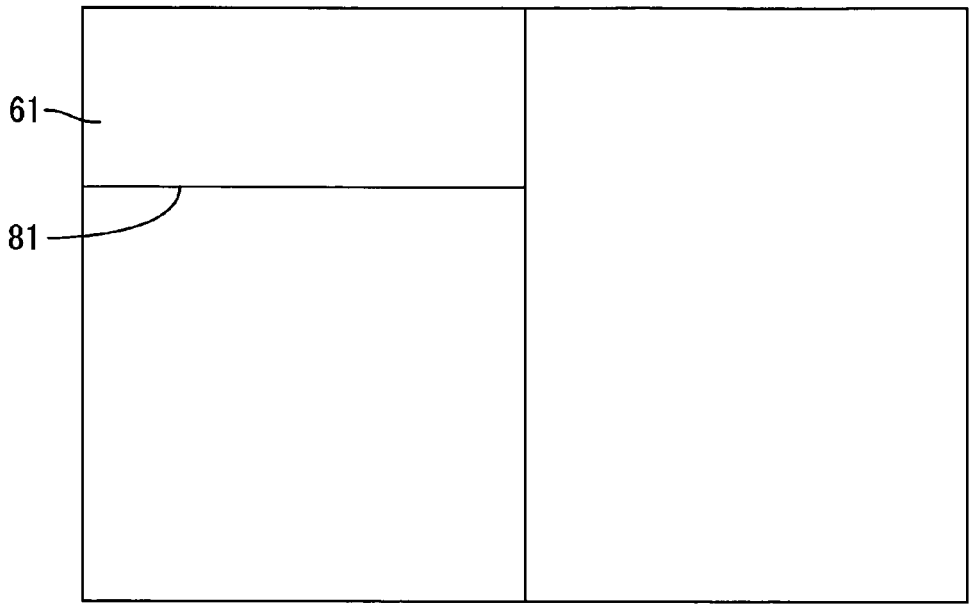
FIG. 60B is a front view of the card forming sheet in FIG. 60A.
Figure 61:
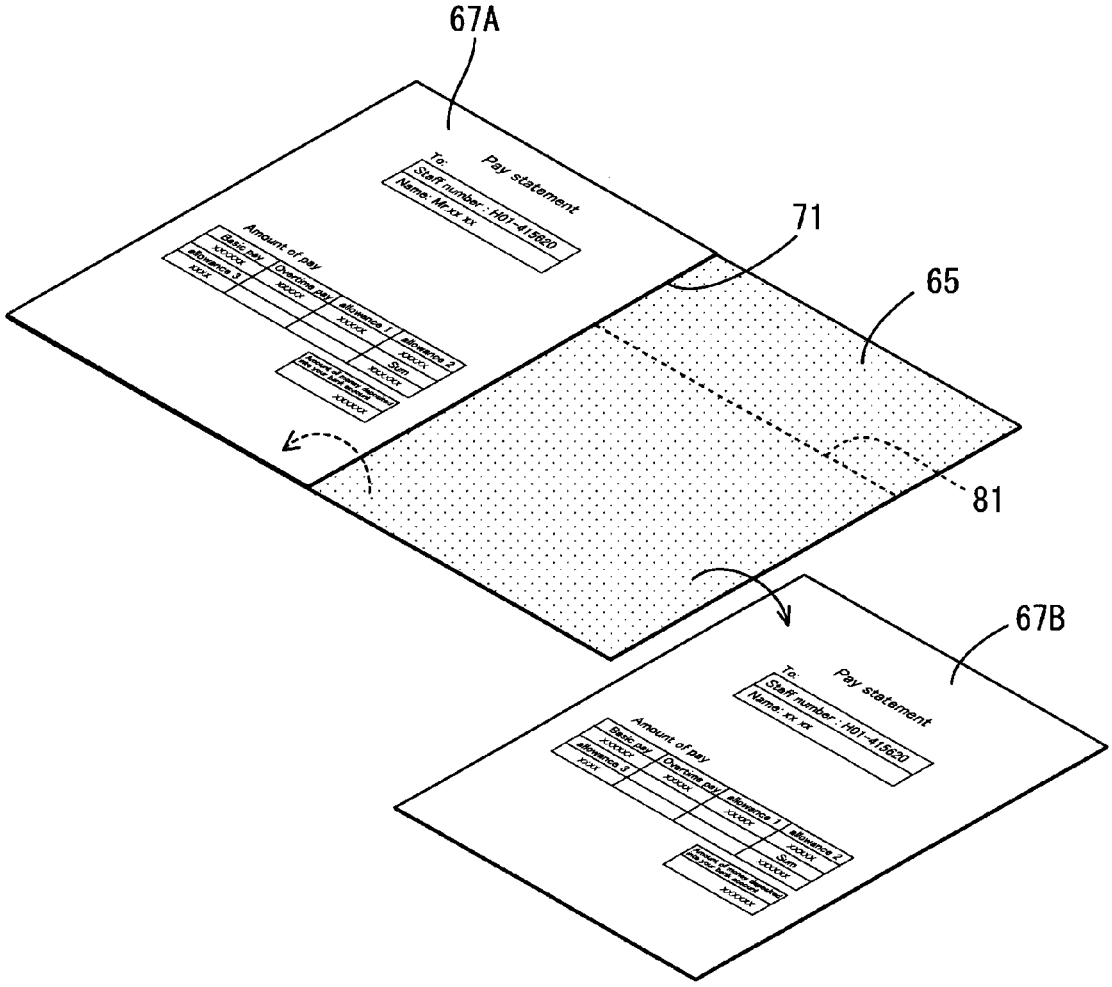
FIG. 61 is a perspective view of a case where a second area of a peeling sheet is peeled.
Figure 62A:
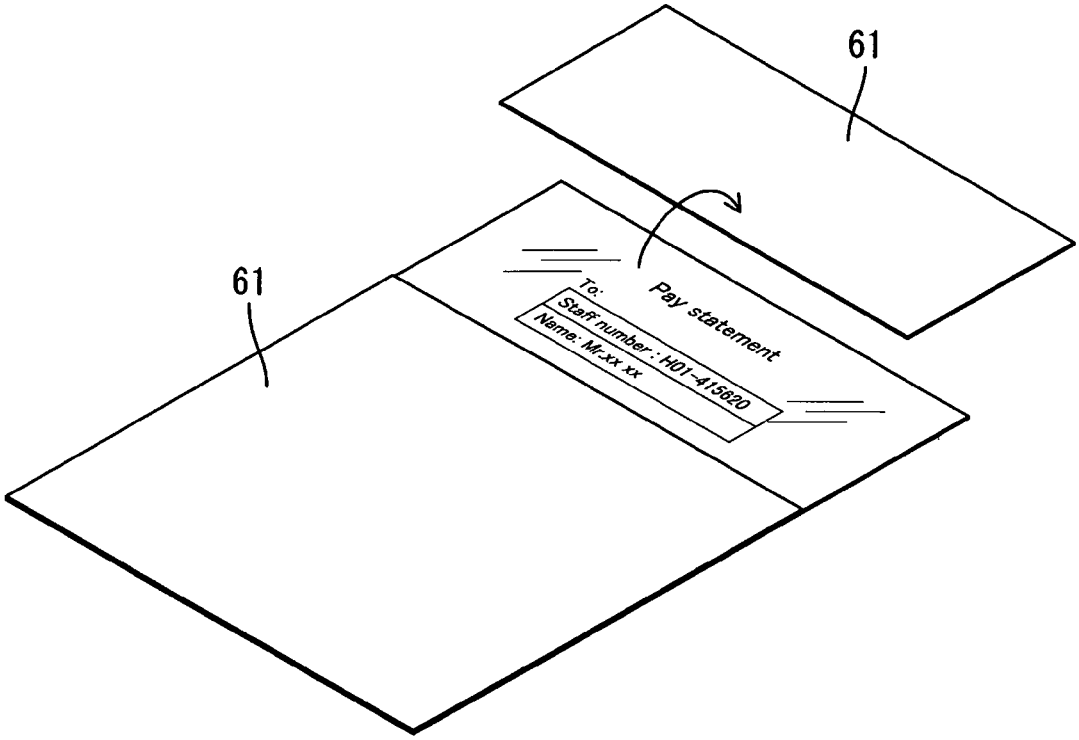
FIG. 62 is a perspective view of a case where information printed on the peeling sheet is read.
Figure 62B:
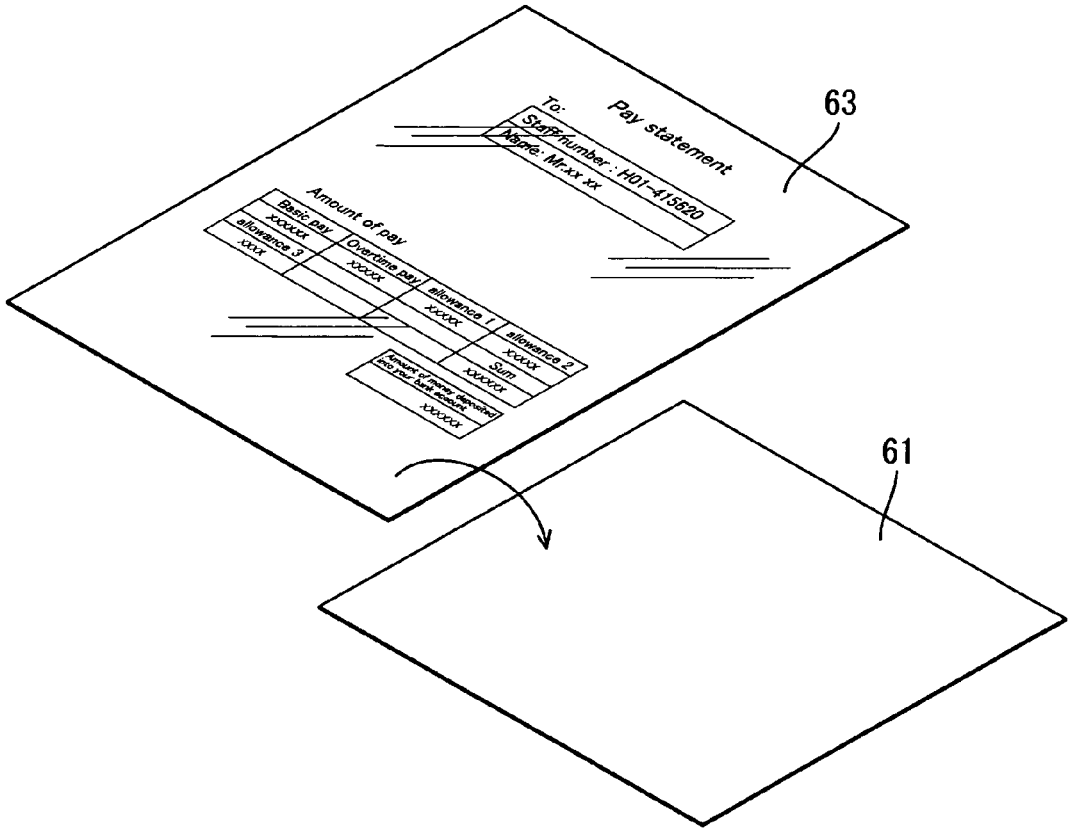
Figure 63:
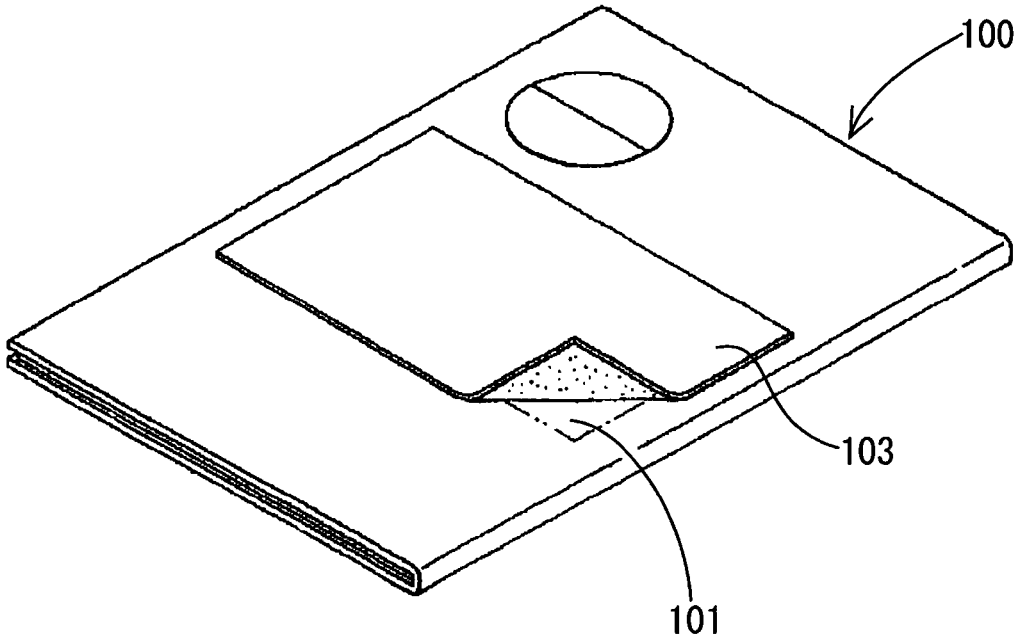
FIG. 63 is a perspective view of a conventional concealing postcard.

(14) In the eighth through tenth embodiments, the tearable line 75 is formed in a closed loop shape in the base sheet 61, and the inner area bounded by the tearable line 75 is peeled away so as to allow the information printed on the peeling sheet 67 to be read. Howver, the invention should not be limited to this example, a simple linear tearable line 81 may be formed as shown in FIGS. 60A and 60B. In this case, as shown in FIG. 61, a second area 67B is separated from a first area 67A along a tearable line 71 and peeled away from an adhesive layer 65. A card forming sheet 60 is then folded into two along the tearable line 71 so that the exposed adhesive layer 65 is placed to the inside. The adhesive layer 65 is placed over and bonded to the first area 67A of the peeling sheet 67, so as to conceal the first area 67A. The base sheet 61 is peeled away to allow printed information to be read as shown in FIGS. 62A and 62B.

(15) In the eighth through tenth embodiments, each tearable line is shown as a half cut or micro-perforations line. However, the tearable line is not limited to these specific examples as long as the tearable line is tearable.

(16) In the eighth through tenth embodiments, the card forming sheet for forming the confidential card of a pay statement is described as an example, but should not be limited to this example. The card forming sheet may be applied to other confidential cards.

(17) In the first through tenth embodiments, the printing sheet or the base sheet is quasi-bonded to the film in the following manner for example. Specifically, a thermoplastic resin similar to a material of the film is previously laminated on the back surface of the printing sheet or the base sheet, and then this sheet is laminated on the film and quasi-bonded by slightly melting the thermoplastic resin. At this point, the laminate on the back surface of the printing sheet or the base sheet becomes fused with the film.

(18) In the first through tenth embodiments, the size of the card forming sheet is not limited. The sheet may be A3, A4, A5, A6, B5 or B4 size.

(19) In the first through tenth embodiments, materials and thicknesses of the printing sheet, the film (transparent or translucent), the base sheet, the adhesive layer, and the peeling sheet are not limited to the examples specified.

(20) In the first through tenth embodiments, the various areas are described as an address describing part and an information describing part. However, the areas are not limited to any specific type of information. In addition, the various areas are not limited to text-based information, i.e., pictures, graphs, and other appropriate information communicating techniques may be used.

The invention claimed is:

1. A card forming sheet comprising:

a printing sheet including an address describing panel, an information describing panel, a concealing panel, a first fold line, and a second fold line, the address describing panel having a first edge and a second edge opposite the first edge, the address describing panel enabling an address to be printed thereon, the information describing panel being disposed adjacent the first edge of the address describing panel and enabling personal information to be printed thereon, and the concealing panel being disposed adjacent the second edge of the address describing panel and having a pattern printed thereon;

a transparent film disposed on the printing sheet;

a transparent adhesive layer disposed on the transparent film; and a peeling sheet disposed on the transparent adhesive layer, wherein the printing sheet is capable of being peeled from the transparent film and is incapable of re-bonding to the transparent film, and wherein the first fold line extends between the address describing panel and the information describing panel, and the second fold line extends between the address describing panel and the concealing panel.

2. The card forming sheet according to claim 1, wherein the peeling sheet includes a part disposed on a back surface of the address describing panel and has a pattern printed thereon.

3. The card forming sheet according to claim 1, wherein the peeling sheet includes a part disposed on a back surface of the information describing panel and has a pattern printed thereon.

4. The card forming sheet according to claim 2, wherein the concealing panel has a closed loop slit.

5. The card forming sheet according to claim 4, wherein the slit is substantially rectangular and has a side aligned with the second fold line.

6. The card forming sheet according to claim 1, wherein the first and second fold lines are perforations.

* * * * *